US010221615B2

(12) United States Patent
Meyerink et al.

(10) Patent No.: US 10,221,615 B2
(45) Date of Patent: Mar. 5, 2019

(54) SHUTTER ASSEMBLY WITH MOTORIZED LOUVER DRIVE SYSTEM

(71) Applicant: Hunter Douglas, Inc., Pearl River, NY (US)

(72) Inventors: Larry Meyerink, Dresden (CA); Anthony Batte, Glencoe (CA); Dean Grubb, Appin (CA)

(73) Assignee: Hunter Douglas Inc., Pearl River, NY (US)

( * ) Notice: Subject to any disclaimer, the term of this patent is extended or adjusted under 35 U.S.C. 154(b) by 203 days.

(21) Appl. No.: 15/190,586

(22) Filed: Jun. 23, 2016

(65) Prior Publication Data

US 2016/0376834 A1 Dec. 29, 2016

Related U.S. Application Data

(60) Provisional application No. 62/300,075, filed on Feb. 26, 2016, provisional application No. 62/293,337, filed on Feb. 10, 2016, provisional application No. 62/252,598, filed on Nov. 9, 2015, provisional application No. 62/202,746, filed on Aug. 7, 2015, provisional application No. 62/188,276, filed on Jul. 2, 2015, provisional application No. 62/184,282, filed on Jun. 25, 2015.

(51) Int. Cl.
*E06B 7/096* (2006.01)
*E06B 9/02* (2006.01)

(52) U.S. Cl.
CPC ..... *E06B 7/096* (2013.01); *E06B 9/02* (2013.01)

(58) Field of Classification Search
CPC . E06B 7/096; E06B 9/02; E06B 7/084; E06B 7/09; E06B 7/086; E06B 7/094; E06B 9/262; E06B 9/322; F16H 19/08; B60K 11/085; Y10T 74/188
USPC ..... 49/79.1, 82.1, 74.1, 77.1; 160/130; 74/89.16
See application file for complete search history.

(56) References Cited

U.S. PATENT DOCUMENTS

| | | | |
|---|---|---|---|
| 107,557 | A | 9/1870 | Smith |
| 145,842 | A | 12/1873 | Byam |
| 164,464 | A | 6/1875 | Lanphere |
| 284,222 | A | 9/1883 | Nelson |

(Continued)

FOREIGN PATENT DOCUMENTS

| | | |
|---|---|---|
| CN | 1154786 | 7/1997 |
| CN | 2486703 | 4/2002 |

(Continued)

*Primary Examiner* — Chi Q Nguyen
(74) *Attorney, Agent, or Firm* — Dority & Manning, P.A.

(57) ABSTRACT

In one aspect, a shutter assembly may include a shutter frame having a top rail, a bottom rail, and first and second stiles extending between the top and bottom rails. The shutter assembly may also include two or more louvers extending between the first and second stiles, with the louvers including at least one driven louver. The louvers may be configured to rotate simultaneously relative to the shutter frame. Additionally, the shutter assembly may include a motor positioned within the shutter frame that is rotatably coupled to the driven louver(s) via at least one shaft. Moreover, the shutter assembly may include a clutch configured to rotationally disengage the driven louver(s) from the motor when the louvers are being manually rotated relative the shutter frame.

24 Claims, 49 Drawing Sheets

(56) References Cited

U.S. PATENT DOCUMENTS

| | | | | |
|---|---|---|---|---|
| 342,124 | A | 5/1886 | Naylor | |
| 397,322 | A | 2/1889 | Whitaker | |
| 439,912 | A | 11/1890 | Ward | |
| 1,715,424 | A | 6/1929 | Ohno | |
| 1,830,405 | A | 11/1931 | Ohno | |
| 1,932,244 | A | 10/1933 | Green | |
| 3,285,089 | A | 11/1966 | Tsugawa | |
| 3,853,167 | A | 12/1974 | Wardlaw | |
| 4,128,307 | A * | 12/1978 | Badertscher | A01G 9/222 359/596 |
| 4,389,014 | A | 6/1983 | Chow | |
| 4,406,319 | A | 9/1983 | McNiel et al. | |
| 4,417,185 | A | 11/1983 | Bullat | |
| 4,644,990 | A | 2/1987 | Webb, Sr. et al. | |
| 4,850,138 | A | 7/1989 | Watanabe et al. | |
| 4,896,713 | A | 1/1990 | Rademacher | |
| 4,934,438 | A | 6/1990 | Yuhas et al. | |
| 4,957,600 | A | 9/1990 | Carlson et al. | |
| 5,390,721 | A | 2/1995 | Oskam et al. | |
| 5,449,143 | A * | 9/1995 | Hur | F24F 13/1426 137/601.16 |
| 5,760,558 | A | 6/1998 | Popat | |
| 5,762,123 | A | 6/1998 | Kuyama et al. | |
| 5,957,186 | A | 9/1999 | Boswell | |
| 5,969,492 | A | 10/1999 | Motte et al. | |
| 6,014,839 | A | 1/2000 | Ruggles | |
| 6,021,691 | A | 2/2000 | Wilkerson, Jr. | |
| 6,029,735 | A | 2/2000 | Nicholson | |
| 6,049,293 | A | 4/2000 | Koot et al. | |
| 6,055,885 | A | 5/2000 | Shea | |
| 6,145,251 | A * | 11/2000 | Ricci | E06B 7/096 49/74.1 |
| 6,170,274 | B1 | 1/2001 | Ichishi et al. | |
| 6,181,089 | B1 | 1/2001 | Kovach et al. | |
| 6,244,325 | B1 | 6/2001 | Miller et al. | |
| 6,259,218 | B1 | 7/2001 | Kovach et al. | |
| 6,338,677 | B1 | 1/2002 | White | |
| 6,347,987 | B1 | 2/2002 | Ichishi et al. | |
| 6,369,530 | B2 | 4/2002 | Kovach et al. | |
| 6,429,961 | B1 | 8/2002 | Harary et al. | |
| 6,568,131 | B1 | 5/2003 | Milano, Jr. | |
| 6,789,597 | B2 | 9/2004 | Wen et al. | |
| 6,984,951 | B2 | 1/2006 | Osinga et al. | |
| 7,040,056 | B2 | 5/2006 | DuBose et al. | |
| 7,040,374 | B2 | 5/2006 | Wen et al. | |
| 7,082,982 | B2 | 8/2006 | Eveland et al. | |
| 7,124,537 | B2 | 10/2006 | Young | |
| 7,178,291 | B2 | 2/2007 | Vasquez | |
| 7,328,533 | B1 | 2/2008 | Coleman | |
| 7,389,806 | B2 | 6/2008 | Kates | |
| 7,434,353 | B2 | 10/2008 | Nien et al. | |
| 7,481,133 | B2 | 1/2009 | Walravens et al. | |
| 7,574,827 | B2 | 8/2009 | Huang et al. | |
| 7,584,777 | B2 | 9/2009 | Hoberman et al. | |
| 7,931,068 | B2 | 4/2011 | Carmen, Jr. et al. | |
| 8,079,398 | B2 | 12/2011 | Tsukamoto | |
| 8,161,919 | B2 * | 4/2012 | Klotz | B60K 11/085 123/41.04 |
| 8,281,843 | B2 | 10/2012 | Yu et al. | |
| 8,336,256 | B2 | 12/2012 | Jeffrey et al. | |
| 8,393,378 | B2 | 3/2013 | Geriniere et al. | |
| 8,424,378 | B2 | 4/2013 | Mugnier et al. | |
| 8,432,117 | B2 | 4/2013 | Berman et al. | |
| 8,708,078 | B2 * | 4/2014 | Charnesky | B60K 11/085 180/68.4 |
| 8,723,455 | B2 | 5/2014 | Mullet et al. | |
| 8,739,744 | B2 | 6/2014 | Charnesky et al. | |
| 8,806,806 | B2 | 8/2014 | Leivenzon et al. | |
| 8,851,141 | B2 | 10/2014 | Blair et al. | |
| 8,931,541 | B2 | 1/2015 | Chambers et al. | |
| 9,038,800 | B2 | 5/2015 | Dang | |
| 9,410,365 | B2 * | 8/2016 | Hashemi | E06B 7/094 |
| 9,732,553 | B2 * | 8/2017 | Rotchell | E06B 7/096 |
| 9,956,866 | B2 * | 5/2018 | Shaw | B60K 11/085 |
| 2002/0129553 | A1 | 9/2002 | Metzen et al. | |
| 2003/0159355 | A1 | 8/2003 | Froerer et al. | |
| 2003/0188836 | A1 | 10/2003 | Whiting | |
| 2004/0094274 | A1 | 5/2004 | Judkins | |
| 2005/0183833 | A1 * | 8/2005 | Vasquez | E06B 7/096 160/133 |
| 2005/0189078 | A1 | 9/2005 | Whiting | |
| 2005/0257429 | A1 * | 11/2005 | Yorgason | E06B 7/096 49/82.1 |
| 2007/0123158 | A1 | 5/2007 | Shibata et al. | |
| 2010/0332034 | A1 | 12/2010 | Bergeson et al. | |
| 2012/0000133 | A1 | 1/2012 | Rohee | |
| 2012/0062853 | A1 * | 3/2012 | Takehana | G03B 21/16 353/52 |
| 2013/0118082 | A1 * | 5/2013 | Colson | E06B 7/096 49/82.1 |
| 2013/0223980 | A1 * | 8/2013 | Pastrick | B60K 11/085 415/1 |
| 2014/0055061 | A1 | 2/2014 | Chambers et al. | |
| 2014/0059931 | A1 | 3/2014 | Tasheiko et al. | |
| 2014/0224437 | A1 | 8/2014 | Colson et al. | |
| 2014/0332168 | A1 | 11/2014 | Vasquez | |
| 2015/0240560 | A1 | 8/2015 | Blair et al. | |
| 2016/0032642 | A1 | 2/2016 | Rotchell | |

FOREIGN PATENT DOCUMENTS

| | | |
|---|---|---|
| CN | 203008747 | 6/2013 |
| CN | 203010866 | 6/2013 |
| CN | 104343374 | 2/2015 |
| CN | 105386642 | 3/2016 |
| DE | 202014003969 | 5/2014 |
| EP | 1087096 | 3/2001 |
| EP | 2829683 | 1/2015 |
| FR | 473554 | 1/1915 |
| GB | 658681 | 10/1951 |
| GB | 768127 | 2/1957 |
| GB | 1422989 | 1/1976 |
| JP | H 0350442 | 3/1991 |
| JP | H 03180686 | 8/1991 |
| JP | H 03248158 | 11/1991 |
| JP | H 09221972 | 8/1997 |
| JP | H 10266742 | 10/1998 |
| JP | 2982143 | 9/1999 |
| JP | H 11310034 | 11/1999 |
| JP | 2005273220 | 10/2005 |
| JP | 3750197 | 3/2006 |
| JP | 3800754 | 5/2006 |
| JP | 3823430 | 7/2006 |
| JP | WO 2006/120771 | 11/2006 |
| JP | 4521021 | 5/2010 |
| JP | 5235780 | 4/2013 |
| KR | 200196516 | 9/2000 |
| KR | 100298884 | 6/2001 |
| KR | 19960023589 | 6/2001 |
| TW | 529658 | 4/2003 |
| WO | WO 2006/005107 | 1/2006 |
| WO | WO 2006/045299 | 4/2006 |
| WO | WO 2008/119247 | 9/2008 |

* cited by examiner

SHUTTER ASSEMBLY WITH MOTORIZED LOUVER DRIVE SYSTEM

CROSS-REFERENCE TO RELATED APPLICATIONS

The present application is based upon and claims priority to and the benefit of the earlier filing dates of U.S. Provisional Patent Application No. 62/184,282 filed on Jun. 25, 2015; U.S. Provisional Patent Application No. 62/188,276 filed on Jul. 2, 2015; U.S. Provisional Patent Application No. 62/202,746 filed on Aug. 7, 2015; U.S. Provisional Patent Application No. 62/252,598 filed on Nov. 9, 2015; U.S. Provisional Patent Application No. 62/293,337 filed on Feb. 10, 2016; and U.S. Provisional Patent Application No. 62/300,075 filed on Feb. 26, 2016, the disclosures of all of which are hereby incorporated by reference herein in their entirety for all purposes.

FIELD OF THE INVENTION

The present subject matter relates generally to coverings for architectural structures and, more particularly, to a shutter assembly for use as a covering for an architectural structure, such as a window, that includes a motorized louver drive system.

BACKGROUND OF THE INVENTION

Shutter assemblies typically include two or more shutter panels configured to be installed within a frame relative to an architectural structure, such as a window. Each shutter panel includes a shutter frame and a plurality of louvers configured to be rotated relative to the shutter frame. For instance, the ends of the louvers are often rotatably coupled to the shutter frame via louver pegs to allow the louvers to be rotated relative to the frame between a substantially vertical orientation and a substantially horizontal orientation. Additionally, in many instances, a tie bar may be secured to all or a portion of the louvers of each shutter panel to couple the louvers to one another, thereby allowing such louvers to be rotated simultaneously relative to the adjacent shutter frame.

To enhance the functionality and usability of shutter assemblies, attempts have been made to integrate automatic louver drive systems within shutter assemblies that allow for the automatic adjustment of the rotational orientation of the louvers. For example, louver drive systems have been developed in the past that include multiple motors as well as complex gearbox arrangements associated with each motor. As a result, these conventional louver drive systems are often costly and quite difficult to design and manufacture. In addition, due to the use of multiple motors and associated gearboxes, such louver drive systems significantly increase the overall weight of the associated shutter assembly and also reduce the available space for the louvers of the shutter assembly given the significant storage requirements for the motors/gearboxes.

Accordingly, a shutter assembly having an improved motorized louver drive system would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a shutter assembly for use as a covering for an architectural structure, with the shutter assembling including a motorized louver drive system. Specifically, in several embodiments, the shutter assembly may include a single motor configured to rotationally drive a motor drive shaft extending through one or more gearboxes installed within a shutter frame of the shutter assembly. Each gearbox may, in turn, be coupled to a louver drive shaft extending within the interior of a corresponding driven louver of the shutter assembly. Accordingly, by rotating the motor drive shaft via the motor, rotational motion may be transferred to each louver drive shaft via the associated gearbox to allow the rotational orientation of the louvers to be automatically adjusted.

Additionally, in several embodiments, the shutter assembly may include one or more clutches configured to rotationally disengage or decouple the louvers from the motor when the rotational orientation of the louvers is being manually adjusted, thereby allowing the automatic louver drive system to be manually overridden when desired. For instance, in one embodiment, each driven louver may include a clutch installed therein that is selectively engageable with or otherwise provided in operative association with the corresponding louver drive shaft extending within the driven louver. In such an embodiment, the clutch may be configured to rotationally disengage or decouple the driven louver from its corresponding louver drive shaft, thereby allowing the driven louver to be rotated relative to the louver shaft. For example, all or a portion of the clutch may be configured to slip relative to the louver drive shaft at a frictional interface defined between the clutch and the shaft when the driven louver is being manually adjusted.

Moreover, in accordance with aspects of the present subject matter, the motor of the louver drive system may be configured to rotationally drive the louvers of one or more additional shutter panels positioned relative to the shutter panel within which the motor is installed. For instance, in one embodiment, adjacent shutter panels may include one or more louver shafts that terminate at or adjacent to an interface defined between the shutter panels. In such an embodiment, the adjacent ends of the shafts may be rotationally coupled to each other at the interface to allow rotational motion from one of the louver shafts to be transferred to the adjacent louver shaft across the interface, thereby allowing the motor to rotationally drive the louvers of the adjacent shutter panels.

These and other features, aspects and advantages of the present subject matter will become better understood with reference to the following description and appended claims. The accompanying drawings, which are incorporated in and constitute a part of this specification, illustrate embodiments of the present subject matter and, together with the description, serve to explain the principles of the present subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
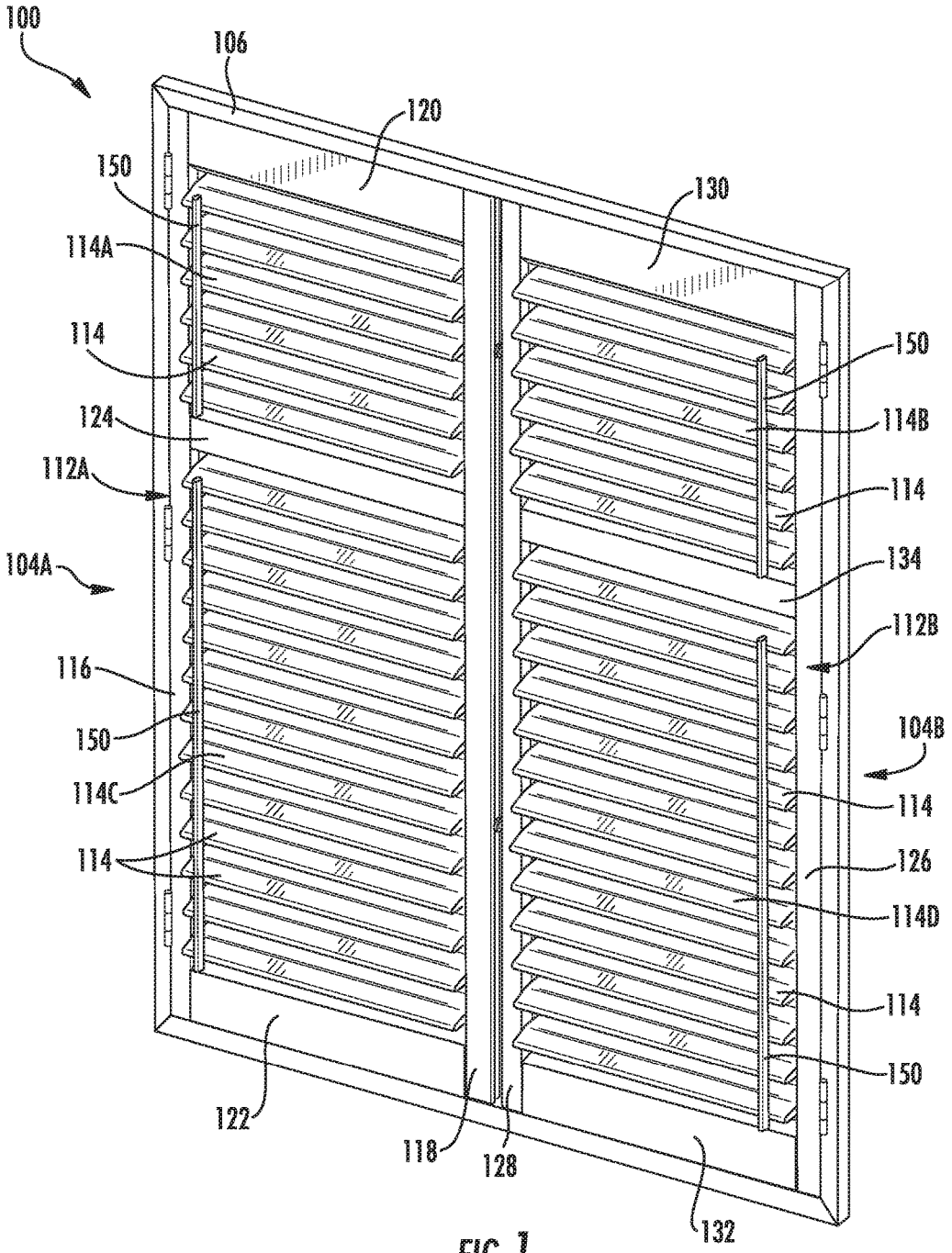
FIG. 1 illustrates a perspective view of one illustrative embodiment of a shutter assembly configured for use as a covering for an architectural structure in accordance with aspects of the present subject matter.

Reference now will be made in detail to embodiments of the present subject matter, one or more examples of which are illustrated in the drawings. Each example is provided by way of explanation without intent to limit the broad concepts of the present subject matter. In fact, it will be apparent to those skilled in the art that various modifications and variations can be made in the present subject matter without departing from the scope or spirit of the present subject matter. For instance, features illustrated or described as part of one embodiment can be used with another embodiment to yield a still further embodiment. Thus, it is intended that the present subject matter covers such modifications and variations as come within the scope of the appended claims and their equivalents.

In general, the present subject matter is directed to a shutter assembly configured for use as a covering for an architectural structure, with the shutter assembly including a motorized louver drive system. Specifically, in several embodiments, the motorized louver drive system may include a single motor configured to automatically adjust the rotational orientation of the louvers within the shutter assembly. For instance, one or more gearboxes may be installed within a shutter frame of the shutter assembly (e.g., within a stile of the shutter frame) that are configured to receive a motor drive shaft coupled to the motor. In such an embodiment, each gearbox may be coupled to one or more louver drive shafts extending within the interior of a corresponding driven louver of the shutter assembly. Accordingly, rotation of the motor drive shaft via the motor may be transferred through each gearbox to its associated louver drive shaft, which may, in turn, rotationally drive the corresponding driven louver. By coupling one or more additional louvers of the shutter assembly to each driven louver (e.g., using a tie bar), one or more groups or sections of louvers may be rotated simultaneously or otherwise in concert using the common motor.

Additionally, the shutter assembly may also include one or more clutches configured to rotationally disengage or decouple the louvers from the motor. Specifically, in several embodiments, each clutch may be configured to rotationally decouple its associated louver(s) from the motor when the rotational orientation of such louver(s) is being manually adjusted. As such, the automatic louver drive system may be manually overridden when a user of the shutter assembly desires to manually adjust one or more of the louvers.

For instance, in one embodiment, each driven louver may include a clutch installed therein that is selectively engageable with or otherwise provided in operative association with a louver drive shaft extending within the driven louver. In such an embodiment, the clutch may be configured to rotationally disengage or decouple the driven louver from its corresponding louver drive shaft when the rotational orientation of the driven louver (or another louver coupled to the driven louver) is being manually adjusted, thereby allowing the driven louver to rotate relative to the louver drive shaft.

For example, all or a portion of the clutch may be configured to slip relative to the louver drive shaft at a frictional interface defined between the clutch and the shaft when the louver(s) is being manually adjusted.

Alternatively, the clutches of the disclosed shutter assembly may be installed at any other suitable location relative to the motor and/or the driven louvers. For instance, as will be described below, the shutter assembly may include clutches integrated within or coupled to one or more of the gearboxes of the shutter assembly. In another embodiment, the clutches may be provided in operative association with one or more gears of the shutter assembly.

Moreover, in several embodiments, the shutter assembly may include two or more shutter panels configured to be installed adjacent to each other within a frame positioned relative to the architectural structure. In such embodiments, the motor of the louver drive system may be configured to rotationally drive all of the louvers of the shutter assembly, including both the louvers of the shutter panel within which the motor is installed and the louvers of any other adjacent shutter panels. For instance, in one embodiment, adjacent shutter panels may include one or more louver shafts that terminate at or adjacent to an interface defined between the shutter panels. In such an embodiment, the adjacent ends of the shafts may be rotationally coupled to each other at the interface to allow rotational motion from one of the louver shafts to be transferred to the adjacent louver shaft across the interface, thereby allowing a single motor to rotationally drive the louvers of the adjacent shutter panels.

It should be appreciated that various embodiments of different components, sub-assemblies, and/or systems will be described herein as being configured for use within the disclosed shutter assembly. In certain instances, specific embodiments of one or more components, sub-assemblies, and/or systems of the shutter assembly will be described in the context of other embodiments of one or more of the components, sub-assemblies, and/or systems of the shutter assembly. Such descriptions are simply provided for exemplary purposes and should not be interpreted as limiting the scope of the present subject matter. In general, the various embodiments of the components, sub-assemblies, and/or systems described herein may be used, assembled, and/or combined in any suitable manner to produce a shutter assembly having one or more of the advantageous features of the present subject matter.

Figure 2:
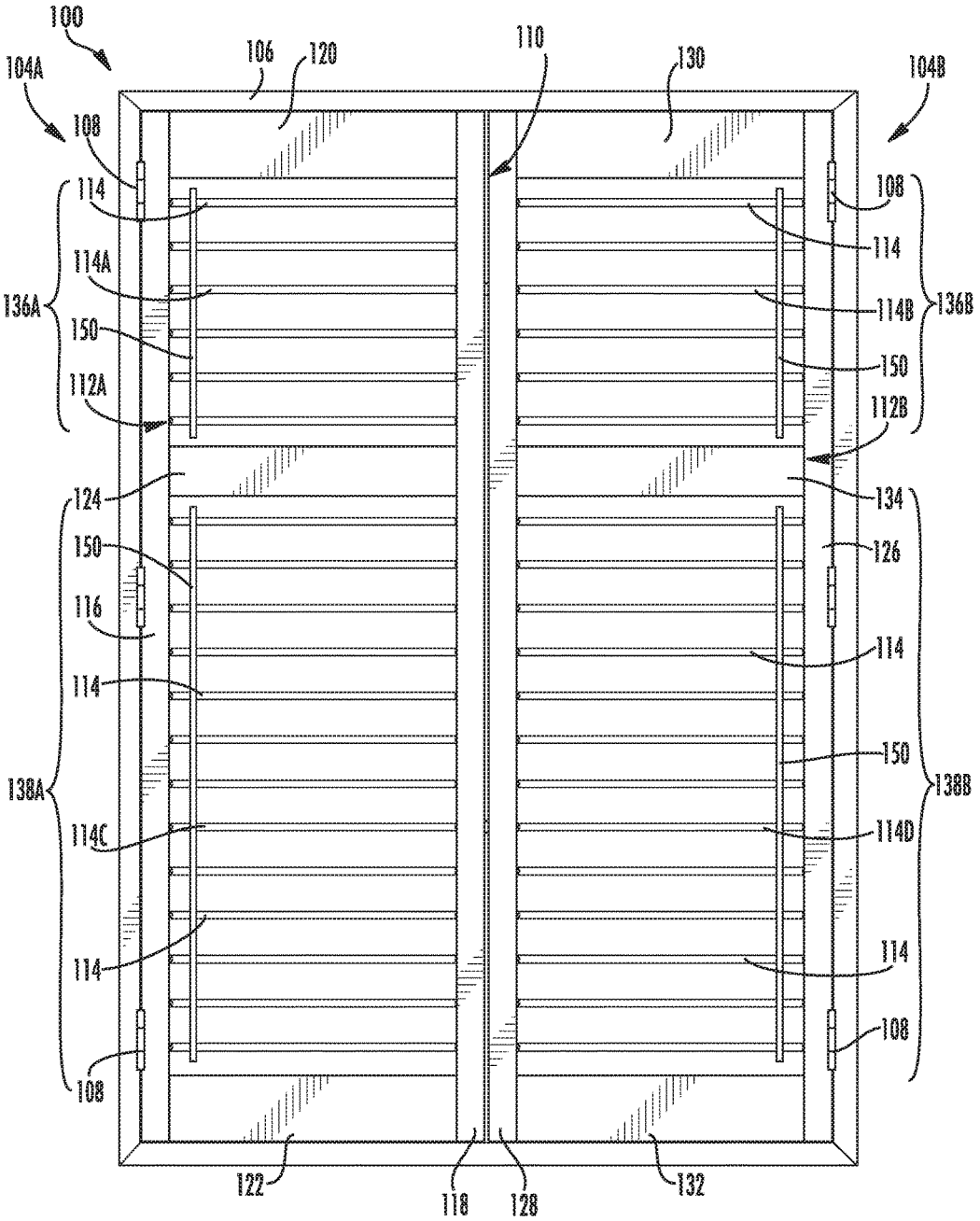
FIG. 2 illustrates a front view of the shutter assembly shown in FIG. 1, particularly illustrating shutter panels of the shutter assembly in a closed position relative to the adjacent architectural structure.
Figure 3:
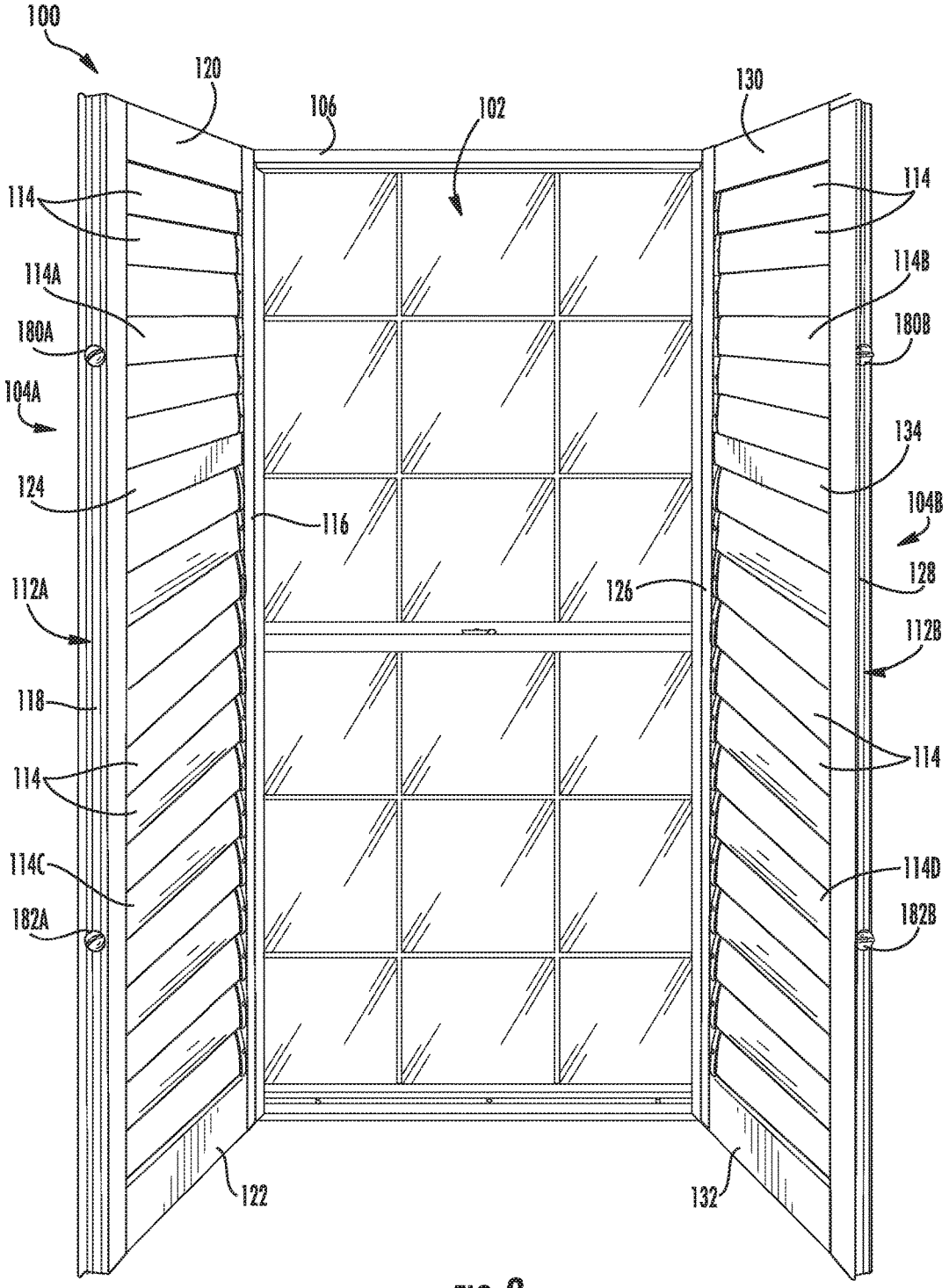
FIG. 3 illustrates another front view of the shutter assembly shown in FIG. 1, particularly illustrating the shutter panels in an open position relative the adjacent architectural structure.
Figure 4:
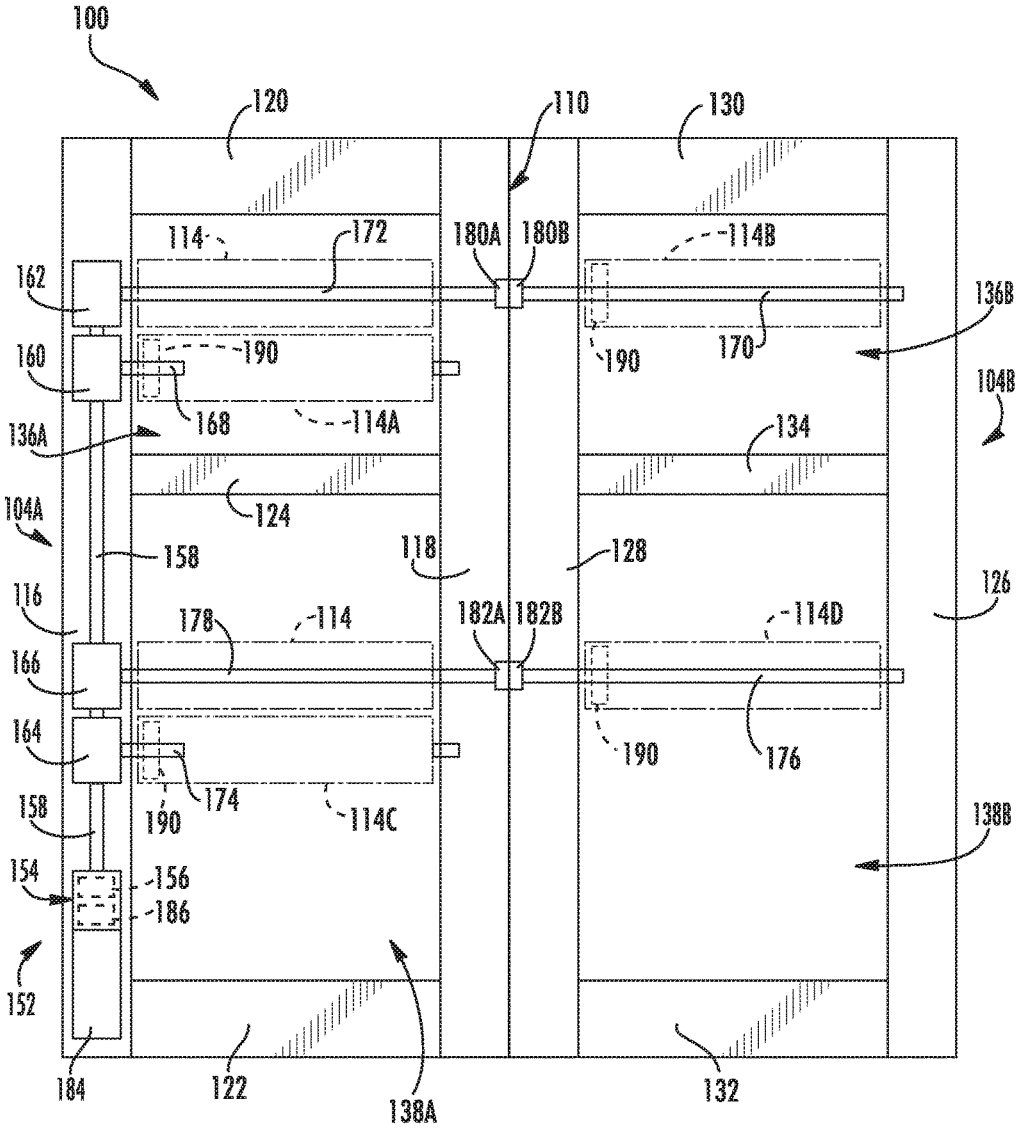
FIG. 4 illustrates a simplified front view of the shutter assembly shown in FIG. 1 with the frames of the shutter panels being shown in wireframe to allow various internal components of the shutter assembly to be viewed, particularly illustrating one illustrative embodiment of a drive system configured for use within the shutter assembly in accordance with aspects of the present subject matter.
Figure 5:
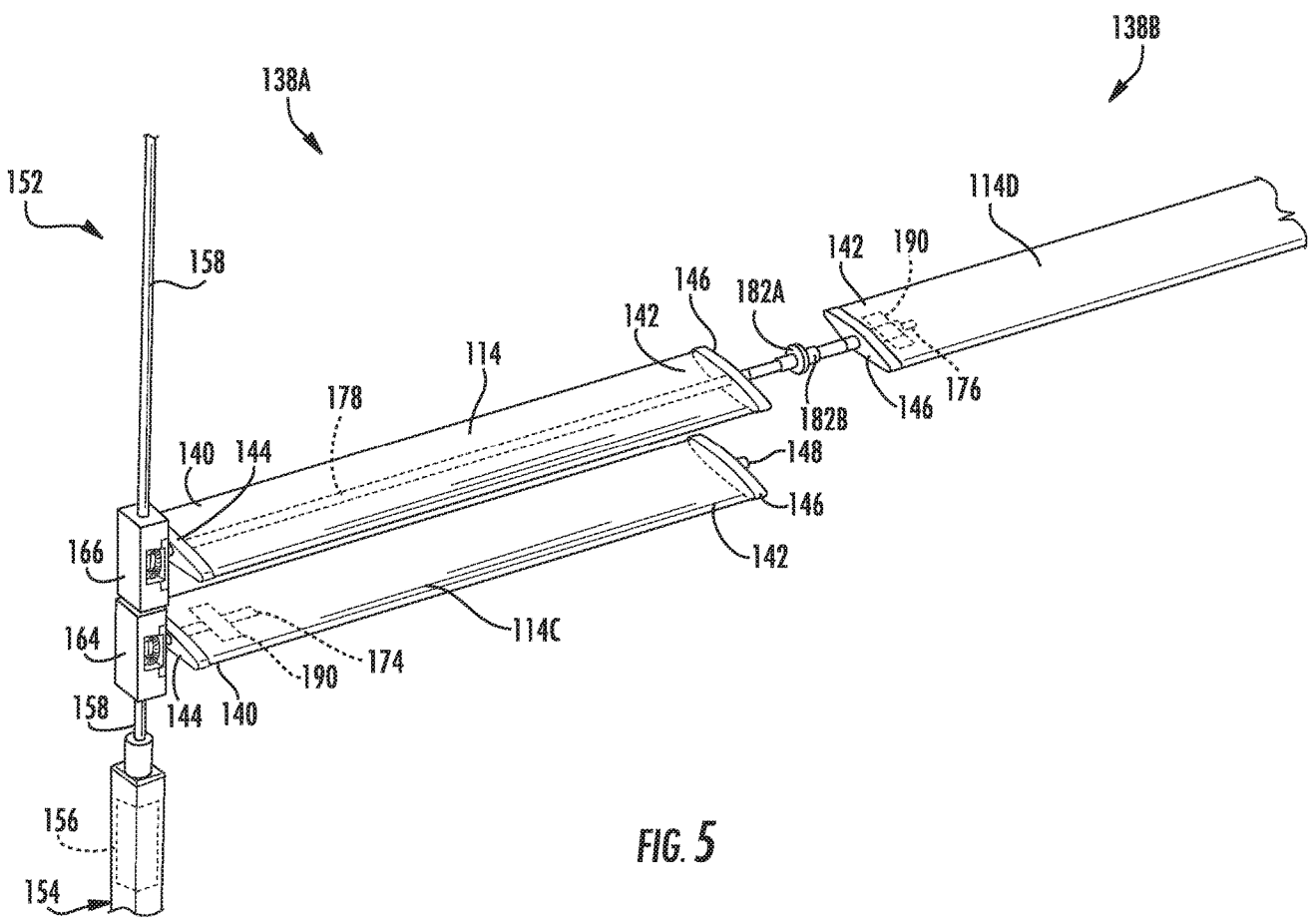
FIG. 5 illustrates a perspective view of a several of the internal components shown in FIG. 4, particularly illustrating a portion of the drive system shown in FIG. 4.

Referring now to FIGS. 1-5, differing views of one illustrative embodiment of a shutter assembly 100 configured for use as a covering for an architectural structure 102 (FIG. 3) are illustrated in accordance with aspects of the present subject matter. Specifically, FIG. 1 illustrates a perspective view of shutter assembly 100, particularly illustrating first and second shutter panels 104A, 104B of shutter assembly 100 in a closed position relative to the adjacent architectural structure 102. FIGS. 2 and 3 illustrate front views of the shutter assembly 100 shown in FIG. 1, particularly illustrating the first and second shutter panels 104A, 104B in both the closed position (FIG. 2) and an open position (FIG. 3) relative to the architectural structure 102. FIG. 4 illustrates another front view of the shutter assembly 100 shown in FIG. 1, particularly illustrating a transparent or wireframe view of shutter panels 104A, 104B in their closed position to allow various internal components of shutter assembly 100 to be viewed. FIG. 4 also illustrates shutter assembly 100 with the majority of its louvers removed (except for a select few shown in phantom lines) for purposes of describing the internal components of shutter assembly 100. Additionally, FIG. 5 illustrates a partial, perspective view of several of the internal components shown in FIG. 4 installed relative to corresponding louvers of shutter assembly 100.

As shown, shutter assembly 100 may generally include one or more shutter panels 104A, 104B configured to be coupled to an outer frame 106 (e.g., a frame defining or associated with the adjacent architectural structure 102). For instance, in the illustrated embodiment, shutter assembly 100 includes both a first shutter panel 104A and a second shutter panel 104B coupled to outer frame 106. However, in other embodiments, shutter assembly 100 may only include a single shutter panel installed relative to the outer frame 106 or three or more shutter panels installed relative to the outer frame 106. As shown in FIGS. 1-3, shutter panels 104A, 104B may, in one embodiment, be pivotably coupled to the outer frame 106 (e.g., via hinges 108 (FIG. 2)) to allow the shutter panels 104A, 104B to be moved between closed and open positions relative to the adjacent architectural structure 102. For example, as particularly shown in FIGS. 1 and 2, shutter panels 104A, 104B may be moved to the closed position to cover the adjacent architectural structure 102. In such closed position, shutter panels 104A, 104B may generally be positioned in a generally planar configuration (e.g., by extending in a plane oriented substantially parallel to the adjacent architectural structure 102), with ends of shutter panels 104A, 104B extending directly adjacent to each other along the height of the panels 104A, 104B such that a vertically extending panel-to-panel interface 110 (FIG. 2) is defined therebetween. Additionally, as shown in FIG. 3, shutter panels 104A, 104B may be moved to the open position to expose the architectural structure 102. For instance, panels 104A, 104B may be pivoted outwardly away from the architectural structure 102 so that each panel 104A, 104B has an angled orientation relative to the plane defined by the architectural structure 102.

In general, each shutter panel 104A, 104B may include a shutter frame 112A, 112B and a plurality of louvers 114 configured to rotate relative to the associated frame 112A, 112B. As shown in FIGS. 1-4, a first shutter frame 112A of first shutter panel 104A may have a generally rectangular shape defined by a first frame-side stile 116, a first panel-side stile 118, and top and bottom rails 120, 122 extending horizontally between the vertically extending stiles 116, 118. Additionally, first shutter frame 112A may also include a divider rail 124 extending horizontally between stiles 116, 118 at a vertical location defined between the top and bottom rails 120, 122 so as to divide the first shutter frame 112A into a first upper panel section 136A (FIG. 2) and a first lower panel section 138A (FIG. 2). Similarly, as shown in FIGS. 1-4, a second shutter frame 112B of second shutter panel 104B may have a generally rectangular shape defined by a second frame-side stile 126, a second panel-side stile 128, and top and bottom rails 130, 132 extending horizontally between the vertically extending stiles 126, 128. As particularly shown in FIG. 2, when shutter panels 104A, 104B are at their closed position relative to the architectural structure 102, the first panel-side stile 118 of first shutter frame 112A may be configured to extend vertically adjacent to the second panel-side stile 128 of second shutter frame 112B along the panel-to-panel interface 110 defined between the panels 104A, 104B. Additionally, second shutter frame 112B may also include a divider rail 134 extending horizontally between stiles 126, 128 at a vertical location defined between the top and bottom rails 130, 132 so as to divide the second shutter frame 112B into a second upper panel section 136B and a second lower panel section 138B.

It should be appreciated that the adjacent panel-side stiles 118, 128 of shutter frames 112A, 112B may be configured to contact each other at the panel-to-panel interface 110 or may be spaced apart from each other such that a gap is defined between the adjacent shutter frames 112A, 112B at the panel-to-panel interface 110. Additionally, as will be described below, each shutter panel 104A, 104B may, in one embodiment, include a coupling member positioned at the panel-to-panel interface 110 that is configured to rotationally engage a corresponding coupling member of the adjacent shutter panel 104A, 104B to allow the louvers 114 of shutter frames 104A, 104B to be driven via a common drive system of shutter assembly 100.

In the illustrated embodiment, each upper panel section 136A, 136B of shutter frames 112A, 112B is shown as defining a shorter vertical height than the corresponding lower panel section 136A, 138B of shutter frames 112A, 112B. However, in other embodiments, each upper panel section 136A, 136B may be configured to have the same vertical height as its corresponding lower panel section 138A, 138B, or may be configured to define a vertical height that is greater than that of its corresponding lower panel section 138A, 138B. It should also be appreciated that, in other embodiments, shutter frames 112A, 112B may not include the illustrated divider rails 124, 134. In such embodiments, each shutter frame 112A, 112B may define a single, continuous panel section between its top and bottom rails 120, 122, 130, 132. Alternatively, each shutter frame 112A, 112B may include two or more divider rails 124, 134, thereby dividing the shutter frames 112A, 112B into three or more separate panel sections.

As indicated above, each shutter panel 104A, 104B may also include a plurality of louvers 114 configured to be rotated relative to its associated shutter frame 112A, 112B. For example, as shown in the illustrated embodiment, first shutter panel 104A may include a plurality of louvers 114 extending horizontally between the stiles 116, 118 of the first shutter frame 112A within both the first upper panel section 136A and the first lower panel section 138A. Similarly, second shutter panel 104B may include a plurality of louvers 114 extending horizontally between the stiles 126, 128 of the second shutter frame 112B within both the second upper panel section 136B and the second lower panel section 138B.

In general, each louver 114 may extend lengthwise along a longitudinal axis between a frame-side end 140 (FIG. 5) and a panel-side end 142 (FIG. 5), with the frame-side end 140 of each louver 114 configured to be positioned adjacent to the frame-side stile 116, 126 of the associated shutter frame 112A, 112B and the panel-side end 142 of each louver 114 configured to be positioned adjacent to the panel-side stile 118, 228 of the associated shutter frame 112A, 112B. Additionally, in several embodiments, each louver 114 may include an end cap 144, 146 positioned at each of its ends 140, 142. For example, as particularly shown in FIG. 5, each louver 114 may include a frame-side end cap 144 positioned at its frame-side end 140 and a panel-side end cap 146 positioned at its panel-side end 142. In one embodiment, each end cap 144, 146 may include a post or louver peg 148 extending outwardly from the adjacent end 140, 142 of the louver 114 along its longitudinal axis that is configured to be received within a corresponding opening (not shown) defined in the adjacent stiles 116, 118, 126, 128. In such an embodiment, each louver peg 148 may provide a rotational connection between the louvers 114 and the associated stiles 116, 118, 126, 128, thereby allowing the louvers 114 to be rotated relative to the shutter frames 112A, 112B.

As is generally understood, each louver 114 may be configured to rotate about its longitudinal axis relative to the adjacent shutter frame 112A, 112B approximately 180 degrees to vary the degree to which the architectural structure 102 may be viewed through shutter panels 104A, 104B when the panels 104A, 104B are at their closed positions. For instance, the louvers 114 may be rotated to a substantially horizontal orientation (e.g., a fully open position as shown in FIGS. 1 and 2) to allow maximum exposure to the architectural structure 102 through shutter panels 104A, 104B. Similarly, the louvers 114 may be rotated approximately 90 degrees in one direction or the other from the substantially horizontal orientation to a substantially vertical orientation (e.g., a fully closed position as shown in FIG. 3) to block the view through the shutter panels 104A, 104B. For instance, when at their substantially vertical orientation, adjacent louvers 114 may vertically overlap each other at their top and bottom ends to fully block the view through the shutter panels 104A, 104B.

In several embodiments, one or more groups or sections of the various louvers 114 may be coupled together in a manner that allows the louvers 114 to rotate simultaneously or otherwise in unison with one another. For example, as shown in the illustrated embodiment, each individual panel section 136A, 136B, 138A, 138B includes a tie bar 150 that is configured to couple all of the louvers 114 included within such panel section to one another. As such, by moving the tie bar 150 for a given panel section up or down, all of the louvers 114 within such panel section may be rotated about their longitudinal axes. Similarly, due to the connection provided by each tie bar 150, rotation of one of the louvers 114 within a given panel section may result in corresponding rotation of the remainder of the louvers 114 included within such panel section. For example, when one of the louvers 114 of the second upper panel section 136B is rotated about its axis, the associated tie bar 150 may result in the remainder of the louvers 114 within the second upper panel section 136B being rotated about their longitudinal axes.

In several embodiments, one or more of the louvers 114 of each panel section 136A, 136B, 138A, 138B may correspond to a driven louver 114A, 114B, 114C, 114D (e.g., a louver that is being directly driven, such as by a shaft), with the remainder of the louvers 114 in such section corresponding to non-driven louvers (e.g., a louver that is being indirectly driven via its connection to a driven louver). For instance, in the illustrated embodiment, the first upper and lower panel sections 136A, 138A may include first upper and lower driven louvers 114A, 114C, respectively. Similarly, the second upper and lower panel sections 136B, 138B may include second upper and lower driven louvers 114B, 114D, respectively. As will be described in greater detail below, each driven louver 114A, 114B, 114C, 114D may be coupled to a motor of the shutter assembly 100 via one or more shafts to allow such louver to be rotationally driven about its longitudinal axis. As a result, by rotating a given driven louver 114A, 114B, 114C, 114D, the remainder of the louvers 114 in the corresponding panel section 136A, 136B, 138A, 138B may be rotated about their longitudinal axes.

It should be appreciated that the tie bars 150 of shutter assembly 100 may generally be configured to be positioned at any suitable location relative to the louvers 114. For instance, in the illustrated embodiment, the tie bars 150 are positioned at the ends of the louvers 140 located adjacent to the frame-side stiles 116, 126 along the front side of the shutter panels 104A, 104B (i.e., the side facing away from the architectural structure 102). However, in other embodiments, the tie bars 150 may be positioned at any other suitable location along the front side of the shutter panels 104A, 104B, such as by positioning the tie bars 150 at a central location along the louvers 114 or by positioning the tie bars 150 at the ends of the louvers 114 located adjacent to the panel-side stiles 118, 128. Similarly, in another embodiment, the tie bars 150 may be positioned along the rear side of the shutter panels 104A, 104B (i.e., the side facing towards the architectural structure 102).

It should also be appreciated that, in alternative embodiments, the louvers 114 within the various panel sections 136A, 136B, 138A, 138B may be coupled to one another using any other suitable means that allows for each section of louvers 114 to rotate in unison. For instance, in another embodiment, the louvers 114 may be coupled together using a rack and pinion-type driven arrangement installed within each shutter frame 112A, 112B.

As indicated above, shutter assembly 100 may also include a motorized drive system 152 for rotationally driving the driven louver(s) 114A, 114B, 114C, 114D of each panel section 136A, 136B, 138A, 138B. Specifically, in several embodiments, the drive system 152 may include a motor assembly 154 having a single electric motor 156 configured to be rotationally coupled to each driven louver 114A, 114B, 114C, 114D. For example, as particularly shown in FIG. 4, the motor 156 may, in one embodiment, be positioned within one of the stiles 116, 118, 126, 128 of shutter panels 104A, 104B, such as the first frame-side stile 116 of the first shutter panel 104A. Additionally, the motor 156 may be coupled to each driven louver 114A, 114B, 114C, 114D via a series of one or more gearboxes and associated shafts. Specifically, as shown in FIG. 4, the motor 156 may be coupled to a primary or motor drive shaft 158 extending lengthwise along the height of the first frame-side stile 116. The motor drive shaft 158 may, in turn, be coupled to one or more louver shafts for rotationally driving each driven louver 114A, 114B, 114C, 114D via one or more corresponding gearboxes 160, 162, 164, 166.

For example, the motor drive shaft 158 may be configured to extend through first and second gearboxes 160, 162 (also referred to herein as "upper gearboxes") housed within the first frame-side stile 116 for transferring rotational motion to corresponding louver shafts 168, 170, 172 coupled to the driven louvers 114A, 114B of the upper panel sections 136A, 136B of shutter panels 104A, 104B. Specifically, as shown in FIG. 4, the motor drive shaft 158 may be coupled to a first louver drive shaft 168 via the first gear box 160 for rotationally driving the driven louver 114A of the first upper panel section 136A. Similarly, the motor drive shaft 158 may be coupled to a second louver drive shaft 170 via the second gear box 162 and a corresponding upper pass-through louver shaft 172 for rotationally driving the driven louver 114B of the second upper panel section 136B. The upper pass-through louver shaft 172 may generally be configured to extend through one of the non-driven louvers 114 of the first upper panel section 136A without rotationally engaging such louver 114. As such, the upper pass-through louver shaft 172 may transfer rotational motion from the second gearbox 162 to the second louver drive shaft 170 without affecting the movement of any of the louvers 114 with the first upper panel section 136A.

Additionally, the motor drive shaft 158 may be configured to extend through third and fourth gearboxes 164, 166 (also referred to herein as "lower gearboxes") housed within the first frame-side stile 116 for transferring rotational motion to corresponding louver shafts 174, 176, 178 coupled to the driven louvers 114C, 114D of the lower panel sections 138A, 138B of shutter panels 104A, 104B. Specifically, as shown in FIG. 4, the motor drive shaft 158 may be coupled to a third louver drive shaft 174 via the third gear box 164 for rotationally driving the driven louver 114C of the first lower panel section 138A. Similarly, the motor drive shaft 158 may be coupled to a fourth louver drive shaft 176 via the fourth gear box 166 and a corresponding lower pass-through louver shaft 178 for rotationally driving the driven louver 114D of the second lower panel section 148B. Similar to the upper pass-through louver shaft 172 described above, the lower pass-through louver shaft 178 may generally be configured to extend through one of the non-driven louvers 114 of the first lower panel section 138A without rotationally engaging such louver 114. As such, the lower pass-through louver shaft 178 may transfer rotational motion from the fourth lower gearbox 166 to the fourth louver drive shaft 176 without affecting the movement of any of the louvers 114 within the first lower panel section 138A.

In several embodiments, each pass-through louver shaft 172, 178 may be configured to be coupled to its associated louver drive shaft 170, 176 via corresponding coupling members 180, 182 secured to the adjacent ends of the shafts at the panel-to-panel interface 110 defined between the first and second shutter panels 104A, 104B. Specifically, as shown in FIG. 4, a first upper coupling member 180A may be positioned at the panel-to-panel interface 110 along the first panel-side stile 118 that is coupled to the adjacent end of the upper pass-through shaft 172 while a second upper coupling member 180B may be installed at to the panel-to-panel interface 110 along the second panel side stile 128 that is coupled to the adjacent end of the second louver drive shaft 170. Similarly, a first lower coupling member 182A may be positioned at the panel-to-panel interface 110 along the first panel-side stile 118 that is coupled to the adjacent end of the lower pass-through shaft 178 while a second lower coupling member 182B may be installed at the panel-to-panel interface 110 along the second panel side stile 128 that is coupled to the adjacent end of the fourth louver drive shaft 176. As will be described in greater detail below, each pair of coupling members 180, 182 may be configured to rotationally engage each other when the shutter panels 104A, 104B are located at their closed positions to allow rotational motion to be transferred from each pass-through louver shaft 172, 178 to its corresponding louver drive shaft 170, 176. However, the coupling members 180, 182 may also be configured to be disengaged from each other to allow the shutter panels 104A, 104B to be moved away from each other to their open positions (e.g., to allow the panels 104A, 104B or the adjacent architectural structure 102 to be cleaned).

Referring particularly to FIG. 5, the portion of the drive system 152 configured to rotationally drive the louvers 114 of the lower panel sections 138A, 138B of shutter panels 104A, 104B is illustrated in more detail. As shown, by rotating the motor drive shaft 158 via the motor 156, rotational motion may be transferred through the third gear box 164 to the third louver drive shaft 174 to rotationally drive the driven louver 114C of the first lower panel section 138A. As a result, all of the louvers 114 within the first lower panel section 138A may be rotated about their longitudinal axis due to the connection provided by the associated tie bar 150 (FIG. 2). Similarly, rotational motion of the motor drive shaft 158 may also be transferred through the fourth gear box 166 to the lower pass-through louver shaft 178 extending through one of the non-driven louvers 114 of the first lower panel section 138A. Such rotation of the lower pass-through louver shaft 178 may then be transferred to the fourth louver drive shaft 176 via the connection provided by the coupling members 182A, 182B to rotationally drive the driven louver 114D of the second lower panel section 138B. As a result, all of the louvers 114 within the second lower panel section 138B may be rotated about their longitudinal axis due to the connection provided by the associated tie bar 150. As indicated above, the driven louvers 114A, 114B for the upper panel sections 136A, 136B may be rotationally driven in a similar manner.

It should be appreciated that the motor 156 may generally be powered via any suitable power source. For example, in one embodiment, one or more batteries may be installed within the shutter assembly 100 to supply power to the motor 156, such as by installing a battery pack 184 within the frame-side stile 116 of the first shutter frame 112A at a location adjacent to the motor assembly 154. Alternatively, the motor 156 may be configured to receive power from any other suitable power source, such as by hardwiring the motor 156 to an external power source (e.g., a 120 volt electrical circuit).

It should also be appreciated that the operation of the motor 156 may, in several embodiments, be controlled automatically via a suitable controller or other electronic circuit. For instance, as will be described in greater detail below, the motor assembly 154 may also include a motor controller 186 communicatively coupled to the motor 156. In one embodiment, the motor controller 186 may incorporate or may otherwise be associated with a communications module for wirelessly receiving motor control signals. In such an embodiment, the operation of the motor 156 may be remotely controlled via a separate control device (e.g., a remote control device) configured to communicate with the motor controller 186 via the communications module.

Additionally, in several embodiments, the drive system 152 may also include one or more clutches 190 associated with each panel section 136A, 136B, 138A, 138B to provide a means for the louvers 114 within such section to be rotationally disengaged or decoupled from the motor 156, thereby allowing for manual adjustment of the rotational orientation of the louvers 114. As shown in FIGS. 4 and 5, in one embodiment, each driven louver 114A, 114B, 114C, 114D may include a clutch 190 positioned within its interior, such as at or adjacent to one of the ends of the driven louver 114A, 114B, 114C, 114D. For example, in the illustrated embodiment, the driven louvers 114A, 114C for the upper and lower panel sections 136A, 138A of the first shutter panel 104A each include a clutch 190 positioned adjacent to their frame-side ends 140 while the driven louvers 114B, 114D for the upper and lower panel sections 136B, 138B of the second shutter panel 104B each include a clutch 190 positioned adjacent to their panel-side ends 142. However, in other embodiments, the clutches 190 may be positioned at any other suitable location within the driven louvers 114A, 114B, 114C, 114D, such as at any location along the longitudinal axis of each driven louver. Alternatively, the clutches 190 for the drive system 152 may be installed at any other suitable location along the drive train defined between the motor 156 and the driven louvers 114A, 114B, 114C, 114D. For instance, as will be described below, the clutches 190 may, in other embodiments, be incorporated within or coupled to a portion of one or more of the gearboxes of shutter assembly 100 or may be incorporated into a gear(s) used within a rack and pinion-type drive arrangement.

By including the clutches 190 within the disclosed shutter assembly 100, a user of shutter assembly 100 may manually override the drive system 152 to allow for manual adjustment of the position of the louvers 114. For instance, in the illustrated embodiment, a user may grasp one of the louvers 114 within the first lower panel section 138A (e.g., the driven louver 114C or any of the non-driven louvers 114) or may grasp the associated tie bar 150 to manually adjust the orientation of all of the louvers 114 within such panel section 138A. As the user begins to manually rotate the louvers 114, the clutch 190 associated with the first lower panel section 138A may allow the corresponding driven louver 114C to be rotationally disengaged from its louver drive shaft 174, thereby permitting the louvers 114 of the first lower panel section 138A to be rotated freely independent of both the motor 156 and the louvers 114 within the remaining panel sections 136A, 136B, 138B of the shutter assembly 100. Similarly, the clutches 190 associated with the other panel sections 136A, 136B, 138B may function similarly to allow the rotational orientation of the louvers 114 within each panel section to be manually adjusted.

Figure 6:
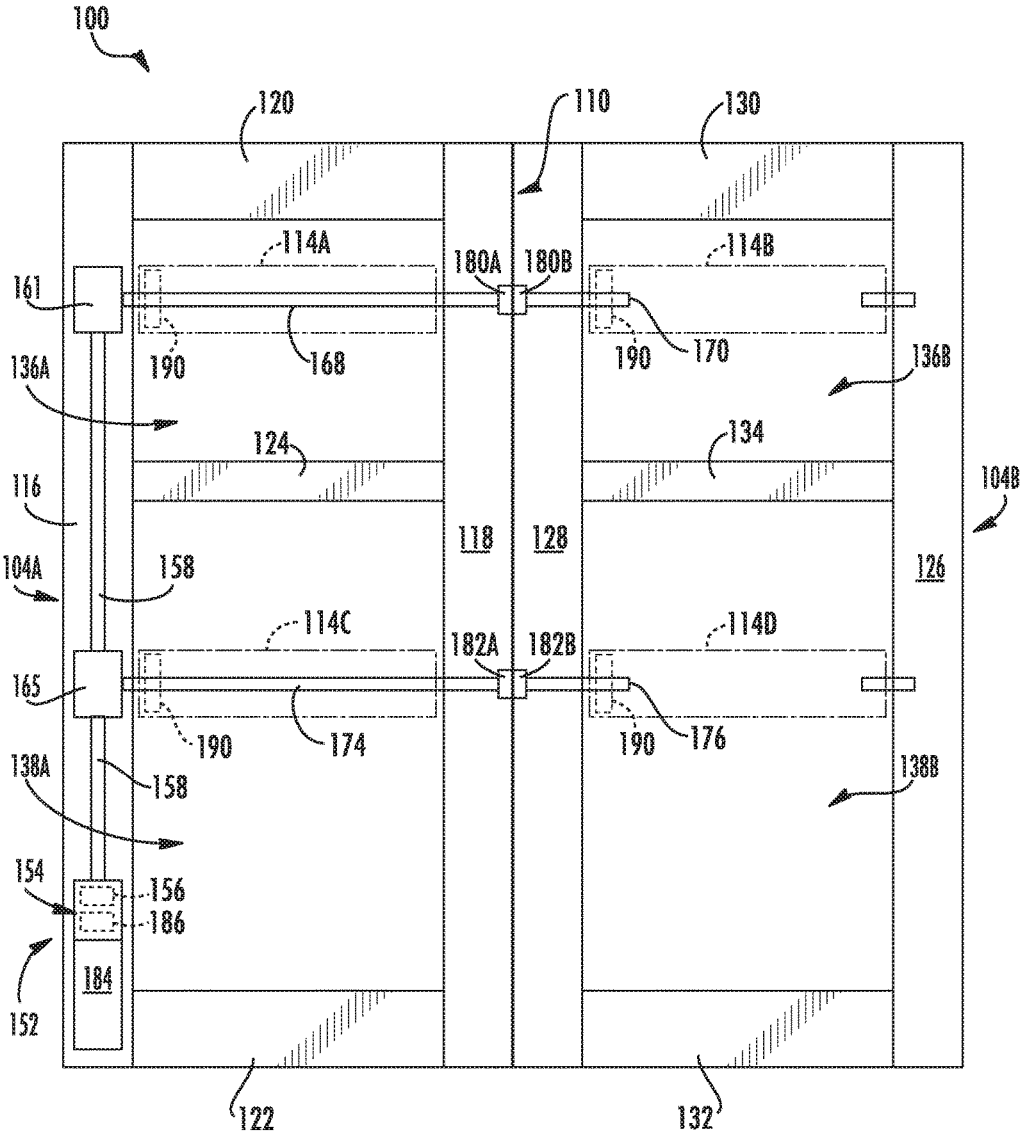
FIG. 6 illustrates another simplified front view of the shutter assembly similar to that shown in FIG. 4, particularly illustrating another illustrative embodiment of a drive system configured for use within the shutter assembly in accordance with aspects of the present subject matter.

Referring now to FIG. 6, an exemplary variation of the illustrative embodiment of the shutter assembly 100 shown in FIGS. 1-5 is illustrated in accordance with aspects of the present subject matter, particularly illustrating a different arrangement for the drive system 152 of shutter assembly 100. Specifically, FIG. 6 illustrates a front view of the shutter assembly 100 similar to the simplified view shown in FIG. 4.

As shown in FIG. 6, unlike the embodiment described above that includes a separate gearbox 160, 162, 164, 166 for each individual panel section 136A, 136B, 138A, 138B, the drive system 152 only includes two gearboxes, namely an upper gearbox 161 and a lower gearbox 165. In such an embodiment, the motor drive shaft 158 may be configured to extend through upper gearbox 161 to allow rotational motion to be transferred to the drive shafts 168, 170 coupled to the driven louvers 114A, 114B of the first and second upper panel sections 136A, 136B. Specifically, as shown in FIG. 6, the motor drive shaft 158 may be coupled to the first louver drive shaft 168 via the upper gear box 161 for rotationally driving the driven louver 114A of the first upper panel section 136A. Additionally, the first louver drive shaft 168 may, in turn, be coupled to the second louver drive shaft 170 via corresponding coupling members 180A, 180B for rotationally driving the driven louver 114B of the second upper panel section 136B. As such, the first and second louver drive shafts 168, 170 may form a common upper drive shaft for rotationally driving the louvers 114 within the first and second upper panel sections 136A, 136B of the shutter assembly 100.

Similarly, the motor drive shaft 158 may be configured to extend through lower gearbox 165 to allow rotational motion to be transferred to the drive shafts 174, 176 coupled to the driven louvers 114C, 114D of the first and second lower panel sections 138A, 138B. Specifically, as shown in FIG. 6, the motor drive shaft 158 may be coupled to the third louver drive shaft 174 via the lower gear box 165 for rotationally driving the driven louver 114C of the first lower panel section 138A. Additionally, the third louver drive shaft 174 may, in turn, be coupled to the fourth louver drive shaft 176 via corresponding coupling members 182A, 182B for rotationally driving the driven louver 114D of the second lower panel section 136B. As such, the third and fourth louver drive shafts 174, 176 may form a common a lower drive shaft for rotationally driving the louvers 114 within the first and second lower panel sections 138A, 138B of the shutter assembly 100.

As shown in FIG. 6, similar to the embodiment described above, one or more clutches 190 may be associated with each panel section 136A, 136B, 138A, 138B to provide a means for the louvers 114 within such panel section to be rotationally disengaged or decoupled from the motor 156, thereby allowing for manual adjustment of the rotational orientation of the louvers 114. For instance, in the illustrated embodiment, each driven louver 114A, 114B, 114C, 114D includes a clutch 190 positioned therein that allows the louver to be disengaged from its corresponding louver drive shaft 168, 170, 174, 176. As such, even with the common drive shafts, the louvers 114 within each panel section 136A, 136B, 138A, 138B may be manually adjusted independent of the louvers 114 within the remainder of the panel sections.

Figure 7:
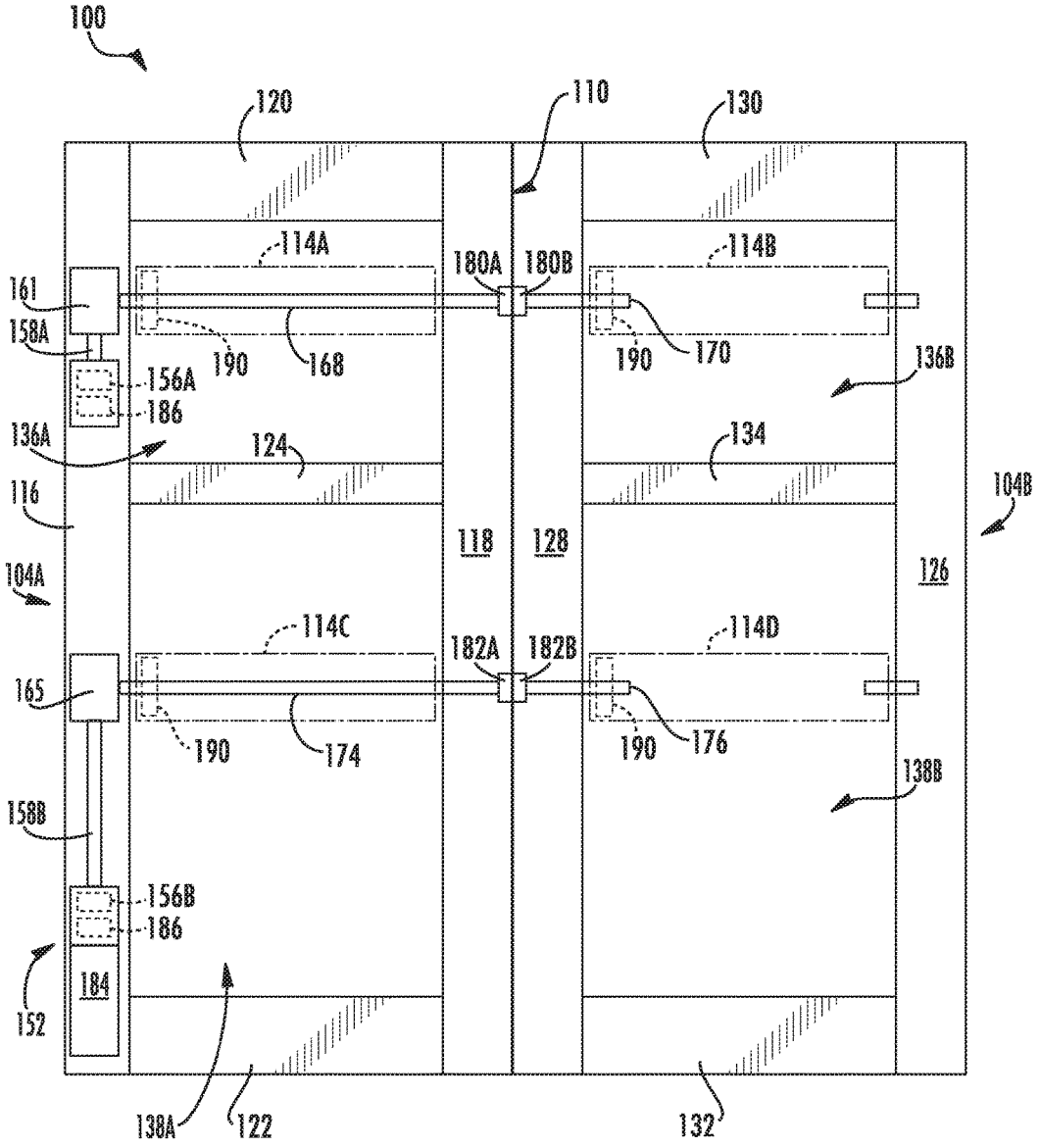
FIG. 7 illustrates yet another simplified front view of the shutter assembly similar to that shown in FIG. 4, particularly illustrating a further illustrative embodiment of a drive system configured for use within the shutter assembly in accordance with aspects of the present subject matter.

Referring now to FIG. 7, an exemplary variation of the illustrative embodiment of the shutter assembly 100 shown in FIG. 6 is illustrated in accordance with aspects of the present subject matter, particularly illustrating a further arrangement for the drive system 152 of the shutter assembly 100. Specifically, FIG. 7 illustrates a front view of the shutter assembly similar to the simplified view shown in FIG. 6.

As shown in FIG. 7, unlike the embodiment described above that includes a single motor 156 for rotationally driving the louvers 114 of the shutter assembly 100, the drive system 152 includes two motors, namely an upper motor 156A and a lower motor 156B. In such an embodiment, the upper motor 156A may be configured to rotationally drive a corresponding upper motor drive shaft 158A that extends through upper gearbox 161 to allow rotational motion to be transferred to the drive shafts 168, 170 coupled to the driven louvers 114A, 114B of the first and second upper panel sections 136A, 136B. Similarly, the lower motor 156B may be configured to rotationally drive a corresponding lower motor drive shaft 158B that extends through lower gearbox 165 to allow rotational motion to be transferred to the drive shafts 174, 176 coupled to the driven louvers 114C, 114D of the first and second lower panel sections 138A, 138B. As a result, the upper panel sections 136A, 136B of the shutter assembly 100 may be rotationally driven independent of the lower panel sections 138A, 138B of the shutter assembly 100.

It should be appreciated that the two-motor drive system shown in FIG. 7 may be similarly implemented with the configuration of the drive system 152 shown in FIG. 4. For instance, the upper motor drive shaft 158A may be configured to extend through both the first gearbox 160 (FIG. 4) and the second gearbox 162 (FIG. 4) to allow the upper motor 156A to rotationally drive both the first louver drive shaft 168 and the second louver drive shaft 160 (e.g., via the upper pass-through louver shaft 172 (FIG. 4)). Similarly, the lower motor drive shaft 158B may be configured to extend through both the third gearbox 164 (FIG. 4) and the fourth gearbox 166 (FIG. 4) to allow the lower motor 156B to rotationally drive both the third louver drive shaft 174 and the fourth louver drive shaft 176 (e.g., via the lower pass-through louver shaft 178 (FIG. 4)).

It should also be appreciated that, in embodiments in which the shutter assembly 100 includes multiple motors, the motors 156A, 156B may be powered via a common power source or separate power sources. For example, as shown in FIG. 7, the shutter assembly 100 may include a single battery pack 184 configured to power both motors 156A, 156B. However, in another embodiment, separate battery backs may be installed within the shutter assembly 100 such that each motor 156A, 156B is powered by its own battery pack. Additionally, in one embodiment, each motor 156A, 156B may form part of a motor assembly having a motor controller 186 associated therewith.

Figure 8:
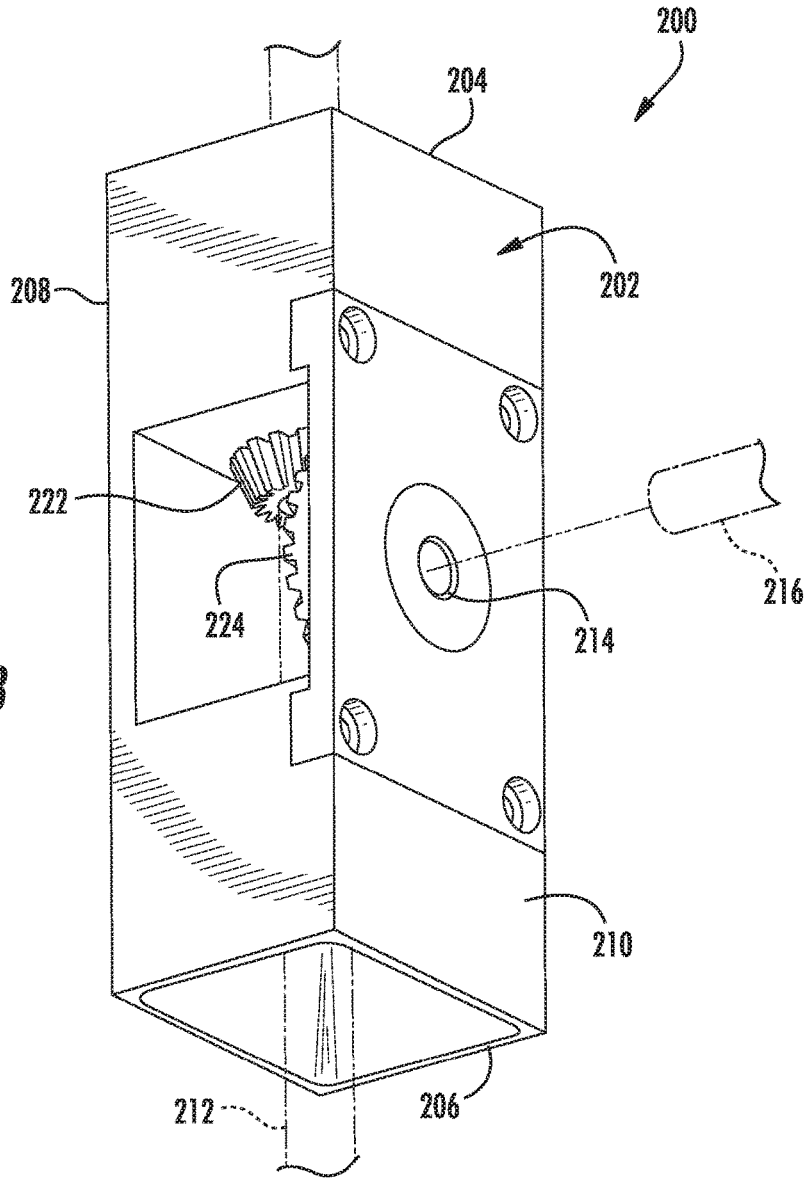
FIG. 8 illustrates a perspective view of one illustrative embodiment of a gearbox suitable for use within the disclosed shutter assembly in accordance with aspects of the present subject matter.
Figure 9:
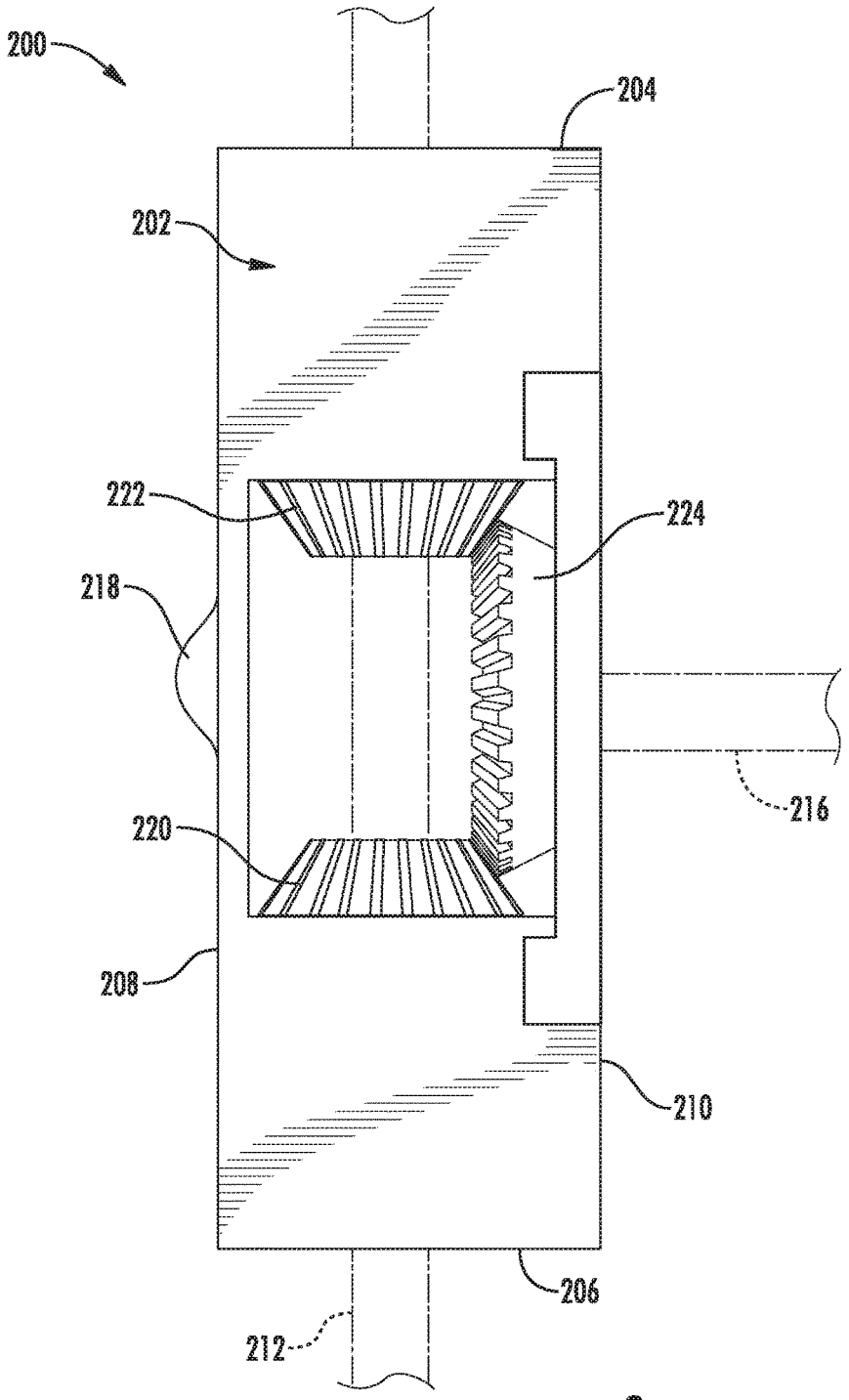
FIG. 9 illustrates a side view of the gearbox shown in FIG. 8.

Referring now to FIGS. 8 and 9, differing views of one illustrative embodiment of a gearbox 200 that may be utilized within the disclosed shutter assembly 100 is illustrated in accordance with aspects of the present subject matter. Specifically, FIG. 8 illustrates a perspective view of the gearbox 200 and FIG. 9 illustrates a side view of the gearbox 200 shown in FIG. 8. It should be appreciated that the gearbox 200 shown in FIGS. 8 and 9 may, in one embodiment, be utilized as one or more of the gearboxes described above with reference to FIGS. 4-7, such as the first gearbox 160, the second gearbox 162, the third gearbox 164, the fourth gearbox 166, the upper gearbox 161, and/or the lower gearbox 165.

As shown, the gearbox 200 may include a housing 202 configured to extend lengthwise between a top end 204 and a bottom end 206 and a crosswise between an outer face 208 and an inner face 210. In one embodiment, a drive shaft 212 (e.g., the motor drive shaft 158 or one of the upper or lower motor drive shafts 158A, 158B of shutter assembly 100) may be configured to extend lengthwise through gearbox 200 between the top and bottom ends 204, 206 of housing 202. As such, suitable shaft openings (not shown) may be defined through the housing 202 at or adjacent to its top and bottom ends 204, 206 for receiving the drive shaft 212.

In several embodiments, the inner face 210 of gearbox 200 may be configured to face inwardly towards the louvers 114 of shutter assembly 100 while the outer face 208 may be configured to face outwardly away from the louvers 114. As shown in FIG. 8, a louver shaft opening 214 may be defined through the inner face 210 of gearbox 200 that is configured to receive a corresponding louver shaft 216 (e.g., one of the louver drive shafts 168, 170, 174, 176 or one of the pass-through louver shafts 172, 178 of shutter assembly 100). Moreover, in one embodiment, housing 202 may include one or more outwardly extending protrusions 218 (FIG. 9) configured to assist in assembling the gearbox 200 within a given shutter frame (e.g., the first shutter frame 112A of shutter assembly 100). For example, as shown in FIG. 9, a cambered protrusion 218 may extend outwardly from the outer face 208 of housing 202. In one embodiment, the cambered protrusion 218 may be configured to engage a corresponding feature defined in the shutter frame in which the gearbox 200 is installed (e.g., by defining a recess in the first frame-side stile 116 that is configured to receive the protrusion 218).

Additionally, in several embodiments, gearbox 200 may include a plurality of gears 220, 222, 224 for transferring rotational motion from the drive shaft 212 to the louver shaft 216. For example, as particularly shown in FIG. 9, the gearbox 200 may include first and second drive shaft gears 220, 222 configured to receive the drive shaft 212. In one embodiment, the first drive shaft gear 220 may be configured to function as a drive or master gear for the gearbox 200 while the second drive shaft gear 220 may be configured to function as a passive or slave gear. For example, the drive shaft 212 may be configured to rotationally engage the first drive shaft gear 220 and simply pass through the second drive shaft gear 222. As such, the second drive shaft gear 222 may be configured to rotate relative to the drive shaft 212 without engaging the shaft 212. However, it should be appreciated that, in another embodiment, the second drive shaft gear 222 may be configured to function as the drive gear for the gearbox 200 while the first drive shaft gear 220 may be configured to function as the passive gear. Alternatively, both the first and second drive shaft gears 220, 222 may correspond to drive gears configured to rotationally engage the drive shaft 212.

Moreover, as shown in FIG. 9, the gearbox 200 may also include a louver drive gear 224 oriented perpendicularly relative to the drive shaft gears 220, 222. In several embodiments, the louver drive gear 224 may be configured to receive or otherwise be coupled to the louver shaft 216. In such embodiments, the louver drive gear 224 may be configured to mesh with the drive shaft gears 220, 222 such that, as the drive shaft 212 is rotated, the first drive shaft gear 220 and/or the second drive shaft gear 222 rotationally drives the louver drive gear 224, which, in turn, rotationally drives the louver shaft 216. As such, rotational motion of the drive shaft 212 may be transferred to the louver shaft 216 via the meshing of the gears 220, 222, 224 to allow an associated motor coupled to the drive shaft 212 (e.g., motor 156) to rotationally drive the louvers 114 of the disclosed shutter assembly 100.

It should be appreciated that the gearbox 200 shown in FIGS. 8 and 9 simply illustrates one example of a suitable gearbox configuration that may be utilized in accordance with aspects of the present subject matter. In other embodiments, any other suitable gearbox configuration may be utilized that allows rotational motion of a first shaft to be transferred to a second shaft.

Figure 10:
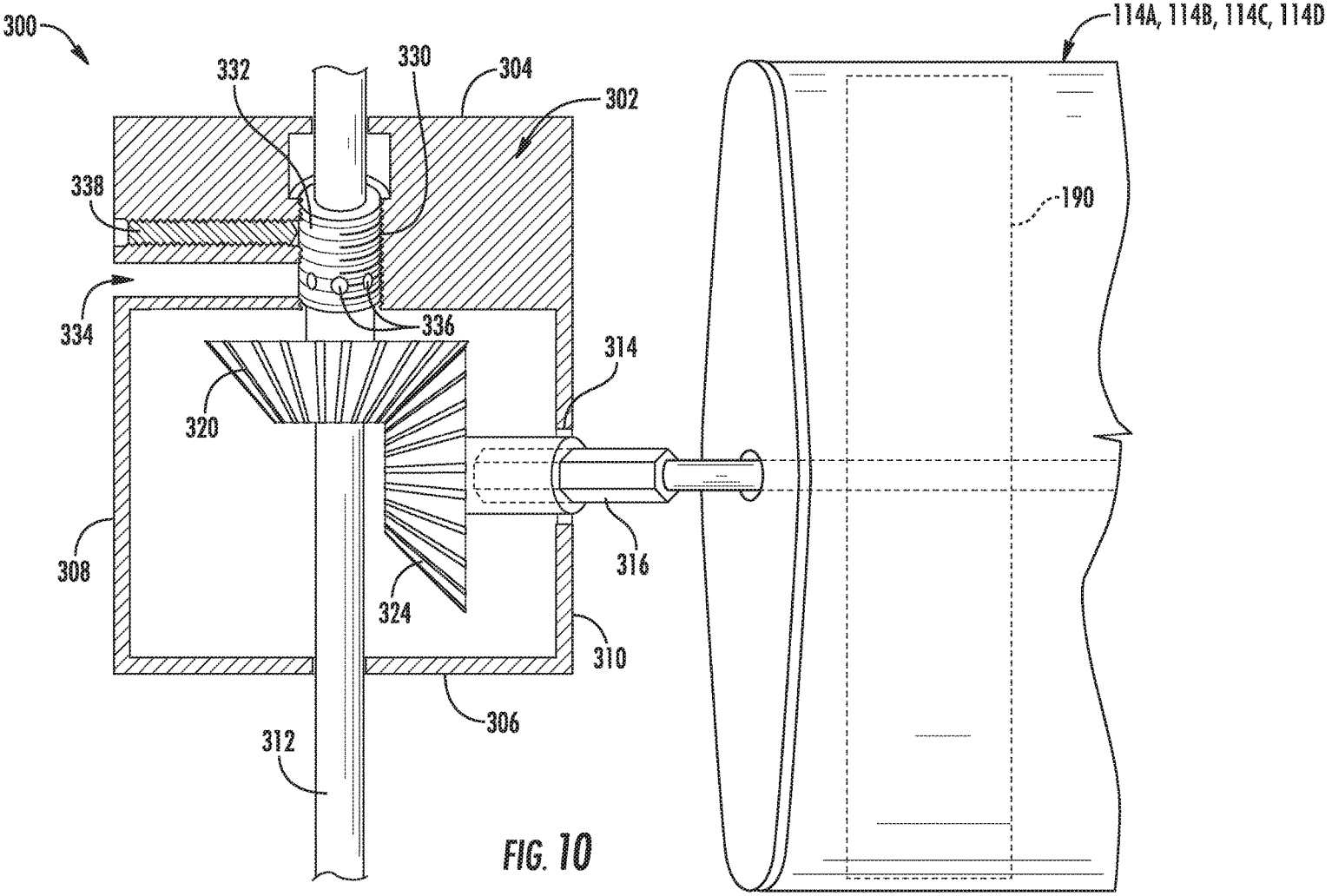
FIG. 10 illustrates a cross-sectional view of another illustrative embodiment of a gearbox suitable for use within the disclosed shutter assembly in accordance with aspects of the present subject matter.

Referring now to FIG. 10, a cross-sectional view of another illustrative embodiment of a gearbox 300 that may be utilized within the disclosed shutter assembly 100 is illustrated in accordance with aspects of the present subject matter. It should be appreciated that the gearbox 300 shown in FIG. 10 may, in one embodiment, be utilized as one or more of the gearboxes described above with reference to FIGS. 4-7, such as the first gearbox 160, the second gearbox 162, the third gearbox 164, the fourth gearbox 166, the upper gearbox 161, and/or the lower gearbox 165.

As shown in FIG. 10, the gearbox 300 may be configured similarly to the gearbox 200 described above. For example, the gearbox 300 may include a housing 302 configured to extend lengthwise between a top end 304 and a bottom end 306 and crosswise between an outer face 308 and an inner face 310. Additionally, a drive shaft 312 (e.g., the motor drive shaft 158 or one of the upper or lower motor drive shafts 158A, 158B of shutter assembly 100) may be configured to extend lengthwise through gearbox 300 between the top and bottom ends 304, 306 of housing 302. In addition, a louver shaft opening 314 may be defined through the inner face 310 of gearbox 300 that is configured to receive a corresponding louver shaft 316 (e.g., one of the louver drive shafts 168, 170, 174, 176 or one of the pass-through louver shafts 172, 178 of shutter assembly 100).

Moreover, the gearbox 300 may include a set of gears 320, 324 for transferring rotational motion from the drive shaft 312 to the louver shaft 316. For example, as shown in FIG. 10, gearbox 300 may include a drive shaft gear 320 configured to rotationally engage the drive shaft 312 and a louver drive gear 324 configured to mesh with the drive shaft gear 320. Thus, as the drive shaft 312 is rotated, the drive shaft gear 320 may rotationally drive the louver drive gear 324, which, in turn, rotationally drives the louver shaft 316.

Additionally, in several embodiments, the vertical positioning of the drive shaft gear 320 may be adjustable relative to the louver drive gear 324 to allow the alignment between the gears 320, 324 to be varied, which may be desirable to compensate for any offset in the timing of panel-to-panel louver movement in instances in which the adjacent shutter panels are being driven by the same motor. For instance, as described above with reference to FIGS. 1-6, four different panel sections 136A, 136B, 138A, 138B across two different shutter panels 104A, 104B may be driven by the same motor 156. In such instance, by adjusting the alignment of the gears 320, 324 within one or more of the gearboxes 300 to accommodate for the varying distances traveled by the louver drive shafts associated with the different panel sections 136A, 136B, 138A, 138B, the louver movement across such panel sections may be synchronized.

As shown in FIG. 10, to allow for the vertical positioning of the drive shaft gear 324 to be adjusted, the gearbox housing 302 may, in one embodiment, define a threaded opening 330 configured to receive a threaded post 332 extending outwardly from the drive shaft gear 320 along the drive shaft 312. Additionally, as shown in the illustrated embodiment, an access slot 334 may be defined through the outer face 308 of the gearbox housing 302 to allow a user of the disclosed shutter assembly 100 to access the portion of the threaded post 332 extending within the threaded opening 330 using a suitable tool. For instance, the threaded post 332 may include radially extending openings 336 spaced apart around its outer circumference into which a tool may be received. The threaded post 332 may then be rotated relative to the housing 302 about the same axis as the drive shaft 312 by inserting the tool through the access slot 334 and into one of the openings 336 and subsequently manually rotating the post 332 using the tool. By rotating the threaded post 332 in one direction or the other relative to the threaded opening 330 defined by the housing 302, the drive shaft gear 320 may be moved vertically along the drive shaft 312 towards or away from the louver drive gear 324 to adjust the relative positioning between the gears 320, 324. Once the desired positioning of the drive shaft gear 320 has been achieved, a set screw 338 extending through the housing may be tightened to lock the post 332 in position relative to the housing 302.

Figure 11:
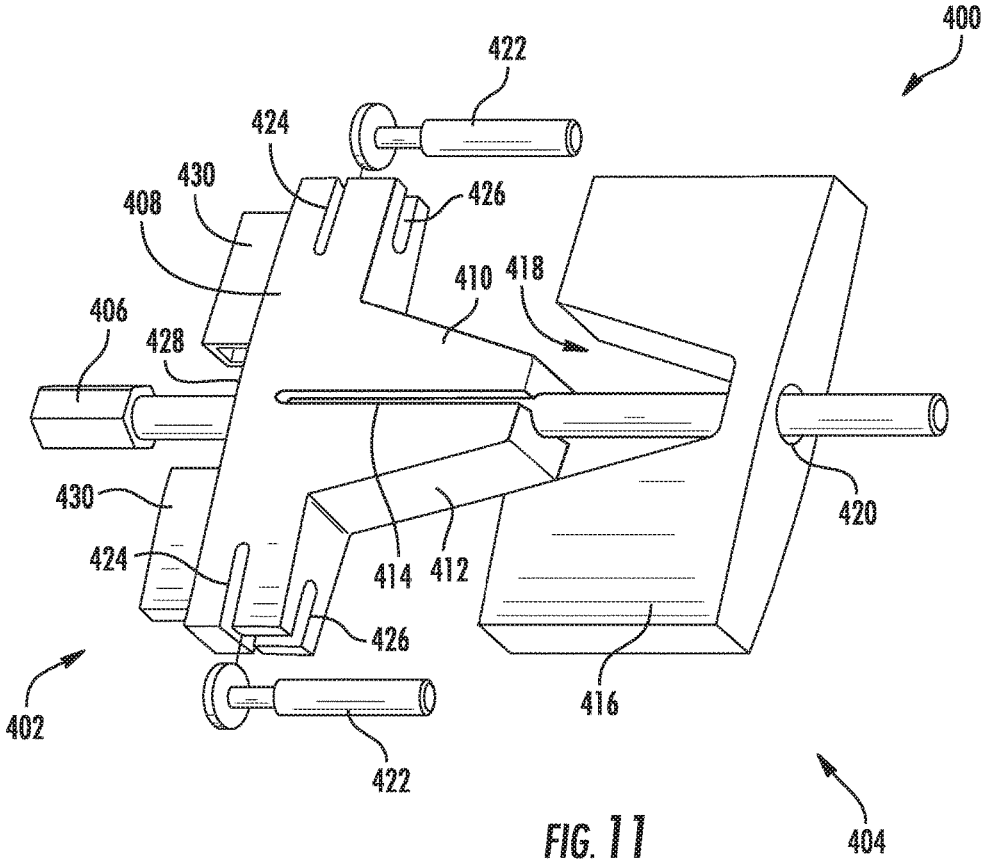
FIG. 11 illustrates an exploded, perspective view of one illustrative embodiment of a clutch suitable for use within the disclosed shutter assembly in accordance with aspects of the present subject matter.
Figure 12:
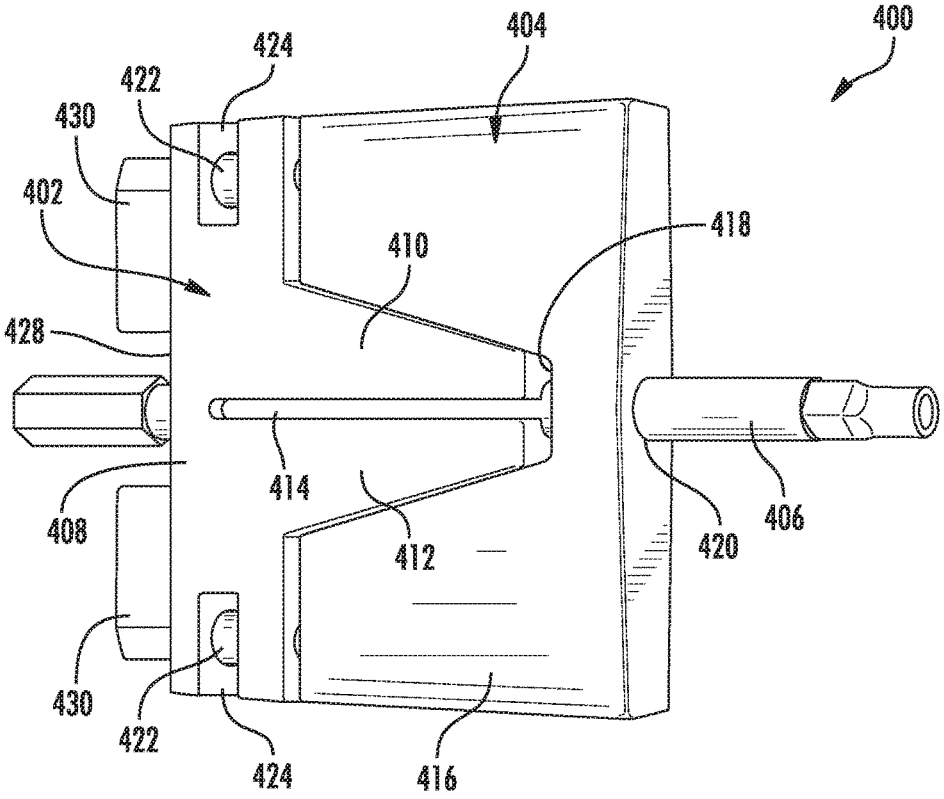
FIG. 12 illustrates an assembled, perspective view of the clutch shown in FIG. 11.

Referring now to FIGS. 11 and 12, differing views of one illustrative embodiment of a clutch 400 that may be utilized within the disclosed shutter assembly 100 is illustrated in accordance with aspects of the present subject matter. Specifically, FIG. 11 illustrates a perspective, exploded view of the clutch 400 and FIG. 12 illustrates a perspective, assembled view of the clutch 400 shown in FIG. 11. It should be appreciated that the clutch 400 shown in FIGS. 11 and 12 may, in one embodiment, be utilized as one or more of the clutches 190 described above with reference to FIGS. 4-7.

As shown, the clutch 400 may include first and second clutch members 402, 404 configured to be installed within a driven louver 114A, 114B, 114C, 114D of the disclosed shutter assembly 100. As will be described in greater detail below, the first clutch member 402 may be configured to be both engaged with and disengaged from a corresponding louver drive shaft 406 (e.g., one of the louver drive shafts 168, 170, 174, 176 of shutter assembly 100) based on slippage occurring at a frictional interface defined between the first clutch member 402 and the louver drive shaft 406. Additionally, the position of the second clutch member 404 may be configured to be selectively adjusted relative to the first clutch member 402 to vary the amount of friction provided at the frictional interface defined between the first clutch member 402 and the louver drive shaft 406, thereby adjusting the amount of torque required to cause the first clutch member 402 to slip relative to the louver drive shaft 406 at the frictional interface.

It should be appreciated that the clutch 400 may be configured such that, when the motor 156 (or one of motors 158A, 158B) of shutter assembly 100 is being used to adjust the rotational orientation of the louvers 114, the first clutch member 402 may be configured to rotationally engage the louver drive shaft 406 at the frictional interface, thereby allowing the driven louver within which the clutch 400 is installed to be rotationally driven by the motor 156. However, when the position of the louvers 114 are, instead, being manually adjusted, the first clutch member 402 may be configured to slip relative to the louver drive shaft 406 at the frictional interface, thereby allowing the associated driven louver to be disengaged from the louver drive shaft 406. In addition, the clutch 400 may also function to realign a given panel section of louvers 114 with the remainder of the louvers 114 of the disclosed shutter assembly 100 after the louvers 114 of such panel section have been manually adjusted relative to the louvers 114 of the other panel sections. For instance, when operating the motor 156 of the shutter assembly 100 following manual adjustment of a given panel section, the clutch 400 may allow the motor 156 to rotate the corresponding louvers 114 of the panel section until the louvers 114 reach the end of their travel range (e.g., by contacting one another at their substantially vertical positions), at which point the first clutch member 402 may begin to slip relative to the louver drive shaft 406 to permit the shaft 406 to rotate relative to the clutch 400 without further rotation of the associated louvers 114.

As shown, the first clutch member 402 may include a base portion 408 and first and second coned or angled portions 410, 412 extending outwardly from the base portion 408. In one embodiment, both the base portion 408 and the first and second angled portions 410, 412 may define an opening (not shown) configured to allow the louver drive shaft 406 to be received through the first clutch member 402. Additionally, a slot 414 may be defined through the first clutch member 402 that separates the first angled portion 410 from the second angled portion 412 and allows the angled portions 410, 412 to move relative to each other to increase/decrease the friction at the frictional interface.

Moreover, as shown in FIG. 11, the second clutch member 404 may include an engagement block 416 defining a coned or angled recess 418 configured to receive the first and second angled portions 410, 412 of the first clutch member 400. As will be described below, by adjusting the extent to which the angled portions 410, 412 are received within the angled recess 418 of the second clutch member 404, the amount of friction provided at the frictional interface between the first clutch member 402 and the louver drive shaft 406 may be adjusted. For instance, to increase the amount of friction provided at the frictional interface, the relative positioning of the engagement block 416 and the angled portions 410, 412 may be adjusted such that the angled portions 410, 412 are received further within the angled recess 418, thereby forcing the first and second angled portions 410, 412 inwardly towards each other to allow the angled portions 410, 412 to more tightly wrap around or otherwise press against the louver drive shaft 406. Similarly, to reduce the amount of friction provided at the frictional interface, the relative positioning of the engagement block 416 and the angled portions 410, 412 may be adjusted so as to partially back-out the angled portions 410, 412 from the angled recess 418, thereby allowing the first and second angled portions 410, 412 to move away from each other in a manner that loosens or reduces the frictional connection between the angled portions 410, 412 and the louver drive shaft 406. It should be appreciated that the second clutch member 404 may define a shaft opening 420 configured to allow the louver drive shaft 406 to pass through the engagement block 416 without rotationally engaging the second clutch member 404.

As particularly shown in FIG. 11, to allow the amount of friction provided at the frictional interface to be adjusted, the clutch 400 may also include adjustment screws 422 configured to be installed within corresponding slots 424, 426 defined through opposed ends of the base portion 408 of the first clutch member 402. For example, a first slot 424 defined at each end of the base portion 408 may be configured to receive the head of each adjustment screw 422 while a second transverse slot 426 defined at each end of the base portion 408 may be configured to receive a portion of the shaft of each adjustment screw 422.

In general, the adjustment screws 422 may be configured to be screwed into corresponding threaded openings (not shown) defined in the engagement block 416 of the second clutch member 404. As such, by rotating the adjustment screws 422 in one direction (e.g., a tightening direction), the engagement block 416 may be pulled down towards the base portion 408 of the first clutch member 402, thereby increasing the friction between the angled portions 410, 412 and the louver drive shaft 406. Similarly, by rotating the adjustment screws 422 in the opposite direction (e.g., a loosening direction), the engagement block 416 may be allowed to move away from the base portion 408 of the first clutch member 402, thereby reducing the friction between the angled portions 410, 412 and the louver drive shaft 406. It should be appreciated that suitable openings (not shown) may be defined through the base portion 408 that extend from each first slot 424 to an outer face 428 of the base portion 408, thereby allowing the screws 422 to be adjusted by inserting a tool through the openings (e.g., an Allen wrench).

Additionally, as shown in FIGS. 11 and 12, the first clutch member 402 may, in one embodiment, include locating tabs 430 extending outwardly from the outer face 428 of the base portion 408. In such an embodiment, the locating tabs 430 may be configured to be received within corresponding features of the adjacent end cap of the driven louver within which the clutch 400 is installed.

It should be appreciated that, in one embodiment, all or a portion of the first clutch member 402 (e.g., the angled portions 410, 412) may be formed from a deformable, friction material selected to provide a desired frictional interface between the first clutch member 402 and the louver drive shaft 406. For instance, suitable deformable, friction materials may include, but are not limited to, nylon, acetal, polycarbonate and/or any other suitable materials.

Figure 13:
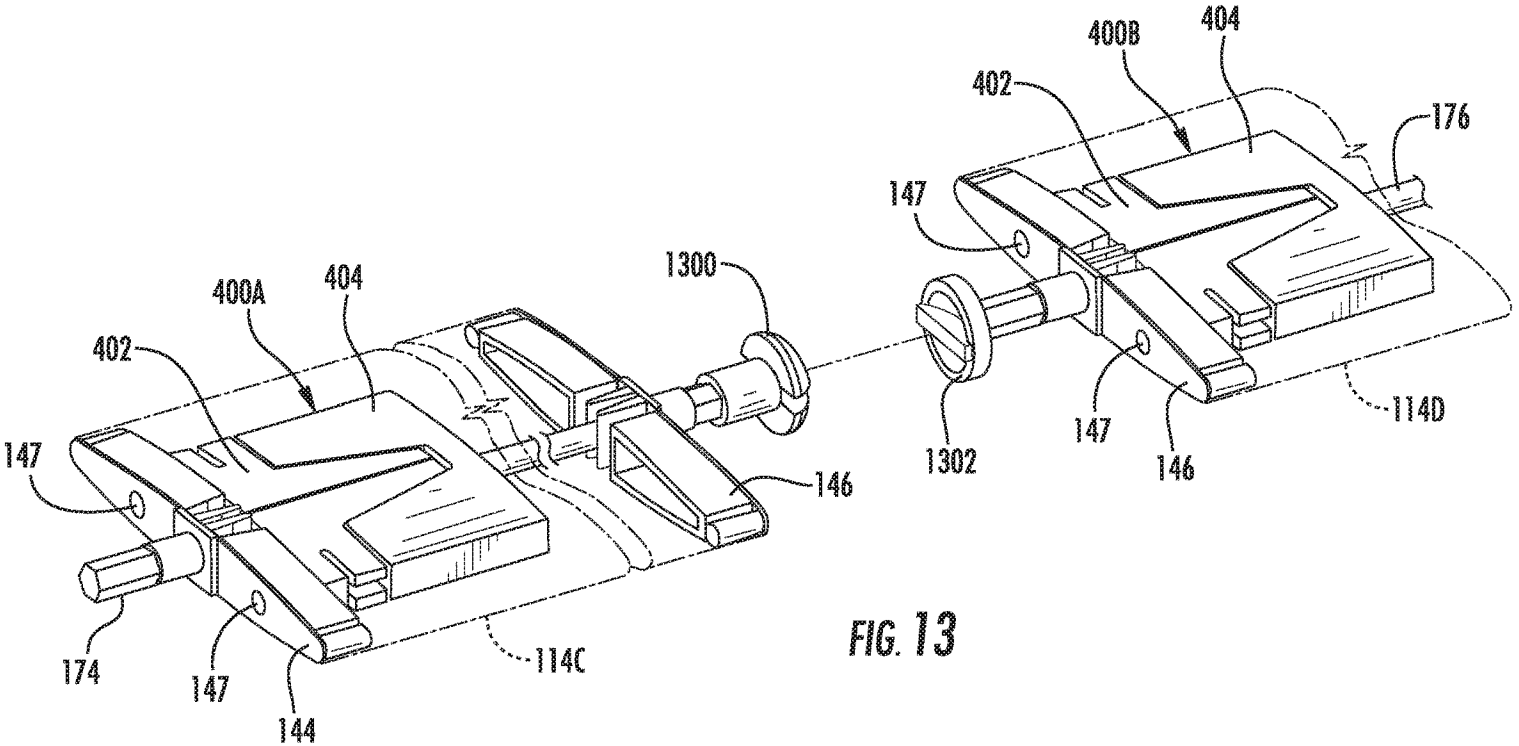
FIG. 13 illustrates a perspective view of one illustrative embodiment of the clutch shown in FIGS. 11 and 12 installed within louvers of adjacent shutter panels of the disclosed shutter assembly in accordance with aspects of the present subject matter.

Referring now to FIG. 13, a partial, perspective view of driven louvers of adjacent panel sections of the disclosed shutter assembly 100 having the clutch 400 shown in FIGS. 11 and 12 installed therein is illustrated in accordance with aspects of the present subject matter. For purposes of description, the driven louvers of FIG. 13 will be described as corresponding to the driven louvers 114C, 114D of the first and second lower panel sections 138A, 138B of the shutter assembly 100 described above with reference to FIG. 6. However, it should be appreciated that, in general, the louvers shown in FIG. 13 may correspond to any suitable driven louvers of the disclosed shutter assembly 100.

As shown in FIG. 13, a first clutch 400A may be installed within the driven louver 114C of the first lower panel section 138A, such as by installing the first clutch 400A within the driven louver 114C adjacent to its frame-side end cap 144. Similarly, a second clutch 400B may be installed within the driven louver 114D of the second lower panel section 138B, such as by installing the second clutch 400B within the driven louver 114B adjacent to its panel-side end cap 146. By installing the clutches 400A, 400B adjacent to the end caps 144, 146 of the driven louvers 114C, 114D, the adjustment screws (not shown in FIG. 13) of the clutches 400A, 400B may be easily accessed from the exterior for the driven louvers 114C, 114D. For instance, as shown in FIG. 13, each end cap 144, 146 may define openings 147 configured to be aligned with the corresponding openings defined through the base portion 408 of each clutch 400A, 400B. As such, a suitable tool (e.g., an Allen wrench) may be inserted through the aligned openings from the exterior of each driven louver 114C, 114D to allow the adjustment screws 422 of the associated clutch 400A, 400B to be tightened or loosened, as desired.

It should be appreciated that the shape and/or outer dimensions of each clutch 400A, 400B may be selected such that the clutch 400A, 400B engages the inner wall(s) or surface(s) of its corresponding driven louver 114C, 114D when installed within the louver 114C, 114D, thereby allowing the clutch 400A, 400B to rotationally engage the louver 114C, 114D. For instance, as shown in FIG. 13, each clutch 400A, 400B may be configured to define a substantial width/height relative to the overall width/height of its corresponding louver 114C, 114D to ensure that the clutch 400A, 400B does not rotate relative to the louver 114C, 114D.

As indicated above, the louver drive shafts of adjacent panel sections may, in several embodiments, be coupled to each other via coupling members to allow the rotational motion of one louver drive shaft to be transferred to the adjacent louver drive shaft. For example, in the embodiment shown in FIG. 13, the third louver drive shaft 174 extending through the driven louver 114C of the first lower panel section 138A may include a first coupling member 1300 (described below with reference to FIGS. 24 and 25) secured to its end that is configured to engage a corresponding second coupling member 1302 (described below with reference to FIGS. 24 and 25) secured to the end of the fourth louver drive shaft 176 extending through the driven louver 114D of the second lower panel section 138B. In such an embodiment, the clutches 400A, 400B may allow the driven louvers 114A, 114B of the adjacent lower panel sections 136A, 136B to be manually adjusted independent of each other despite their louver drive shafts 174, 176 being rotationally coupled to each other via the coupling members 1300, 1302. Specifically, when manually adjusting the rotational orientation of the louvers 114 within the first lower panel section 138A, the first clutch 400A may allow the associated driven louver 114C to rotationally disengage from the third louver drive shaft 174, thereby allowing the driven louver 114C to be rotated relative to the louver drive shaft 174. Similarly, the second clutch 400B may allow the louvers 114 within the second lower panel section 138B to be manually adjusted without transferring such rotation to the fourth louver drive shaft 176.

Figure 14:
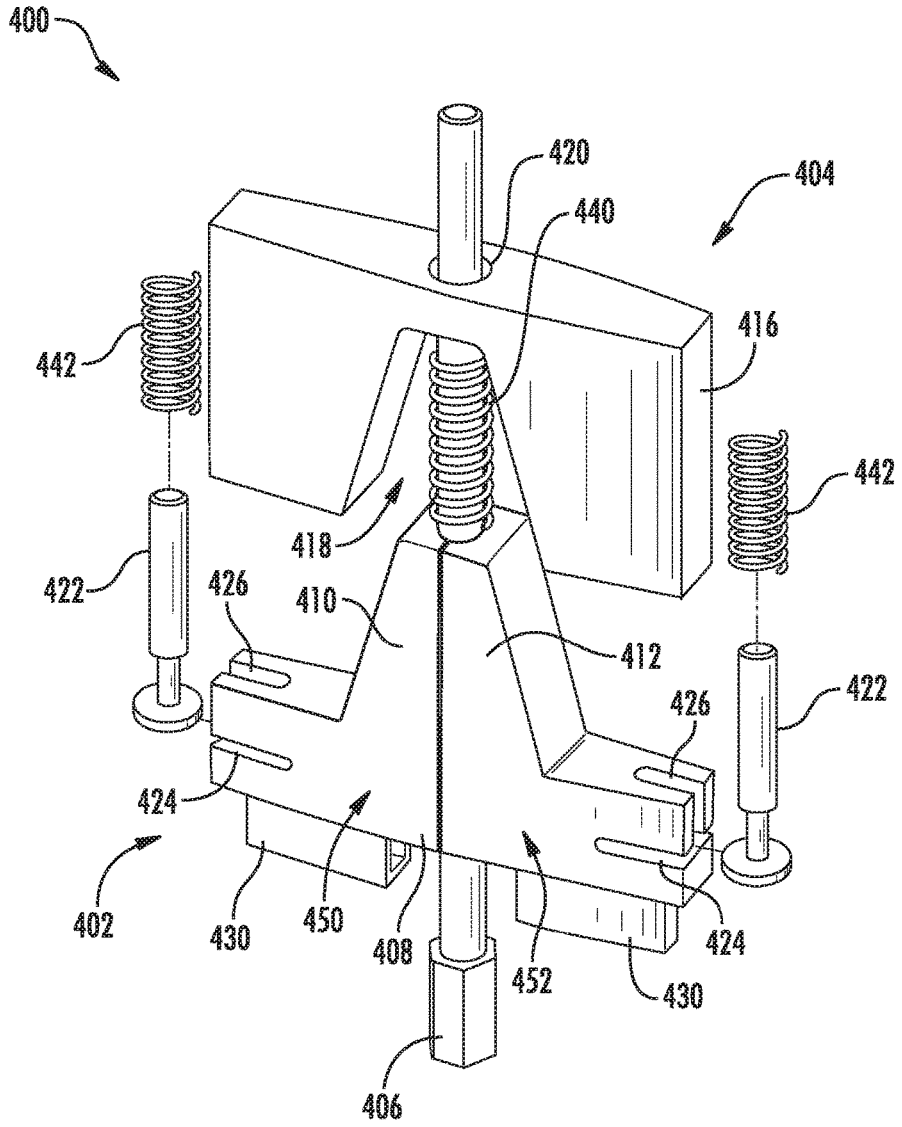
FIG. 14 illustrates an exploded, perspective view of another illustrative embodiment of the clutch shown in FIGS. 11 and 12 in accordance with aspects of the present subject matter.

Referring now to FIG. 14, an exemplary variation of the illustrative embodiment of the clutch 400 shown in FIGS. 11 and 12 is illustrated in accordance with aspects of the present subject matter. As shown, unlike the embodiment described above, the clutch 400 may include one or more springs 440, 442 configured to be positioned between the first and second clutch members 402, 404 to assist in separating the clutch members 402, 404 when the adjustment screws 422 are being loosened. Specifically, in one embodiment, a shaft spring 440 may be positioned on the louver drive shaft 406 at a location between the angled portions 410, 412 of the first clutch member 402 and the engagement block 416 of the second clutch member 404. As such, when the adjustment screws 422 are loosened, the shaft spring 440 may provide a biasing force that pushes the second clutch member 404 away from the first clutch member 402. In addition to the shaft spring 440, or as an alternative thereto, a screw spring 442 may be positioned on each adjustment screw 422 at a location between the base portion 408 of the first clutch member 402 and the engagement block 416 of the second clutch member 402. Similar to the shaft spring 440, the screw springs 442 may provide a biasing force that serves to separate the clutch members 402, 404 as the adjustment screws 422 are being loosened.

Additionally, when previously describing the clutch 400, the first clutch member 402 was shown in FIGS. 11 and 12 as corresponding to a single integral component. However, in other embodiments, the first clutch member 402 may be split into two separate components along its length. For example, as shown in FIG. 14, the first clutch member 402 may be formed from an assembly of first and second components 450, 452, with each component 450, 452 generally defining one-half of the clutch member 402.

Figure 15:
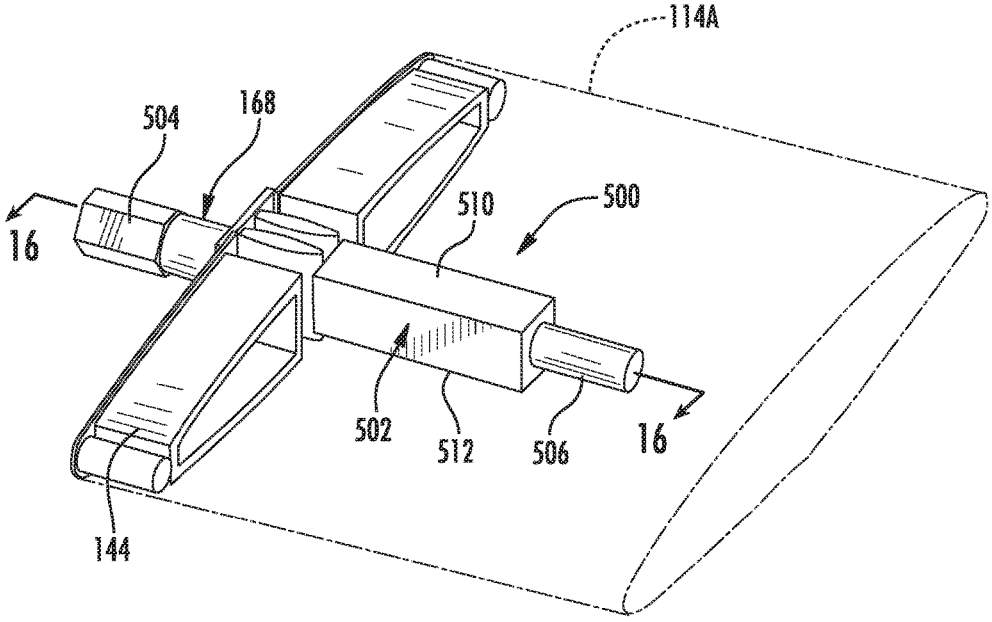
FIG. 15 illustrates a perspective view of another illustrative embodiment of a clutch suitable for use within the disclosed shutter assembly in accordance with aspects of the present subject matter.
Figure 16:
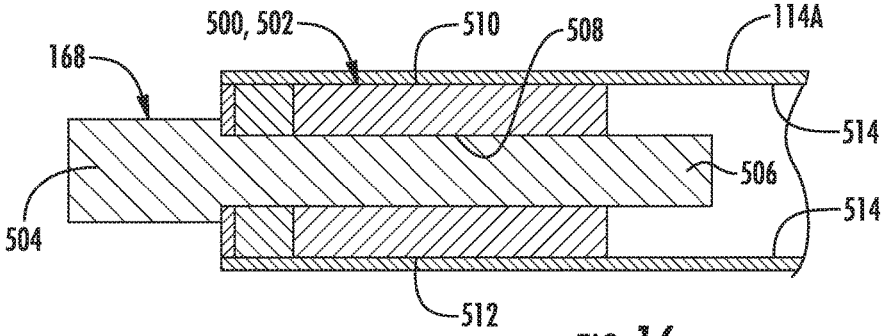
FIG. 16 illustrates a cross-sectional view of the clutch shown in FIG. 15 taken about line 16-16.

Referring now to FIGS. 15 and 16, differing views of another illustrative embodiment of a clutch 500 that may be utilized within the disclosed shutter assembly 100 are illustrated in accordance with aspects of the present subject matter. Specifically, FIG. 15 illustrates a perspective view of the clutch 500 and FIG. 16 illustrates a cross-sectional view of the clutch 500 shown in FIG. 15 taken about line 16-16. It should be appreciated that the clutch 500 shown in FIGS. 15 and 16 may, in one embodiment, be utilized as one or more of the clutches 190 described above with reference to FIGS. 4-7. For purposes of description, the clutch 500 will be described as being installed within the driven louver 114A of the first upper panel section 136A of the shutter assembly 100 described above with reference to FIG. 4. However, it should be appreciated that, in general, the clutch 500 may be installed within any suitable driven louver of the disclosed shutter assembly 100.

As shown, the clutch 500 may include a sleeve member 502 configured to be installed onto a portion of the louver drive shaft 168 extending within the driven louver 114A of the first upper panel section 136A. Specifically, in the illustrated embodiment, the louver drive shaft 168 may include a first shaft portion 504 extending outwardly from the adjacent end cap of the driven louver 114A (e.g., the frame-side end cap 144) along the exterior of the driven louver 114A (e.g., to allow the first shaft portion 504 to be received within a corresponding gearbox of the shutter assembly 100) and a second shaft portion 506 extending within the driven louver 114A. In such an embodiment, the sleeve member 502 may be configured to be installed onto the second portion 506 of the louver drive shaft 168 such that the clutch 500 is positioned within the interior of the driven louver 114A.

In several embodiments, the sleeve member 502 may be formed from a deformable, friction material (e.g., nylon or any other suitable material) that allows the sleeve member 502 to be fit tightly around the louver drive shaft 168 to provide a frictional interface between the clutch 500 and the drive shaft 168. For instance, the sleeve member 502 may define an opening 508 extending along its length through which the louver drive shaft 168 is configured to extend. In such an embodiment, the diameter of the opening 508 may be smaller than the diameter of the louver drive shaft 158 so that the sleeve member 502 grips the louver drive shaft 168 tightly around the frictional interface. Additionally, in several embodiments, the shape and/or outer dimensions of the sleeve member 502 may be selected such that the sleeve member 502 engages the inner wall(s) or surface(s) of the driven louver 114A when the clutch 500 is installed within the louver 114A, thereby allowing the clutch 500 to rotationally engage the louver 114A. For instance, as shown in FIGS. 15 and 16, the sleeve member 502 may define a rectangular shape having top and bottom sides 510, 512 configured to engage corresponding inner surfaces 514 of the driven louver 114A. However, in other embodiments, the sleeve member 502 may define any other suitable shape that allows the clutch 500 to rotationally engage the driven louver 114A.

Given the frictional interface provided between the clutch 500 and the louver drive shaft 168, the sleeve member 502 (and, thus, the driven louver 114A) may be configured to rotate with the louver drive shaft 168 when the motor 156 of the shutter assembly 100 is being used to rotationally drive the shaft 168. However, when the position of the driven louver 114A (or any other louver 114 to which the driven louver 114A is connected) is being manually adjusted, the friction between the clutch 500 and the louver drive shaft 168 may be overcome, thereby allowing the sleeve member 502 to rotate relative to the louver drive shaft 168. In addition, the clutch 500 may also allow the driven louver 114A (and any other louvers 114 connected to the driven louver 114A) to be realigned within the remainder of the louvers 114 of the shutter assembly 100 following manual adjustment. For instance, when the driven louver 114A reaches the end of its travel range, the sleeve member 502 may begin to slip relative to the louver drive shaft 168 to permit the drive shaft 168 to rotate relative to the clutch 500 without further rotation of the driven louver 114A.

Figure 17:
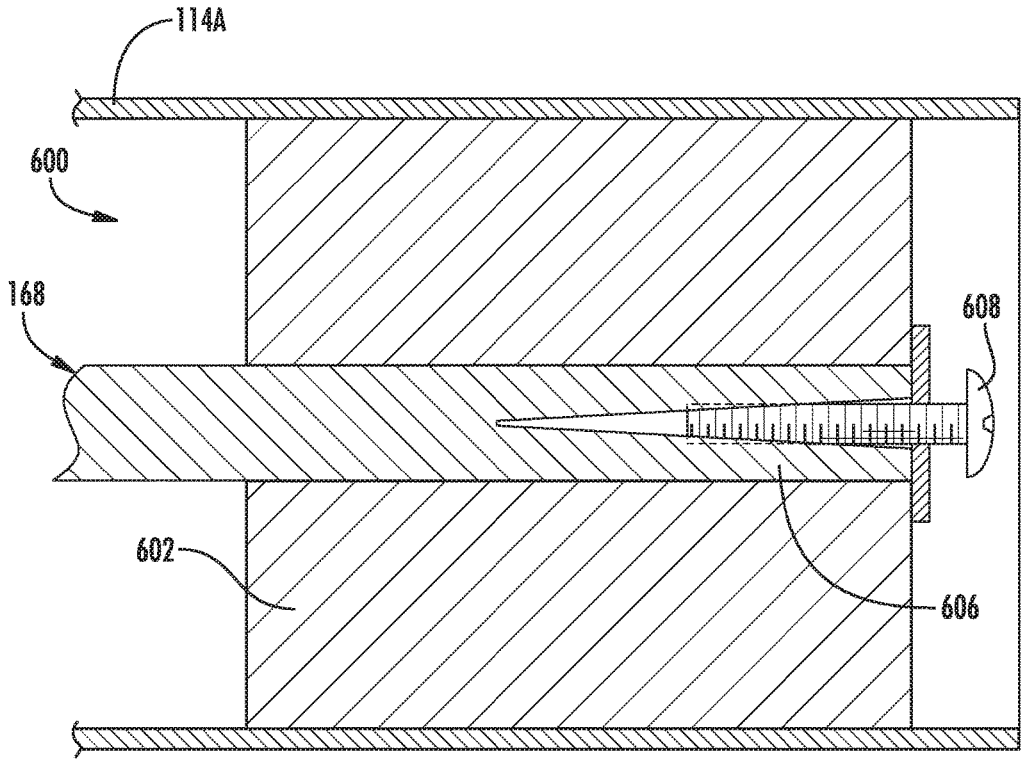
FIG. 17 illustrates a cross-sectional view of a further illustrative embodiment of a clutch suitable for use within the disclosed shutter assembly in accordance with aspects of the present subject matter.

Referring now to FIG. 17, a cross-sectional view of a further illustrative embodiment of a clutch 600 that may be utilized within the disclosed shutter assembly 100 is illustrated in accordance with aspects of the present subject matter. It should be appreciated that the clutch 600 shown in FIG. 17 may, in one embodiment, be utilized as one or more of the clutches 190 described above with reference to FIGS. 4-7. For purposes of description, the clutch 600 will be described as being installed within the driven louver 114A of the first upper panel section 136A of the shutter assembly 100 described above with reference to FIG. 4. However, it should be appreciated that, in general, the clutch 600 may be installed within any suitable driven louver of the disclosed shutter assembly 100.

As shown, the clutch 600 may be configured similarly to the clutch 500 described above with reference to FIGS. 15 and 16. For example, the clutch 600 may include a sleeve member 602 configured to be installed onto a portion of the louver drive shaft 168 extending within the driven louver 114A of the first upper panel section 136A. Similar to the sleeve member 502 described above, the sleeve member 602 may be formed from a deformable, friction material (e.g., nylon or any other suitable material) that allows the sleeve member 602 to be fit tightly around the louver drive shaft 168 to provide a frictional interface between the clutch 600 and the drive shaft 168. In addition, the shape and/or outer dimensions of the sleeve member 602 may be selected such that the sleeve member 602 engages the inner wall(s) or surface(s) of the driven louver 114A when the clutch 600 is installed within the louver 114A, thereby allowing the clutch 600 to rotationally engage the louver 114A.

Moreover, as shown in FIG. 17, the amount of friction provided at the frictional interface defined between the clutch 600 and the louver drive shaft 168 may be adjusted using an adjustment screw 604 configured to be screwed into a split-end portion 606 of the louver drive shaft 168 extending through the sleeve member 602. Specifically, by tightening the screw 604 into the split-end portion 606 of the louver drive shaft 168, the split-end portion 606 may expand outwardly and press against the sleeve member 602, thereby increasing the friction between the clutch 600 and the louver drive shaft 168. Similarly, by loosening the screw 604, the split-end portion 606 of the louver drive shaft 168 may contract or move away from the sleeve member 602, thereby reducing the friction between the clutch 600 and the louver drive shaft 168. Thus, by varying the positioning of the screw 604 within the split-end portion 606 of the louver drive shaft 168, the amount of torque required to cause sleeve member 602 to slip relative to the louver drive shaft 168 at the frictional interface may be adjusted.

Figure 18:
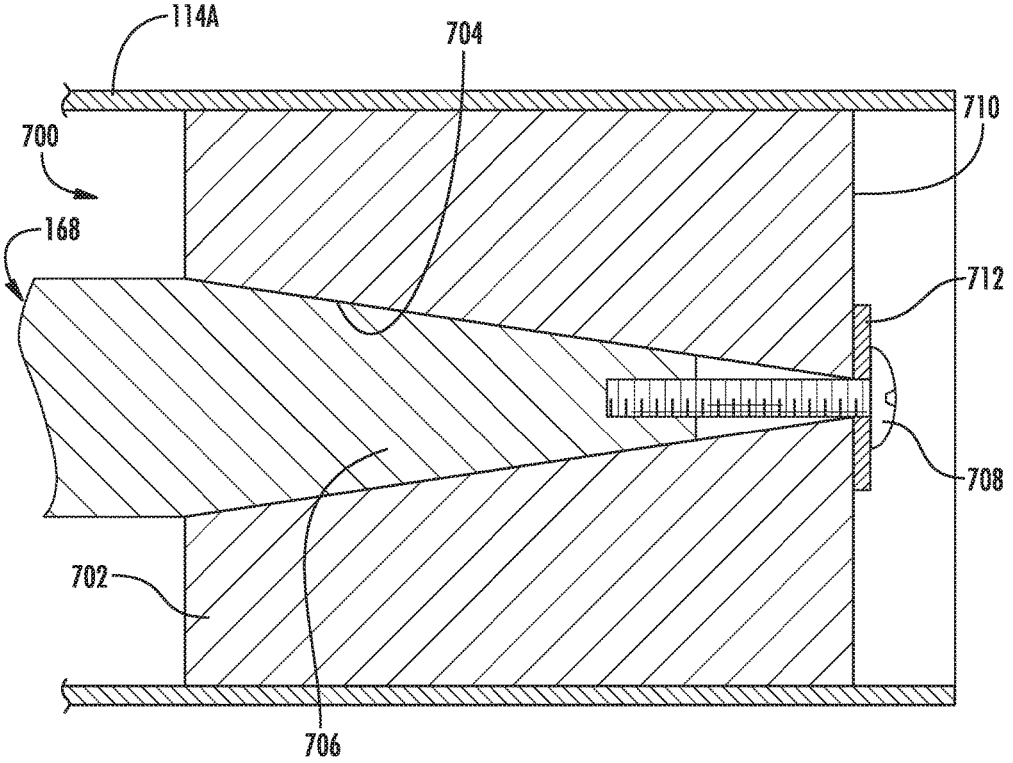
FIG. 18 illustrates a cross-sectional view of yet another illustrative embodiment of a clutch suitable for use within the disclosed shutter assembly in accordance with aspects of the present subject matter.

Referring now to FIG. 18, a cross-sectional view of yet another illustrative embodiment of a clutch 700 that may be utilized within the disclosed shutter assembly 100 is illustrated in accordance with aspects of the present subject matter. It should be appreciated that the clutch 700 shown in FIG. 18 may, in one embodiment, be utilized as one or more of the clutches 190 described above with reference to FIGS. 4-7. For purposes of description, the clutch 700 will be described as being installed within the driven louver 114A of the first upper panel section 136A of the shutter assembly 100 described above with reference to FIG. 4. However, it should be appreciated that, in general, the clutch 700 may be installed within any suitable driven louver of the disclosed shutter assembly 100.

As shown, the clutch 700 may be configured similarly to the clutches 500, 600 described above with reference to FIGS. 15-17. For example, the clutch 700 may include a sleeve member 702 configured to be installed onto a portion of the louver drive shaft 168 extending within the driven louver 114A of the first upper panel section 136A. Similar to the sleeve members 502, 602 described above, the sleeve member 702 may be formed from a deformable, friction material (e.g., nylon or any other suitable material) that allows the sleeve member 702 to be fit tightly around the louver drive shaft 168 to provide a frictional interface between the clutch 700 and the drive shaft 168. In addition, the shape and/or outer dimensions of the sleeve member 702 may be selected such that the sleeve member 702 engages the inner wall(s) or surface(s) of the driven louver 114A when the clutch 700 is installed within the louver 114A, thereby allowing the clutch 600 to rotationally engage the louver 114A.

However, as shown in FIG. 18, the sleeve member 702 of the illustrated clutch 700 may be configured to define a tapered opening 704 configured to receive a tapered end portion 706 of the louver drive shaft 168. In such an embodiment, an adjustment screw 708 positioned at an end 710 of the sleeve member 702 may be utilized to adjust the amount of friction provided at the frictional interface defined between the clutch 700 and the louver drive shaft 168. For example, as shown in FIG. 18, the adjustment screw 708 may be screwed into a corresponding threaded opening (not shown) defined through the end of the louver drive shaft 168. Additionally, the head of the adjustment screw 708 may be configured to engage a washer 712 abutting the end 710 of the sleeve member 702. As such, by tightening the screw 708, the tapered end portion 706 of the drive shaft 168 may be drawn further into the tapered opening 704 of the sleeve member 702, thereby increasing the friction between the clutch 700 and the louver drive shaft 168. Similarly, by loosening the screw 708, the pressure between the sleeve member 702 and the tapered end portion 706 of the louver drive shaft 168 may be decreased, thereby reducing the friction between the clutch 700 and the louver drive shaft 168. Thus, by tightening or loosening the screw 708, the amount of torque required to cause the sleeve member 702 to slip relative to the louver drive shaft 168 at the frictional interface may be adjusted.

Figure 19:
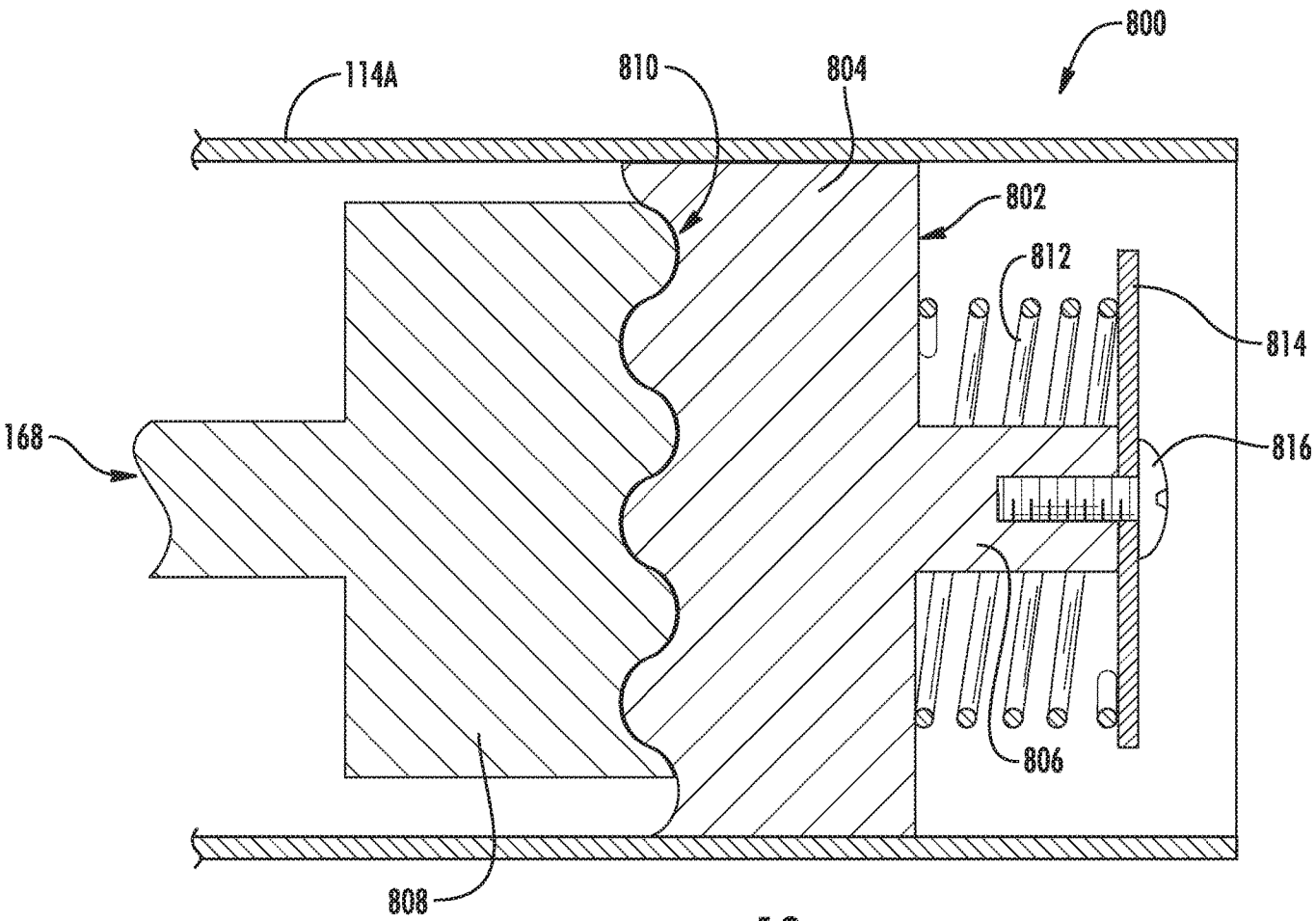
FIG. 19 illustrates a cross-sectional view of an even further illustrative embodiment of a clutch suitable for use within the disclosed shutter assembly in accordance with aspects of the present subject matter.

Referring now to FIG. 19, a cross-sectional view of an even further illustrative embodiment of a clutch 800 that may be utilized within the disclosed shutter assembly 100 is illustrated in accordance with aspects of the present subject matter. It should be appreciated that the clutch 800 shown in FIG. 19 may, in one embodiment, be utilized as one or more of the clutches 190 described above with reference to FIGS. 4-7. For purposes of description, the clutch 800 will be described as being installed within the driven louver 114A of the first upper panel section 136A of the shutter assembly 100 described above with reference to FIG. 4. However, it should be appreciated that, in general, the clutch 800 may be installed within any suitable driven louver of the disclosed shutter assembly 100.

As shown, the clutch 800 may include a clutch member 802 configured to be installed with a portion of the louver drive shaft 168 extending within the driven louver 114A of the first upper panel section 136A. In several embodiments, the clutch member 802 may include a detent portion 804 and a post portion 806 extending outwardly from the detent portion 804. The detent portion 804 may generally be configured to engage the driven louver 114A along its outer perimeter to ensure that the clutch 800 and the driven louver 114A rotate together. In addition, the detent portion 804 of the clutch member 800 may be configured to engage a corresponding detent portion 808 coupled to or formed integrally with a portion the louver drive shaft 168. As shown in FIG. 19, each detent portion 804, 808 may include a wavy or ratcheted end face configured to mate with a corresponding end face of the other detent portion 804, 808 at an engagement interface 810 defined between the detent portions 804, 808.

Additionally, as shown in FIG. 19, the clutch 800 may include a spring 812 compressed between the detent portion 804 of the clutch member 802 and a washer 814 positioned at the end of the post portion 806 (e.g., by retaining the washer 814 via a screw 816 tightened into the end of the post portion 806). The spring 812 may generally be configured to provide a biasing force against the detent portion 804 of the clutch member 802 that biases such detent portion 804 into rotational engagement with the detent portion 808 of the louver drive shaft 168. A such, when the motor 156 of shutter assembly 100 is used to rotationally drive the louver drive shaft 168, rotational motion may be transferred from the louver drive shaft 168 to the clutch 800 (and, thus, to the driven louver 168) via the engagement interface 810 defined between the adjacent detent portions 804, 808. However, when the driven louver 114A is being manually adjusted, the detent portion 804 of the clutch member 802 may be cammed outwardly against the force of the spring 812 in a direction away from the detent portion 808 of the louver drive shaft 168, thereby allowing the clutch member 800 to rotate relative to the louver drive shaft 168.

Figure 20:
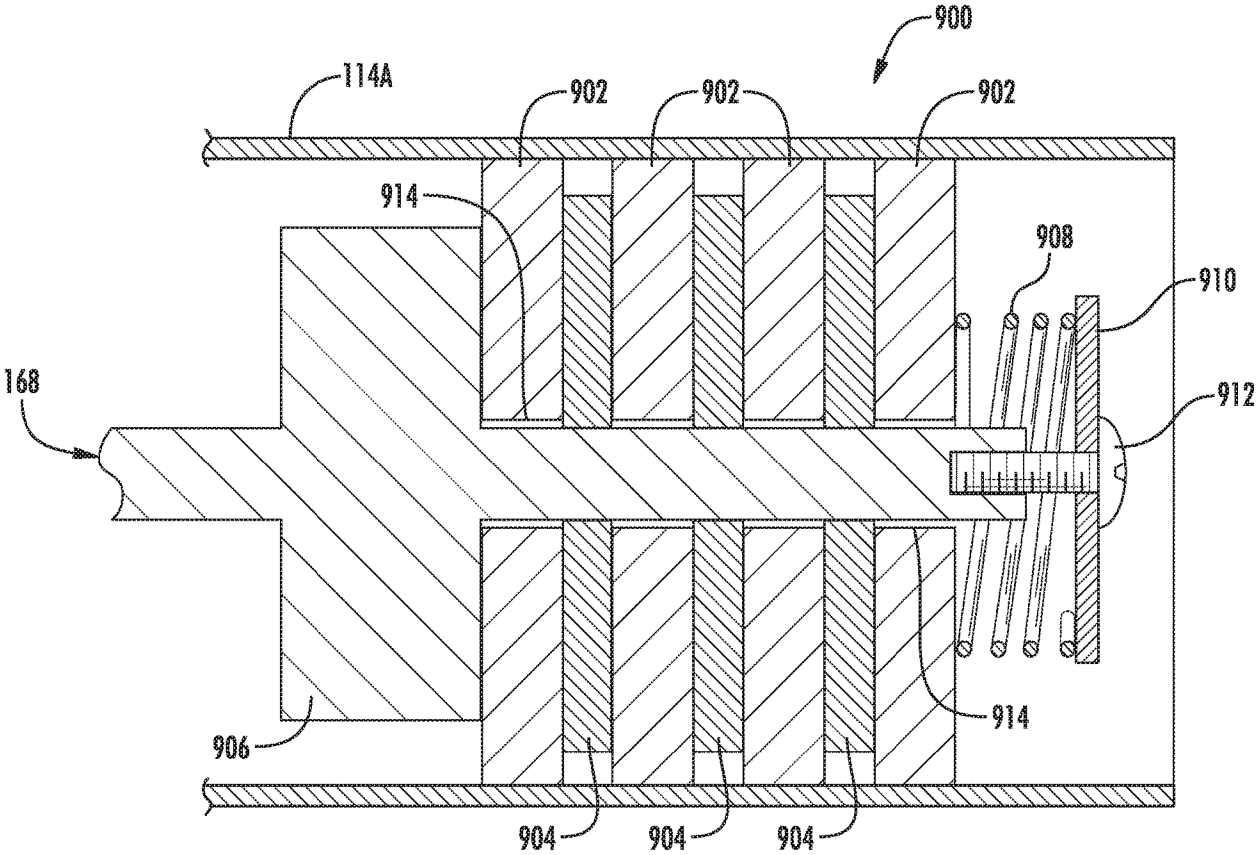
FIG. 20 illustrates a cross-sectional view of another illustrative embodiment of a clutch suitable for use within the disclosed shutter assembly in accordance with aspects of the present subject matter.

Referring now to FIG. 20, a cross-sectional view of another illustrative embodiment of a clutch 900 that may be utilized within the disclosed shutter assembly 100 is illustrated in accordance with aspects of the present subject matter. It should be appreciated that the clutch 900 shown in FIG. 20 may, in one embodiment, be utilized as one or more of the clutches 190 described above with reference to FIGS. 4-7. For purposes of description, the clutch 900 will be described as being installed within the driven louver 114A of the first upper panel section 136A of the shutter assembly 100 described above with reference to FIG. 4. However, it should be appreciated that, in general, the clutch 900 may be installed within any suitable driven louver of the disclosed shutter assembly 100.

As shown, the clutch 900 may include a plurality of friction pads 902 and corresponding friction disks 904 configured to be installed onto a portion of the louver drive shaft 168 extending within the driven louver 114A of the first upper panel section 136A. The clutch 900 may generally extend lengthwise along the louver drive shaft 168 between a clutch flange 906 coupled to or formed integrally with the drive shaft 168 and a spring 908 retained relative to the end of the louver drive shaft 168 via a washer 910 and corresponding screw 912. As shown in FIG. 20, the friction pads 902 and friction disks 904 may be provided in an alternating arrangement along the portion of the louver drive shaft 168 extending between the clutch flange 906 and the spring 908.

In general, the friction pads 902 may be configured to be installed within the driven louver 114A such that the pads 902 engage the driven louver 114A along its outer perimeter. For instance, the dimensions of the friction pads 902 may be selected to ensure that the pads 902 rotationally engage the driven louver 114A, thereby allowing such components to rotate together as the rotational orientation of the louver 114A is being adjusted. In addition, each friction pad 902 may be configured to define a central opening 914 through which the louver drive shaft 168 extends, with each openings 914 having a diameter that is larger than the diameter of the louver drive shaft 168. As such, the frictions pads 902 may be allowed to rotate relative to the louver drive shaft 168.

In contrast to the friction pads 902, the friction disks 904 may be rotationally engaged with the louver drive shaft 168 while being allowed to rotate relative to the driven louver 114A. For instance, in one embodiment, a keyed connection may be defined between the louver drive shaft 168 and the friction disks 902, such as by including a groove or spline along the louver drive shaft 168 that is configured to engage a corresponding feature of the friction disks 902. In another embodiment, the louver drive shaft 168 and the corresponding opening defined through each friction disk 904 may be configured to have complementary shapes (e.g., a hexagonal shape). Alternatively, the friction disks 904 may be rotatably coupled to the louver drive shaft 168 in any other suitable manner.

When adjusting the rotational orientation of the driven louver 114A, the frictional interface defined between each pair of adjacent friction pads/disks 902, 904 may serve to maintain the louver drive shaft 168 rotationally engaged with the driven louver 114A as the motor 156 is being used to rotate the louver 114A. However, when manually adjusting the driven louver 114A, the friction pads 902 may be configured to slip relative to the friction disks 904, thereby allowing the driven louver 114A to rotate relative to the louver drive shaft 168.

It should be appreciated that the amount of friction provided at the frictional interface defined between each pair of adjacent friction pads/disks 902, 904 may be adjusted by tightening and loosening the screw 912 positioned at the end of the louver drive shaft 168. For example, by tightening the screw 912, the spring 908 may be further compressed between the clutch 900 and the washer 910, thereby increasing the compressive force applied by the spring 908 and, thus, increasing the amount of friction between the friction pads/disks 902, 904. Similarly, by loosening the screw 912, the spring 908 may expand between the clutch 900 and the washer 910, thereby reducing the compressive force applied by the spring 908 and, thus, decreasing the amount of friction between the friction pads/disks 902, 904.

It should be appreciated that, in one embodiment, the various clutches 600, 700, 800, 900 shown in FIGS. 17-20 may be configured to be installed within each driven louver at the end of the louver positioned opposite the end at which the louver drive shaft extends into the driven louver from the gearbox. For instance, in the embodiment shown in FIG. 4, each of the clutches 600, 700, 800, 900 may be configured to be installed adjacent to the panel-side ends 142 of the driven louvers 168, 174 of the first upper and lower panel sections 136A, 138A and adjacent to the frame-side ends 140 of the driven louvers 170, 176 of the second upper lower panel sections 136B, 138B. In such an embodiment, the louver drive shafts 168, 170, 174, 176 for such driven louvers 114A, 114B, 114C, 114D may be configured to extend lengthwise from one end of each driven louver to the other to allow the drive shafts to be received within each clutch 600, 700, 800, 900.

Figure 21:
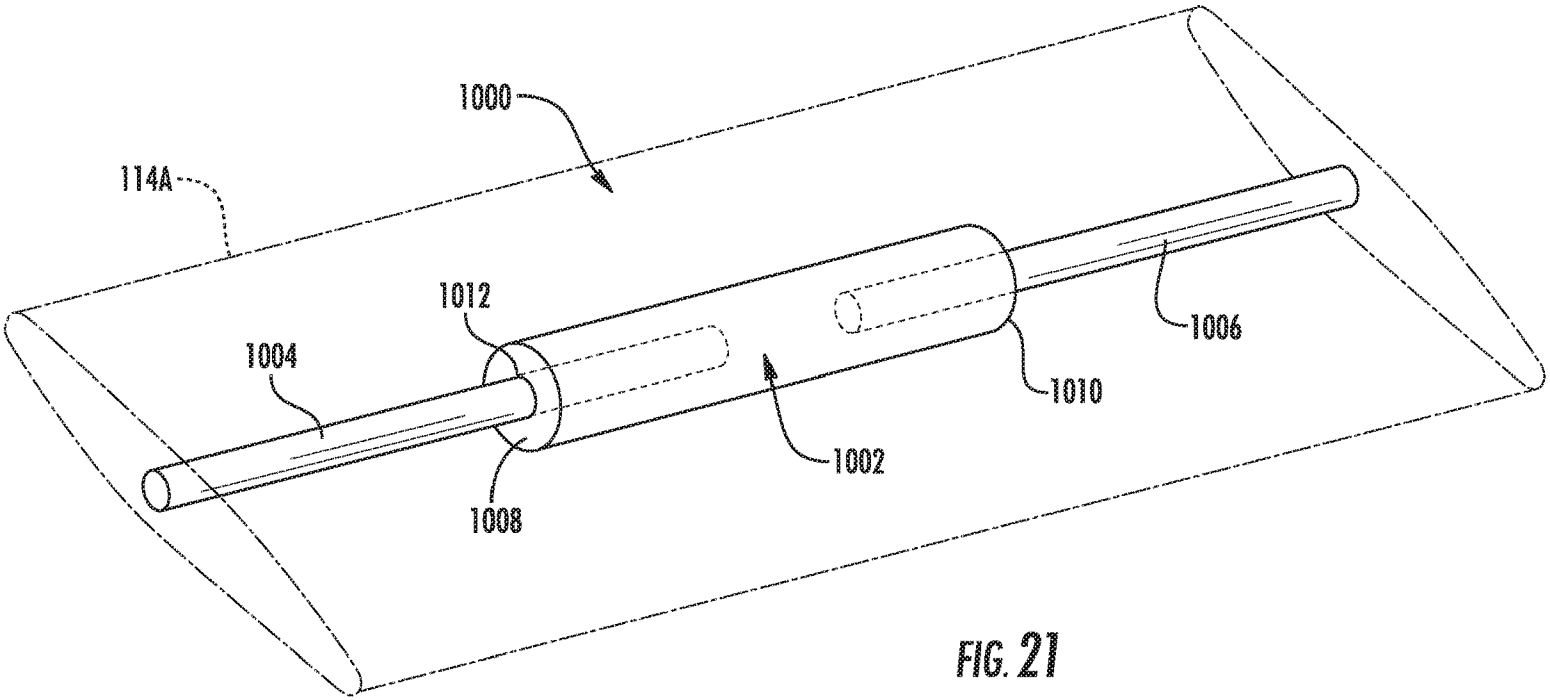
FIG. 21 illustrates a perspective view of a further illustrative embodiment of a clutch suitable for use within the disclosed shutter assembly in accordance with aspects of the present subject matter.

Referring now to FIG. 21, a cross-sectional view of a further illustrative embodiment of a clutch 1000 that may be utilized within the disclosed shutter assembly 100 is illustrated in accordance with aspects of the present subject matter. It should be appreciated that the clutch 1000 shown in FIG. 21 may, in one embodiment, be utilized as one or more of the clutches 190 described above with reference to FIGS. 4-7. For purposes of description, the clutch 1000 will be described as being installed within the driven louver 114A of the first upper panel section 136A of the shutter assembly 100 described above with reference to FIG. 4. However, it should be appreciated that, in general, the clutch 1000 may be installed within any suitable driven louver of the disclosed shutter assembly 100.

As shown, the clutch 1000 may include an in-line sleeve member 1002 configured to be installed at the location of adjacent ends of two separate shaft sections 1004, 1006 (e.g., first and second shaft sections 1004, 1006 forming the louver drive shaft 168 extending within the interior of the driven louver 114A of the first upper panel section 136A). Specifically, in one embodiment, the sleeve member 1002 may be configured to extend lengthwise between a first end 1008 and a second end 1010, with a shaft opening 1012 being defined through the sleeve member 1002 between its first and second ends 1008, 1010. In such an embodiment, the ends of the adjacent shaft sections 1004, 1006 may be configured to be inserted into the shaft opening 1012 at the opposed ends 1008, 1010 of the sleeve member 1002 so that a portion of each shaft section 1004, 1006 is received within the sleeve member 1002.

In several embodiments, the sleeve member 1002 may be formed from a deformable, friction material (e.g., nylon or any other suitable material) that allows the sleeve member 1002 to be fit tightly around the shaft sections 1004, 1006 to provide a frictional interface between the clutch 1000 and each shaft section 1004, 1006. For instance, the diameter of the shaft opening 1012 may be smaller than the diameters of the shaft sections 1004, 1006 so that the sleeve member 1002 grips each shaft section 1004, 1006 tightly around the frictional interface. As such, when the motor 156 of the shutter assembly 100 is being used to rotationally drive one of the shaft sections (e.g., the first shaft section 1004), the friction provided between the sleeve member 1002 and each shaft section 1004, 1006 may allow for rotational motion to be transferred through the clutch 1000 to the other shaft section (e.g., the second louver drive shaft 1006). However, when the associated driven louver 114A is being manually adjusted, the shaft section coupled to the louver 114A (e.g., the second shaft section 1006) may be configured to slip relative to the sleeve member 1002, thereby allowing the louver 114A to be rotated relative to the other shaft section (e.g., the first shaft section 1004).

It should be appreciated that, although the clutch 1000 is shown in FIG. 21 as being positioned within the interior of a driven louver, the clutch 1000 may generally be positioned at any suitable location along the drive train defined between the motor 156 and each driven louver 114A, 114B, 114C, 114D of the disclosed shutter assembly 100. For example, in another embodiment, the clutch 1000 may be installed between ends of adjacent shaft sections forming all or a portion of the motor drive shaft 158 of the shutter assembly 100.

Figure 22:
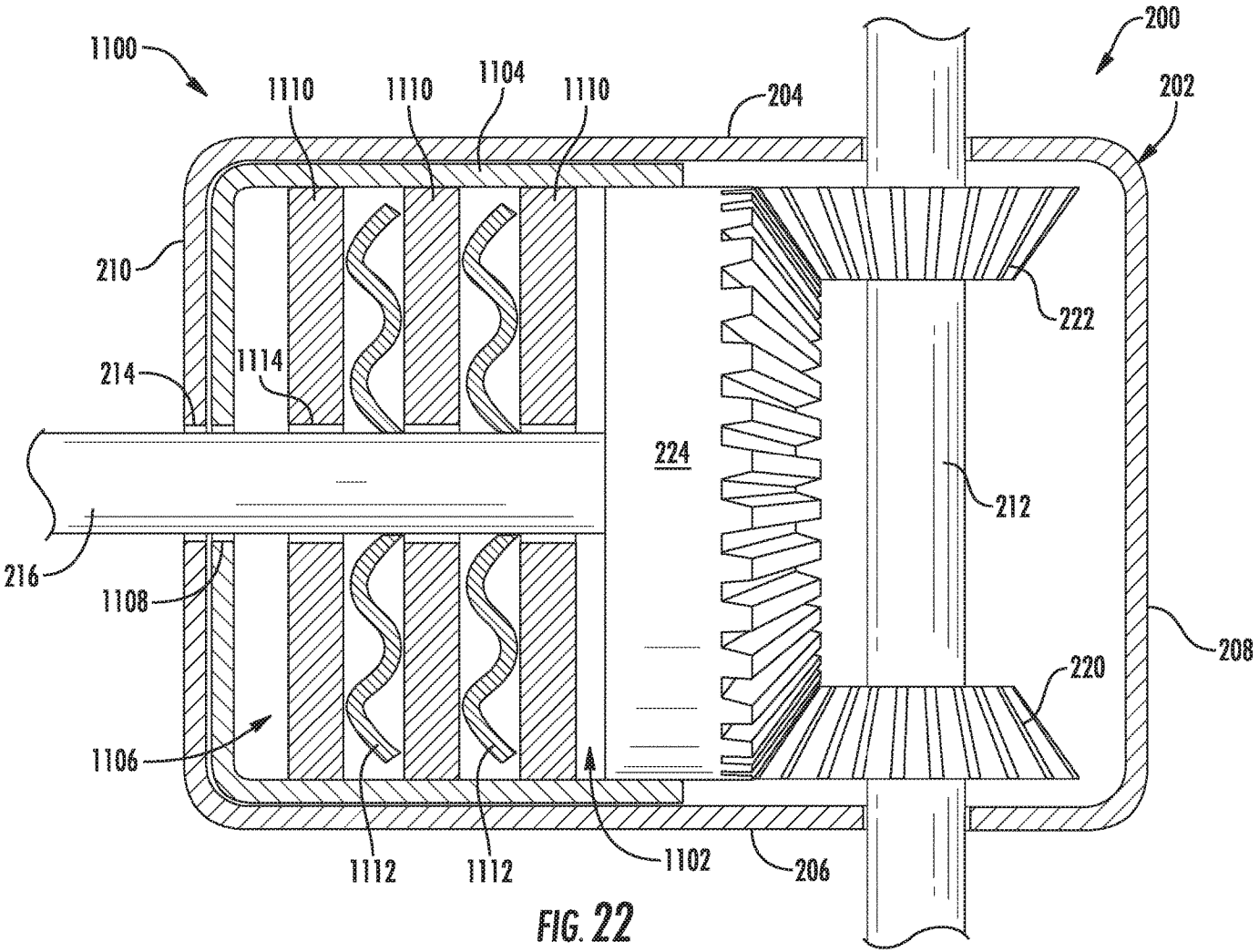
FIG. 22 illustrates a cross-sectional view of one illustrative embodiment of a gearbox including a clutch associated therewith in accordance with aspects of the present subject matter.

Referring now to FIG. 22, a cross-sectional view of another illustrative embodiment of a clutch 1100 that may be utilized within the disclosed shutter assembly 100 is illustrated in accordance with aspects of the present subject matter. As shown, unlike the clutch embodiments described above, the illustrated clutch 1110 is configured to be integrated within or coupled to one of the gearboxes of the shutter assembly 100. For instance, for purposes of description, the clutch 1100 will be described as being integrated into the gearbox 200 described above with reference to FIGS. 8 and 9. As such, the same reference numbers will be used in FIG. 22 to identify the same or similar components of the gearbox 200 shown in FIGS. 8 and 9. However, it should be appreciated that, in other embodiments, the clutch 1100 may be installed within any other gearbox having any other suitable gearbox configuration.

As shown in FIG. 22, the dimensions of the gearbox housing 302 may be selected or adjusted, as necessary, to allow the clutch 1100 to be installed within its interior. For instance, as compared to the gearbox 200 described above with reference to FIGS. 8 and 9, the sidewalls of the housing 202 have been elongated so that the inner face 210 of the housing 202 is spaced further apart from the louver drive gear 224, thereby defining a cavity 1102 between the inner face 210 and the louver drive gear 224 in which the clutch 1110 may be installed.

As shown, the clutch 1100 may include a clutch shroud 1104 rotationally coupled to the louver gear drive 224 such that the shroud 1104 rotates with the louver drive gear 224 when such gear 224 is being driven via the drive shaft 212 and associated shaft gear(s) 220, 222. The clutch shroud 1104 may generally be configured to extend outwardly from the louver drive gear 224 towards the inner face 210 of the housing 202 so as to enclose a friction assembly 1106 of the clutch 1100. Additionally, as shown in FIG. 22, the clutch shroud 1104 may define a shaft opening 1108 configured to be aligned with the shaft opening 214 defined through the inner face 210 of the housing 202 to allow the louver shaft 216 to be received within the shroud 1104 and extend through the friction assembly 1106.

As shown in FIG. 22, the friction assembly 1106 of the clutch 1100 may generally include a plurality of friction pads 1110 and spring washers 1112 provided in an alternating arrangement along the portion of the louver shaft 216 extending with the clutch shroud 1104. In general, the friction pads 1110 may be configured to be installed with the clutch shroud 1106 such that the pads 1110 engage the shroud 1104 along its outer perimeter. For instance, the dimensions of the friction pads 1110 may be selected to ensure that the pads 1110 rotationally engage the clutch shroud 1104, thereby allowing such components to rotate with each other. In addition, each friction pad 1110 may be configured to define a central opening 1114 through which the louver shaft 216 extends, with each opening 1114 having a diameter that is larger than the diameter of the louver shaft 216. As such, the frictions pads 1110 may be allowed to rotate relative to the louver shaft 216.

In contrast, the spring washers 1112 may be rotationally engaged with the louver shaft 216 while being allowed to rotate relative to the clutch shroud 1104. For instance, in one embodiment, a keyed connection may be defined between the louver shaft 216 and each spring washer 1112, such as by including a groove or spline along the louver shaft 216 that is configured to engage a corresponding feature of each spring washer 1112. Alternatively, the louver shaft 216 and the corresponding openings defined through the spring washers 1112 may be configured to define complementary shapes (e.g., a hexagonal shape).

Unlike the embodiment of the gearbox 200 described above with reference to FIGS. 8 and 9 in which rotation of the louver drive gear 224 is directly transferred to the louver shaft 216, the louver drive gear 224 is not directly rotationally coupled to the louver shaft 216 within the embodiment of the gearbox 200 shown in FIG. 22. Rather, rotation of the louver drive gear 224 may be transferred through the clutch shroud 1104 and corresponding friction assembly 1106 to the louver shaft 216. Thus, when the motor 156 of the shutter assembly 100 is being used to rotationally drive the louver drive gear 224 (e.g., via the drive shaft 212 and shaft gear(s) 220, 222), rotation of the clutch shroud 1104 may be transferred to the louver shaft 216 via the frictional interface defined between each pair of adjacent friction pads/washers 1110, 1112. However, when the louver shaft 216 is being rotated separately (e.g., during manual adjustment of a corresponding driven louver), the spring washers 1112 may slip relative to the friction pads 1110 at each frictional interface, thereby allowing the louver shaft 216 to be rotated relative to both the clutch shroud 1104 and louver drive gear 224.

Figure 23:
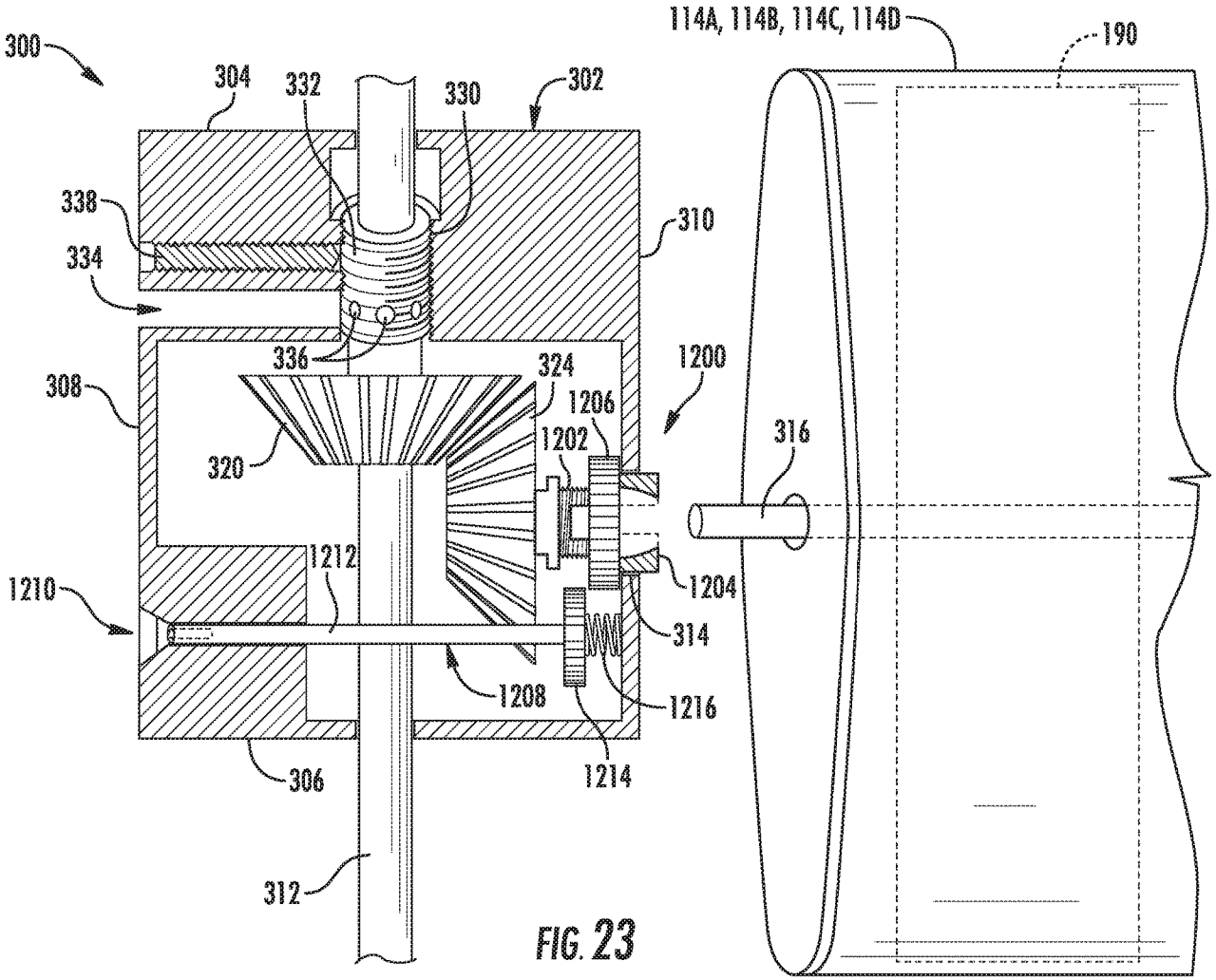
FIG. 23 illustrates a cross-sectional view of another illustrative embodiment of a gearbox including a clutch associated therewith in accordance with aspects of the present subject matter.

Referring now to FIG. 23, a cross-sectional view of another illustrative embodiment of a clutch 1200 that may be utilized within the disclosed shutter assembly 100 is illustrated in accordance with aspects of the present subject matter. As shown, similar to the embodiment described above with reference to FIG. 22, the illustrated clutch 1200 is configured to be integrated within or coupled to one of the gearboxes of the shutter assembly. For instance, for purposes of description, the clutch 1200 will be described as being integrated into the gearbox 300 described above with reference to FIG. 10. As such, the same reference numbers will be used in FIG. 23 to identify the same or similar components of the gearbox 300 shown in FIG. 10, such as the gear alignment features that may be used to synchronize louver movement across two or more adjacent shutter panels. However, it should be appreciated that, in other embodiments, the clutch 1200 may be installed within any other gearbox having any other suitable gearbox configuration.

As shown, the clutch 1200 may include a threaded portion 1202 coupled to the louver drive gear 324 and a gripper portion 1204 that is configured to receive a portion of the louver shaft 316 (or louver peg) extending outwardly from one of the driven louvers 114A, 114B, 114C, 114D of the disclosed shutter assembly 100. In general, the gripper portion 1204 may have any suitable configuration that allows it to fit tightly around the louver shaft 316 to provide a frictional interface between the clutch 1200 and the louver shaft 316, thereby allowing the gripper portion 1204 to rotationally engage the louver shaft 316 when the motor 156 of the shutter assembly 100 is being used to rotationally drive the louver drive gear 324. In addition, the gripper portion 1204 may also be configured to allow the louver shaft 316 to slip relative to the gripper portion 1204 when the corresponding driven louver is being manually adjusted.

In one embodiment, the gripper portion 1204 may be configured similar to the sleeve members 502, 602, 702, 1002 described above. For instance, the gripper portion 1204 may be formed from a deformable, friction material (e.g., nylon or any other suitable material) that allows the gripper portion 1204 to grip tightly around the louver shaft 316. Alternatively, the gripper portion 1204 may have any other suitable configuration that allows it to function as described herein.

Additionally, in several embodiments, the gearbox/clutch 300, 1200 may incorporate one or more components or features for adjusting the amount of friction provided at the frictional interface defined between the sleeve member 1204 and the louver shaft 316. For example, as shown in FIG. 23, in one embodiment, a clutch nut 1206 may be installed onto the threaded portion 1202 of the clutch 1200 that is configured to engage the gripper portion 1204. In such an embodiment, the positioning of the clutch nut 1206 along the threaded portion 1202 may be adjusted by accessing a clutch adjuster 1208 via an access port 1210 defined through the outer face 308 of the gearbox housing 302.

As shown in FIG. 23, the clutch adjuster 1208 may include an adjuster shaft 1212 extending from the access port 1210 to an adjuster gear 1214 configured to engage corresponding gear teeth defined around the outer circumference of the clutch nut 1206. Additionally, a spring 1216 may be positioned between the inner face 310 of the housing 302 and the clutch adjuster 1208 to bias the adjuster gear 1214 away from the clutch nut 1206. Thus, in its normal position, the adjuster gear 1214 may be spaced apart from the clutch nut 1206 (e.g., as shown in FIG. 23). However, by pushing the adjuster shaft 1212 inwardly relative to the housing 302 against the biasing force of the spring 1216 (e.g., using a tool inserted through the access port 1210), the adjuster gear 1214 may be moved into engagement with the clutch nut 1206. Thereafter, rotation of the clutch adjuster 1208 (e.g., utilizing the same tool used to initially depress the adjuster 1208) may, in turn, be transferred to the clutch nut 1206 to allow the nut 1206 to be translated along the threaded portion 1202 of the clutch 1200 towards or away from the gripper portion 1204. Such translation of the clutch nut 1206 may allow for the gripper portion 1204 to be tightened around or loosened relative to the louver shaft 316 (e.g., depending on the direction of translation) to adjust the amount of friction provided between the gripper portion 1204 and the louver shaft 316.

Figure 24:
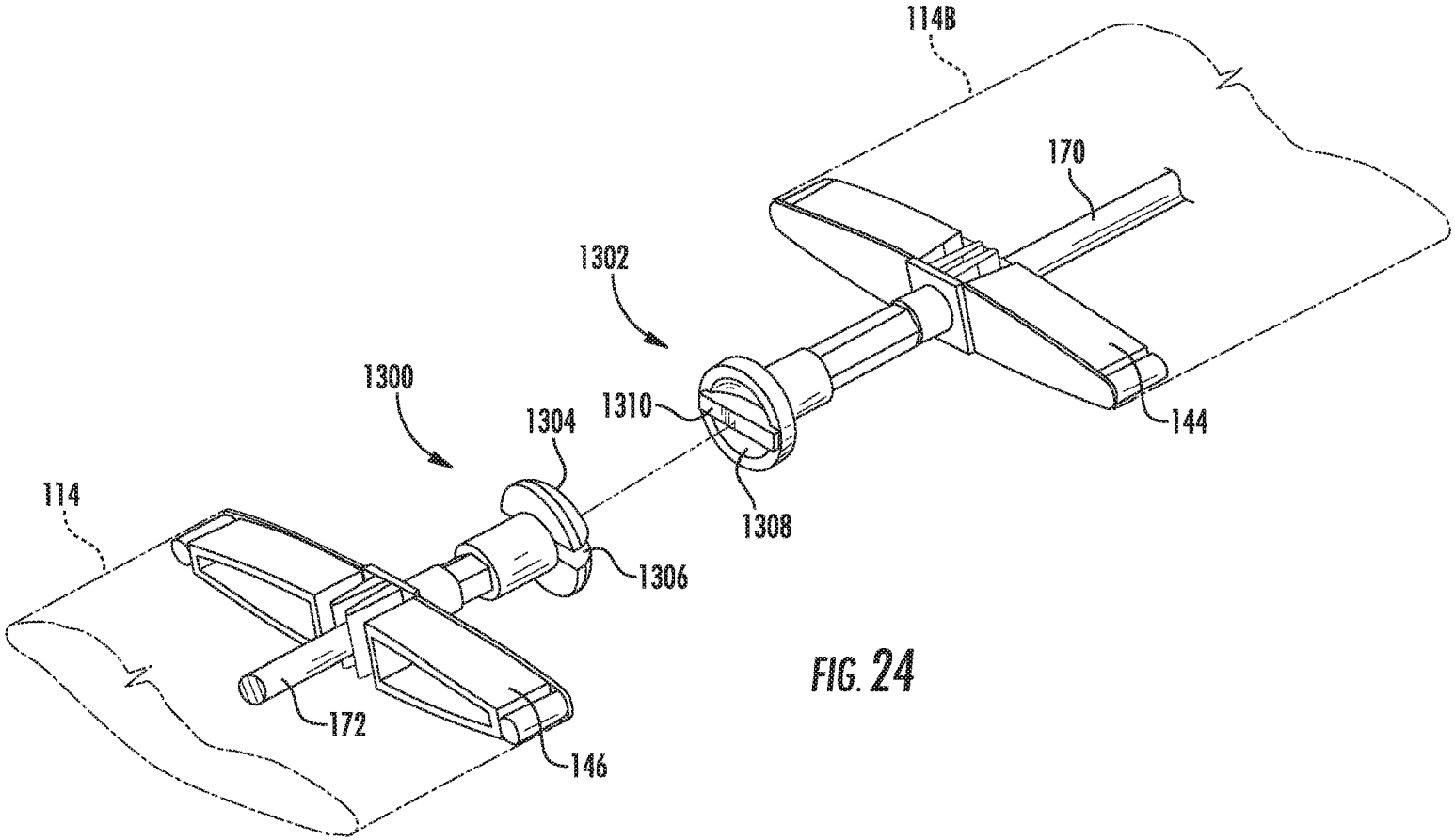
FIG. 24 illustrates a perspective view of louvers of adjacent shutter panels of the disclosed shutter assembly in accordance with aspects of the present subject matter, particularly illustrating one embodiment of coupling members configured to rotationally couple the louvers to one another at an interface defined between the adjacent shutter panels.
Figure 25:
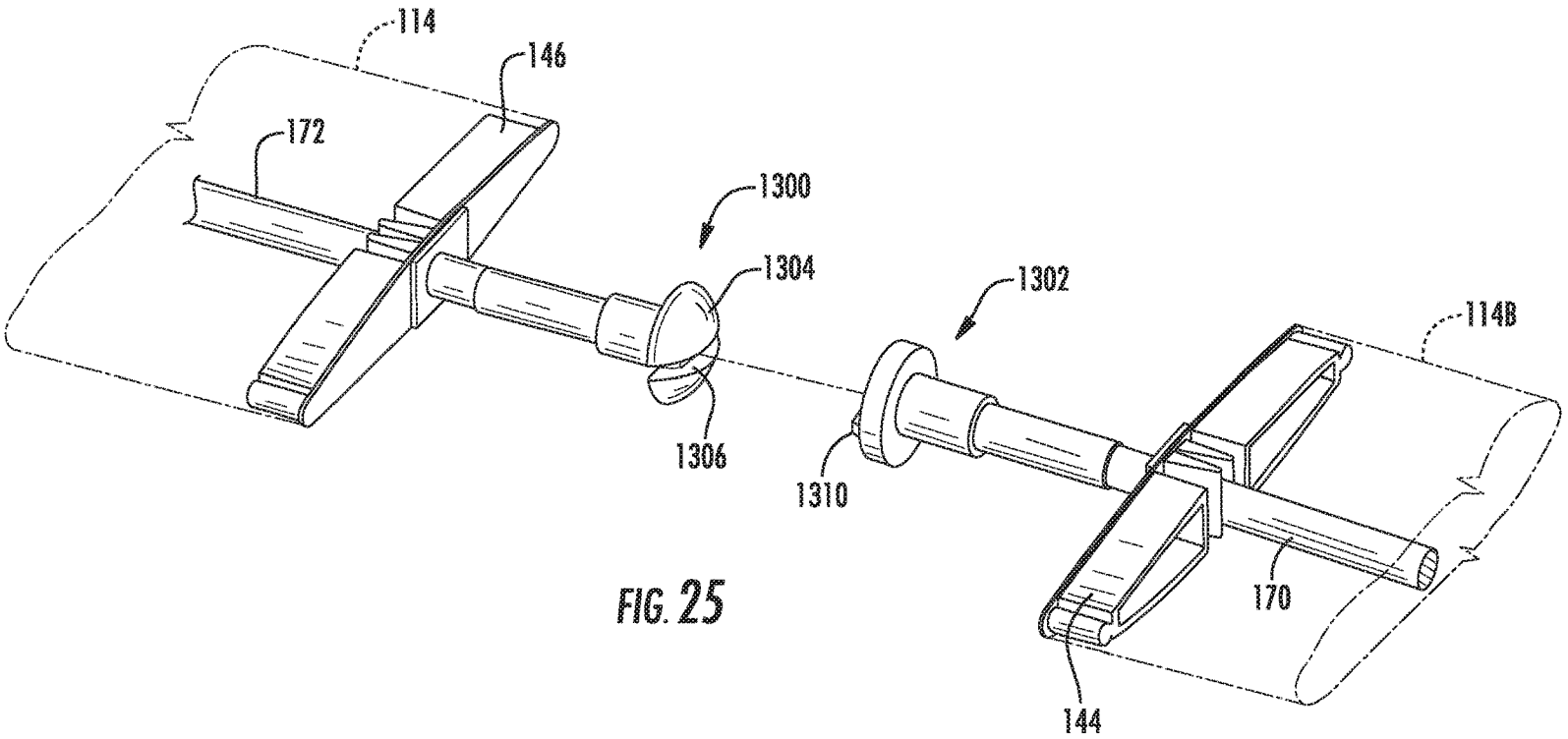
FIG. 25 illustrates another perspective view of the louvers and coupling members shown in FIG. 24.

Referring now to FIGS. 24 and 25, perspective views of one illustrative embodiment of coupling members 1300, 1302 that may be utilized within the disclosed shutter assembly 100 are illustrated in accordance with aspects of the present subject matter. It should be appreciated that the coupling members 1300, 1302 shown in FIGS. 24 and 25 may, in one embodiment, be utilized as any of the pairs of coupling members described above, such as the coupling members 180A, 180B, 182A, 182B described above with reference to FIGS. 3-7.

As indicated above, the disclosed shutter assembly 100 may include one or more pairs of coupling members configured to be coupled to adjacent ends of corresponding louver shafts at the panel-to-panel interface 110 defined between adjacent shutter panels 104A, 104B. For purposes of description, the coupling members 1300, 1302 of FIGS. 24 and 25 will be described as being installed between the upper pass-through louver shaft 172 and the second louver drive shaft 170 of the first and second upper panel sections 136A, 136B of the shutter assembly 100 described above with reference to FIG. 4. However, it should be appreciated that, in general, the coupling members 1300, 1302 shown in FIGS. 24 and 25 may be installed at any suitable location within the disclosed shutter assembly 100 to allow the adjacent ends of two shafts to be coupled to each other.

As shown in FIGS. 24 and 25, a first coupling member 1300 may be coupled to the end of the upper pass-through louver shaft 172 extending outwardly from a corresponding louver 114 of the first upper panel section 136A while a second coupling member 1302 may be coupled to the end of the second louver drive shaft 170 extending outwardly from the driven louver 114B of the second upper panel section 136B. In general, the coupling members 1300, 1302 may be configured to rotationally engage each other to allow rotational motion to be transferred from the pass-through louver shaft 172 to the second louver drive shaft 170 (and vice versa). In several embodiments, a male/female-type coupling joint may be defined between the first and second coupling members 1300, 1302. For instance, as particularly shown in FIG. 25, the first coupling member 1300 may include both a semi-circular, outwardly curved end face 1304 and a lateral slot 1306 extending across the end face 1304. Additionally, as particularly shown in FIG. 24, the second coupling member 1302 may include both a semi-circular, inwardly curved or recessed end face 1308 and a lateral tab 1310 extending outwardly from the recessed end face 1308. In such an embodiment, when the coupling members 1300, 1302 are positioned end-to-end, the outwardly curved end face 1304 of the first coupling member 1300 may be received within the recessed end face 1308 of the second coupling member 1302 while the lateral tab 1310 of the second coupling member 1302 may be received within the lateral slot 1306 of the first coupling member 1300, thereby allowing the coupling members 1300, 1302 to rotationally engage each other.

It should be appreciated that coupling members 1300, 1302 may be configured to be positioned end-to-end when the associated shutter panels 104A, 104B are moved to the closed position (e.g., as shown in FIG. 4) so that the shutter frames 112A, 112B of the panels 104A, 104B are positioned adjacent to each other along the panel-to-panel interface 110. In the event that the coupling members 1302, 1304 are not properly aligned when the shutter panels 104A, 104B are moved to the closed position (e.g., the lateral tab 1310 of the second coupling member 1302 is not aligned with the lateral slot 1306 of the first coupling member 1300), subsequent rotation of one of the shafts 172, 170 (e.g. by the motor 156 or manually) may result in the coupling members 1300, 1302 becoming aligned. For example, with the motor 156 of the shutter assembly 100 being coupled to the upper pass-through louver shaft 172, the motor 156 may rotate the pass-through louver shaft 172 relative to the second louver drive shaft 170 until the first coupling member 1300 is properly aligned with the second coupling member 1302, at which point the coupling members 1300, 1302 may rotationally engage to allow the rotation of the pass-through louver shaft 172 to be transferred to the second louver drive shaft 170.

It should also be appreciated that the coupling members 1300, 1302 may have any other suitable configuration that allows for the coupling members 1300, 1302 to rotationally engage each other at the ends of adjacent shafts. For instance, as will be described below with reference to FIGS. 28 and 29, embodiments of the disclosed coupling members may include spring-loaded features to facilitate engaging the coupling members with each other.

Figure 26:
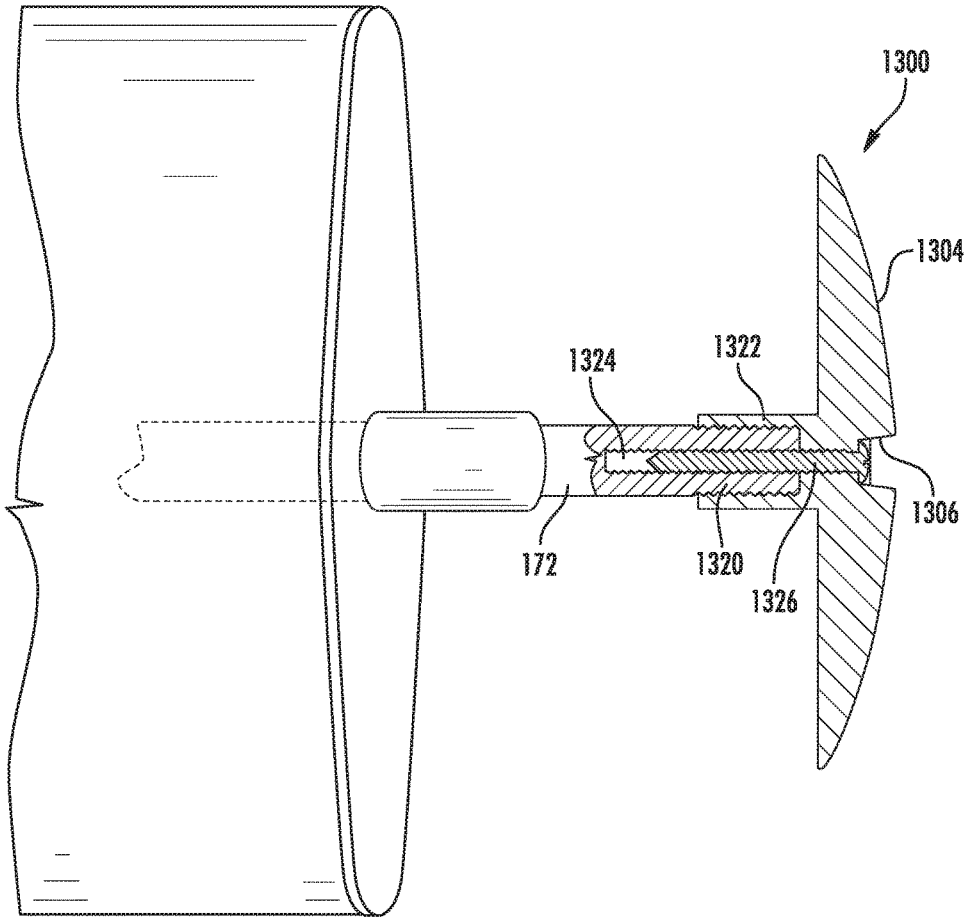
FIG. 26 illustrates a partial, cross-sectional view of one of the coupling members shown in FIGS. 24 and 25, particularly illustrating one illustrative embodiment of features for adjusting the depth of the coupling member relative to the other coupling members and/or relative to the end of the adjacent shaft in accordance with aspects of the present subject matter.

Referring now to FIG. 26, a simplified view of one embodiment of an attachment configuration for allowing the depth or position of the coupling members 1300, 1302 described above with reference to FIGS. 24 and 25 to be adjusted relative to the ends of the adjacent shafts is illustrated in accordance with aspects of the present subject matter. For purposes of description, the attachment configuration will be described below with reference to the first coupling member 1300 shown in FIGS. 24 and 25. However, it should be appreciated that the same or a similar attachment configuration may also be utilized for the second coupling member 1302 to allow its position to be adjusted relative to the end of its corresponding louver shaft. It should also be appreciated that both the coupling member 1300 and a portion of the associated louver shaft have been shown in cross-section in FIG. 26 to illustrate the interface between the coupling member and the louver shaft.

As shown, the end of the louver shaft to which the coupling member 1302 is attached (e.g., louver shaft 172) may include a threaded outer portion 1320 configured to engage a corresponding threaded sleeve or spline 1322 of the coupling member 1300. In addition, a threaded opening 1324 may be defined through the end of the louver shaft 172 that is configured to receive a screw 1326 extending through the coupling member 1300. For instance, the screw 1326 may be accessible via an opening (not shown) defined through the end face 1304 of the coupling member 1300, such as by configuring the opening to extend to the bottom of the lateral slot 1306 of coupling member 1300. In such an embodiment, by loosening the screw 1326, the coupling member 1300 may be rotated relative to the louver shaft 172 to move the spline 1322 along the threaded portion 1320 towards or away from the end of the shaft 172, thereby allowing the depth of the coupling member 1300 to be adjusted. Accordingly, by adjusting the depth of one or both of the coupling members 1300, 1302, it can be ensured that the coupling members 1300, 1302 engage each other when the associated shutter panels are moved to the closed position. It should be appreciated that the screw 1326 may be tightened to lock the coupling member 1300 in place once the desired depth is achieved.

It should also be appreciated that, although the coupling members 1300, 1302 have been described above as being directly coupled to the ends of their corresponding louver shafts, the coupling members 1300, 1302 may, instead, be indirectly coupled to the louver shafts. For instance, in one embodiment, each louver shaft may be coupled to a louver peg at the adjacent end cap of the corresponding louver, with the louver peg, in turn, being coupled to the associated coupling member 1300, 1302. In such an embodiment, the threaded portion 1320 and the threaded opening 1324 shown in FIG. 26 may, for example, be defined by the louver peg as opposed to the louver shaft 172.

Figure 27:
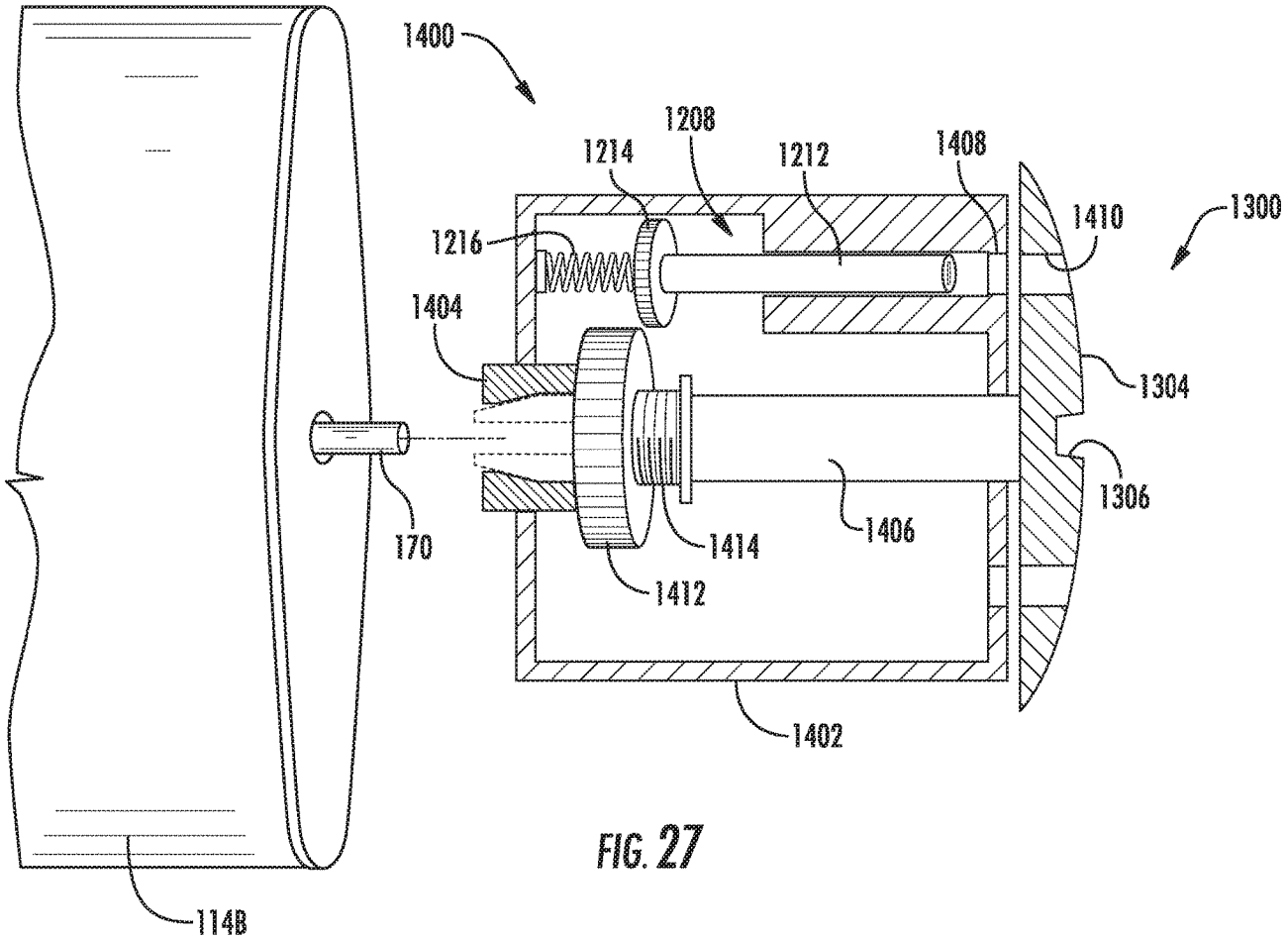
FIG. 27 illustrates a cross-sectional view of one of the coupling members shown in FIGS. 24 and 25, particularly illustrating one illustrative embodiment of a clutch that may be provided in operative association with the coupling member in accordance with aspects of the present subject matter.

Referring now to FIG. 27, a simplified view of yet another illustrative embodiment of a clutch 1400 that may be utilized within the disclosed shutter assembly 100 is illustrated in accordance with aspects of the present subject matter, particularly illustrating the adjustable clutch configuration shown in FIG. 23 being provided in operative association with one of the coupling members 1300, 1302 described above with reference to FIGS. 24 and 25. For purposes of description, the clutch 1400 will be described below with reference to the first coupling member 1300 shown in FIGS. 24 and 25. However, it should be appreciated that the same or a similar configuration may also be utilized with the second coupling member 1302 to provide a clutching mechanism at or adjacent to such coupling member 1302.

As shown, the clutch 1400 may include a clutch housing 1402 configured to be mounted within or coupled to an adjacent shutter frame 112A, 112B of the disclosed shutter assembly 100, such as by mounting the housing 1402 within one of the panel-side stiles 118, 128 of shutter assembly 100. In general, the clutch housing 1402 may be configured to at least partially encase the various internal components of the clutch 1400. For example, as shown in FIG. 27, the clutch 1400 may include a gripper portion 1404 that is configured to receive a portion of the louver shaft (or louver peg) to which the coupling member 1300 is being secured (e.g., louver shaft 170) and a clutch shaft 1406 extending through the clutch housing 1402 from the gripper portion 1404 to the associated coupling member 1300. In addition, the clutch 1400 may include a clutch nut 1412 positioned on a threaded portion 1414 of the clutch shaft 1406 extending adjacent to the gripper portion 1404.

In general, the gripper portion 1404 may be configured the same as or similar to the gripper portion 1204 described above. For example, the gripper portion 1404 may be configured to fit tightly around the louver shaft 170 to provide a frictional interface between the clutch 1400 and the louver shaft 170, thereby allowing the gripper portion 1404 to rotationally engage the shaft 170 when the motor 156 of the shutter assembly 100 is being used to drive the associated louver 114B. In addition, the louver shaft 170 may be allowed to slip relative to the gripper portion 1404 when the louver 114B is being manually adjusted.

It should be appreciated that the various components and/or features used to adjust the amount of friction provided at the frictional interface defined between the gripper portion 1404 and the louver shaft 170 may generally function the same as the components and/or features described above with reference to FIG. 23. Thus, the same reference numbers will be used in FIG. 27 to identify the same or similar components and/or features shown in FIG. 23. However, unlike the embodiment described above, the clutch adjuster 1208 may be accessed via aligned access ports 1408, 1410 defined through the clutch housing 1402 and the coupling member 1300, respectively. In such an embodiment, by inserting a tool through the aligned access ports 1408, 1410 to push the adjuster shaft 1212 inwardly relative to the housing 1402 and against the biasing force of the spring 1214, the adjuster gear 1214 may be moved into engagement with the clutch nut 1412. Thereafter, rotation of the clutch adjuster 1208 (e.g., utilizing the same tool used to initially depress the adjuster 1208) may, in turn, be transferred to the clutch nut 1412 to allow the nut 1412 to be translated along the threaded portion 1414 of the clutch shaft 1406 towards or away from the gripper portion 1404. Such translation of the clutch nut 1412 may allow for the gripper portion 1404 to be tightened around or loosened relative to the louver shaft 170 (e.g., depending on the direction of translation) to adjust the amount of friction provided between the gripper portion 1404 and the louver shaft 170.

Figure 28:
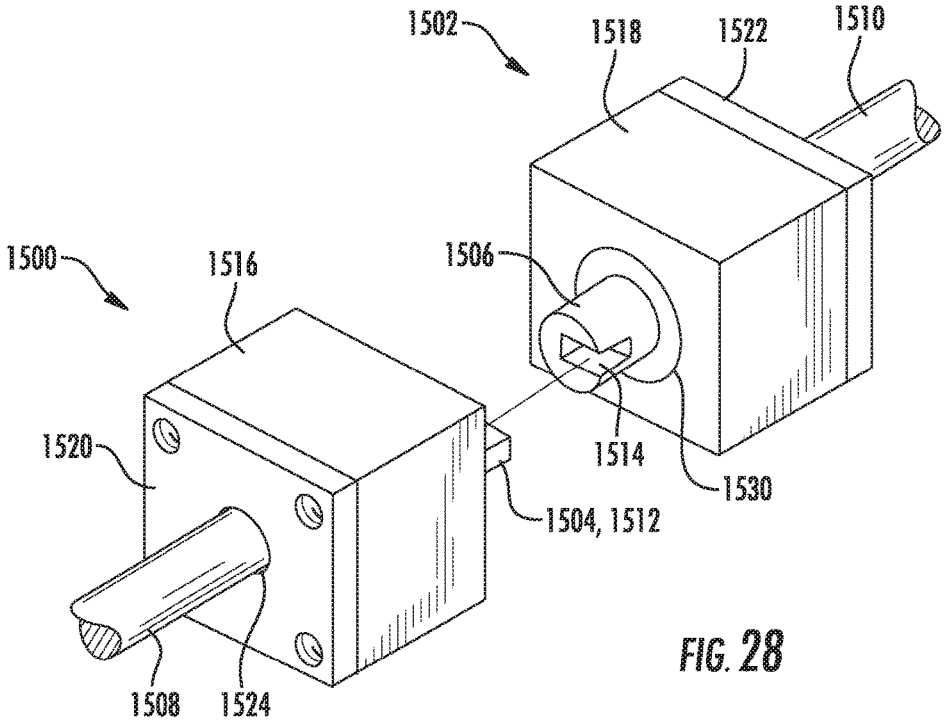
FIG. 28 illustrates a perspective view of one illustrative embodiment of coupling devices having coupling members associated therewith that are configured to rotationally couple the louvers of adjacent shutters panels to one another in accordance with aspects of the present subject matter.
Figure 29:
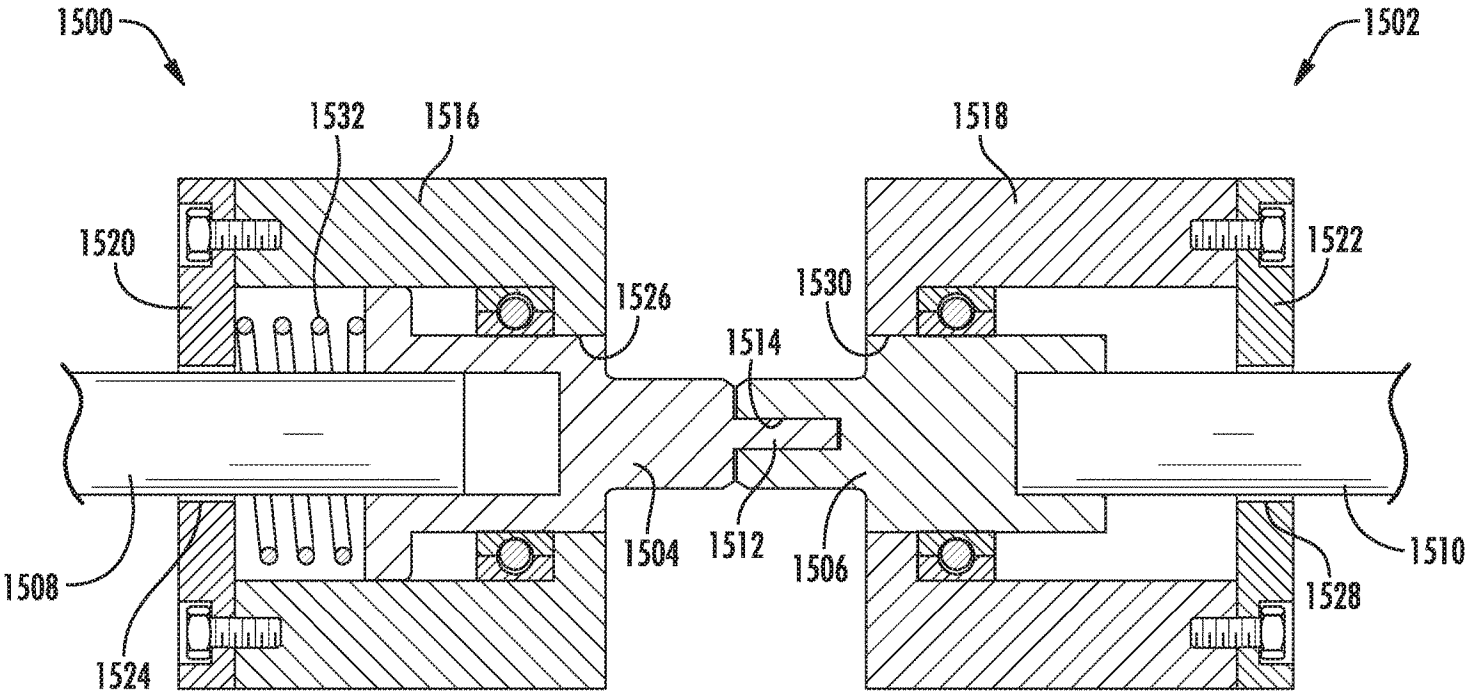
FIG. 29 illustrates a cross-sectional view of the coupling devices shown in FIG. 29 with the coupling members being engaged with each other.

Referring now to FIGS. 28 and 29, differing views of an illustrative embodiment of coupling devices 1500, 1502 incorporating corresponding coupling members 1504, 1506 that may be utilized within the disclosed shutter assembly 100 are illustrated in accordance with aspects of the present subject matter. Specifically, FIG. 28 illustrates a perspective view of the coupling devices 1500, 1502 exploded away from each other. Additionally, FIG. 29 illustrates a cross-sectional view of the coupling devices 1500, 1502 with their corresponding coupling members 1504, 1506 being rotationally engaged with each other. It should be appreciated that the coupling devices 1500, 1502 and associated coupling members 1504, 1506 shown in FIGS. 28 and 29 may, in one embodiment, be installed in place of any of the pairs of coupling members described above, such as the coupling members 180A, 180B, 182A, 182B described above with reference to FIGS. 3-7.

As shown in FIGS. 28 and 29, a first coupling device 1500 may include a first coupling member 1504 configured to be coupled to the end of a first louver shaft 1508 (e.g., one of the pass-through louver shafts 172, 178 shown in FIG. 4 or one of the louver drive shafts 168, 174 of the first panel 104A shown in FIGS. 6 and 7) while a second coupling device 1502 may include a second coupling member 1506 configured to be coupled to the end of a second louver shaft 1510 (e.g., one of the louver drive shafts 170, 176 of the second panel 104B shown in FIGS. 4, 6 and 7). In general, the coupling members 1504, 1506 of the coupling devices 1500, 1502 may be configured similar to the coupling members 1300, 1302 described above with reference to FIGS. 24 and 25. For instance, the coupling members 1504, 1506 may be configured to rotationally engage each other to allow rotational motion to be transferred from the first louver shaft 1508 to the second louver shaft 1510 (and vice versa). Additionally, a male/female-type coupling joint may be defined between the first and second coupling members 1504, 1506. For instance, as shown in the illustrated embodiment, the first coupling member 1504 may include an outwardly extending tab 1512 configured to be received within a corresponding slot 1514 defined in the second coupling member 1506. As such, when the tab 1512 is received with the slot 1514, the first coupling member 1504 may be rotationally engaged with the second coupling member 1506, thereby allowing rotational motion to be transferred between the first and second louver shafts 1508, 1510.

As shown in FIGS. 28 and 29, each coupling device 1500, 1502 may also include an outer housing or frame 1516, 1518 configured to rotationally support each coupling member 1504, 1506. For example, the first coupling device 1500 may include a first frame 1516 having a first backing plate 1520 coupled thereto (e.g., via screws) to enclose a volume within the device 1500 for at least partially receiving the first coupling member 1504 and the first louver shaft 1508. Similarly, the second coupling device 1502 may include a second frame 1518 having a second backing plate 1522 coupled thereto (e.g., via screws) to enclose a volume within the device 1502 for at least partially receiving the second coupling member 1506 and the second louver shaft 1510. Additionally, the coupling devices 1500, 1502 may define suitable openings for accommodating the louver shafts 1508, 1510 and associated coupling members 1504, 1506. For example, a first shaft opening 1524 may be defined through the first backing plate 1520 for receiving the first louver shaft 1508 while a first aperture 1526 may be defined through the opposed end of the first frame 1516 for receiving the first coupling member 1504. Similarly, a second shaft opening 1528 may be defined through the second backing plate 1522 for receiving the second louver shaft 1510 while a second aperture 1530 may be defined through the opposed end of the second frame 1518 for receiving the second coupling member 1506.

In several embodiments, one or both of the coupling members 1504, 1506 may be spring-loaded to allow the coupling devices 1500, 1502 to accommodate misalignment between the coupling members 1504, 1506 when the shutter panels 104A, 104B of the shutter assembly 100 are moved to the closed position. For instance, as shown in FIG. 29, the first coupling device includes a spring 1532 configured to be compressed between the first backing plate 1520 and the first coupling member 1504 such that the spring 1532 applies an outward biasing force against the first coupling member 1504. As such, in the event that the tab 1512 of the first coupling member 1504 is not aligned with the slot 1514 of the second coupling member 1506 when the coupling members 1504, 1506 are positioned end-to-end, the first coupling member 1504 may be pushed inwardly relative to the first frame 1516. Thereafter, the first coupling member 1504 may be rotated relative to the second coupling member 1502 (e.g., via the motor or manually) until the tab 1512 is aligned with the slot 1514, at which point the spring 1532 may force the first coupling member 1504 outwardly into engagement with the second coupling member 1506.

It should be appreciated that, in several embodiments, a keyed connection may be provided between the first louver shaft 1508 and the first coupling member 1504 to allow the first coupling member 1504 to slide axially relative to the louver shaft 1508 with compression/expansion of the spring 1532. For instance, the first louver shaft 1508 may include a groove or spline that is configured to engage a corresponding feature of the first coupling member 1504. Alternatively, the louver shaft 1508 and the corresponding shaft opening defined by the first coupling member 1504 may be configured to have complementary shapes (e.g., a hexagonal shape) that allow for such relative axial movement while still maintaining the rotational connection between the louver shaft 1508 and the coupling member 1504.

It also should be appreciated that, although the first coupling member 1504 is shown as being spring-loaded, the second coupling member 1506 may, instead, be spring-loaded relative to the second frame 1518. Alternatively, both the first coupling member 1504 and the second coupling member 1506 may be spring-loaded.

Figure 30:
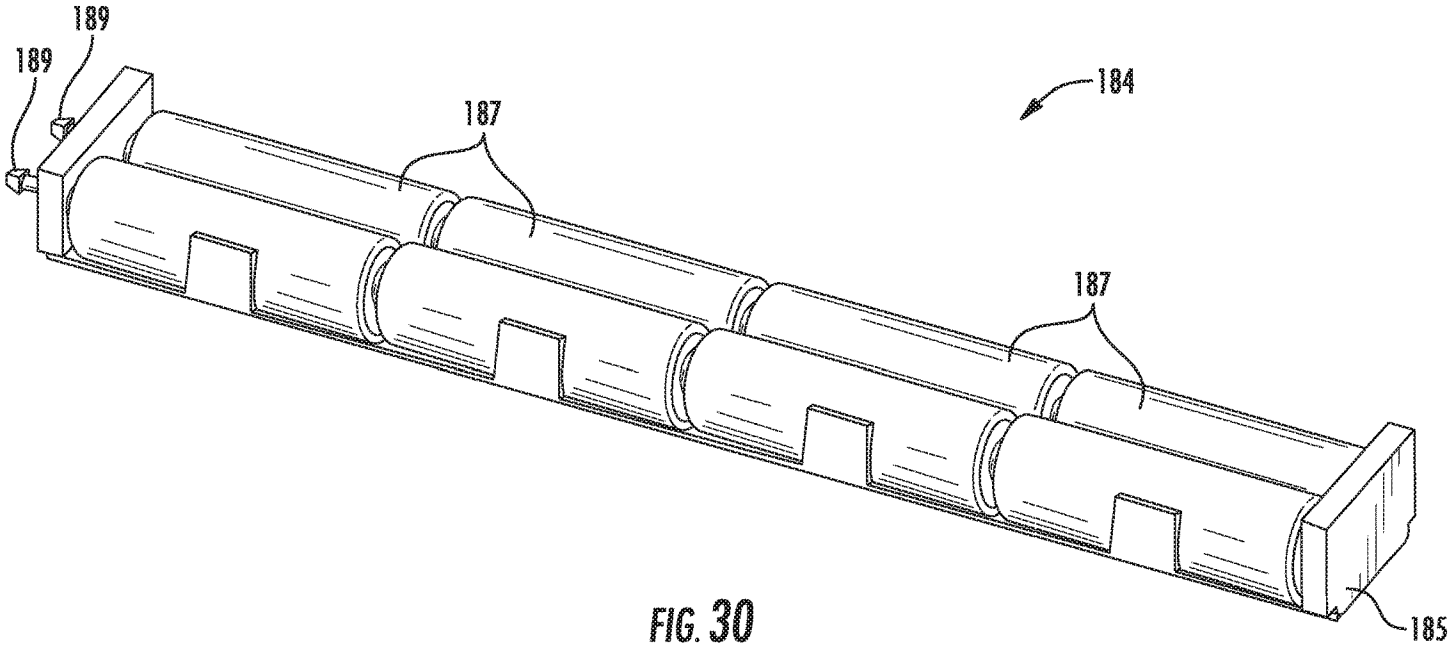
FIG. 30 illustrates a perspective view of one illustrative embodiment of a battery pack configured for use within the disclosed shutter assembly in accordance with aspects of the present subject matter.

Referring now to FIG. 30, a perspective view of one illustrative embodiment of the battery pack 184 described above with reference to FIGS. 4, 6 and 7 is illustrated in accordance with aspects of the present subject matter. As shown, the battery pack 184 may include a battery tray or sled 185 configured to support a plurality of batteries 187. For example, in the illustrated embodiment, the battery sled 185 is configured to support eight batteries of a given size. However, in other embodiments, the battery sled 185 may be configured to support any other suitable number of batteries 187 depending on the power requirements for the shutter assembly 100 and/or any dimensional constraints related to installing the battery pack 184 within one of the shutter frames 112A, 112B of the shutter assembly 100.

Additionally, as shown in FIG. 30, the battery pack 184 may also include two connection members 189 extending outwardly from the battery sled 185. In one embodiment, the connection members 189 may be utilized to couple the battery pack 184 to an adjacent component(s) of the disclosed shutter assembly 100, such as an adjacent motor housing of the motor assembly 154 (described below) of the disclosed shutter assembly 100.

Figure 31:
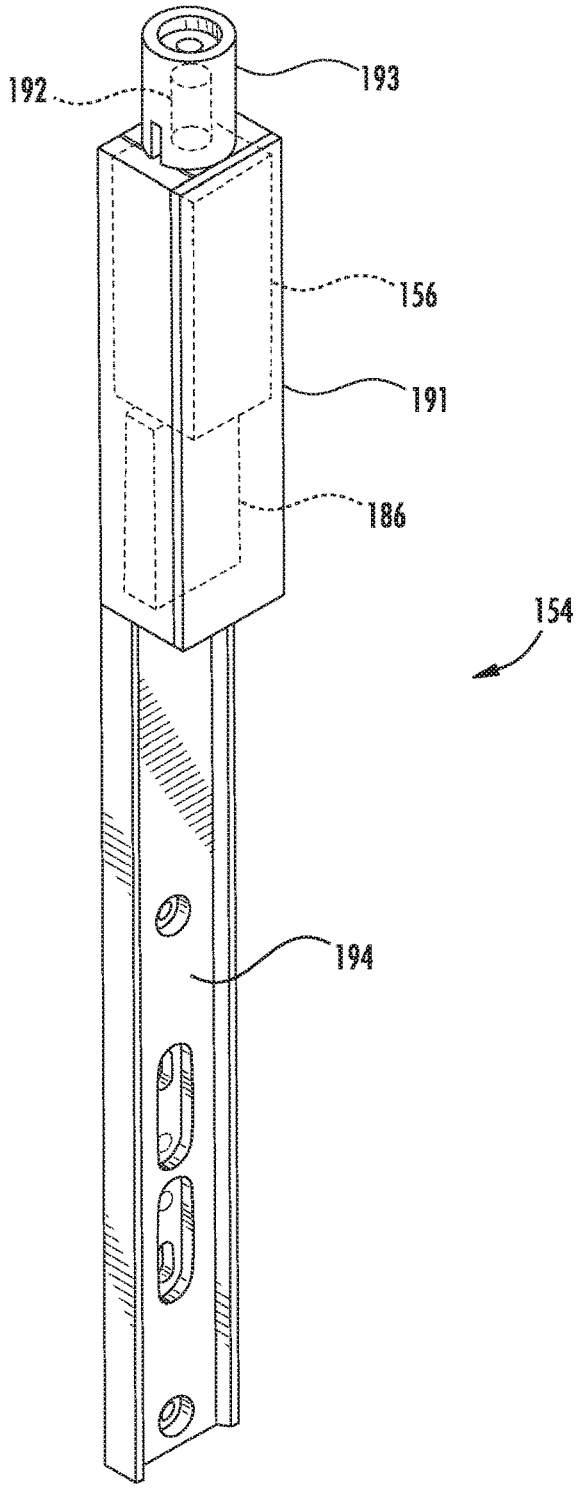
FIG. 31 illustrates a perspective view of one illustrative embodiment of a motor assembly configured for use within the disclosed shutter assembly in accordance with aspects of the present subject matter.

Referring now to FIG. 31, a perspective view of one illustrative embodiment of the motor assembly 154 described above with reference to FIGS. 4, 6 and 7 is illustrated in accordance with aspects of the present subject matter. As shown, the motor assembly 154 may include a housing 191 configured to encase both the motor 156 and the motor controller 186 of the assembly 154. For instance, the motor 156 may be positioned within the housing 191 adjacent to one of its ends to allow an output shaft 192 of the motor 156 to extend outwardly from the housing 191. A suitable coupling device 193 (or a gear box) may be coupled between the output shaft 192 and the motor drive shaft 158 to allow the motor 156 to be rotationally coupled to the louvers 114 via the drive system 152 described above. Alternatively, the output shaft 191 of the motor 156 may correspond to the motor drive shaft 158 and, thus, may eliminate the need for the separate coupling device 193 (or gearbox).

Moreover, as shown in FIG. 31, the motor assembly 154 may also include a support tray 194 extending outwardly from the motor housing 191. In several embodiments, the battery pack 184 may be configured to be installed onto the support tray 194. For instance, in one embodiment, the battery sled 185 of the battery pack 184 may be slid onto the support tray 194 until the connection members 189 of the battery pack 184 engage corresponding features of the motor housing 191, thereby securing the battery pack 184 to the motor assembly 154.

Figure 32:
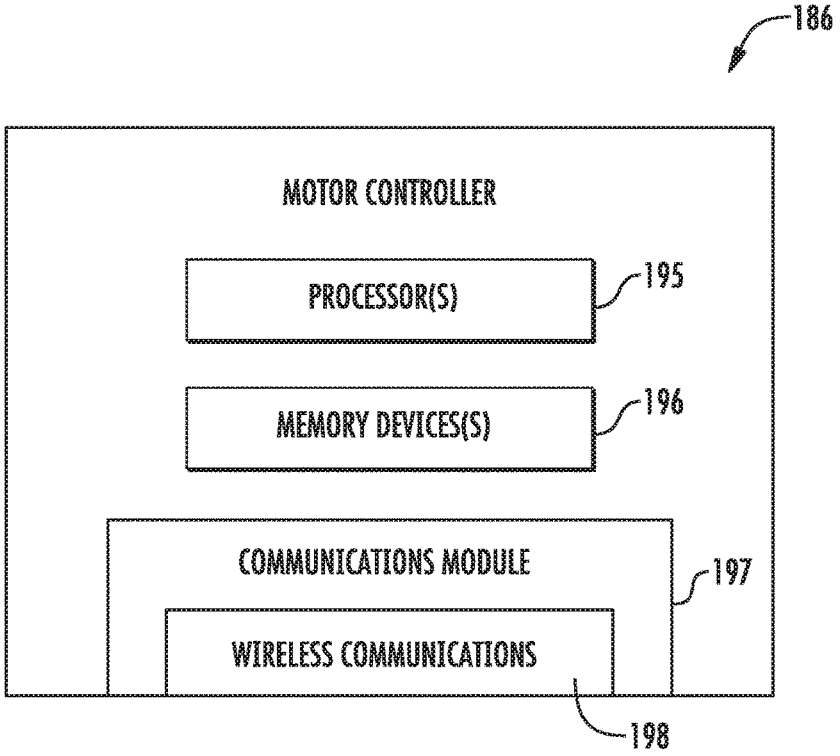
FIG. 32 illustrates a schematic view of one illustrative embodiment of suitable components that may be included within a motor controller of the disclosed shutter assembly in accordance with aspects of the present subject matter.

Referring now to FIG. 32, a schematic view of one illustrative embodiment of suitable components that may be included within the motor controller 186 of the disclosed shutter assembly 100 is illustrated in accordance with aspects of the present subject matter. In several embodiments, the motor controller 186 may correspond to any suitable processor-based device and/or combination of processor-based devices. Thus, the motor controller 186 may, for example, include one or more processor(s) 195 and associated memory device(s) 196 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 196 may generally comprise memory element(s) including, but not limited to, computer readable medium (e.g., random access memory (RAM)), computer readable non-volatile medium (e.g., a flash memory), and/or other suitable memory elements. Such memory device(s) 196 may generally be configured to store suitable computer-readable instructions that, when implemented by the processor(s) 195, configure the motor controller 186 to perform various functions including, but not limited to, the controlling the operation of the motor 156 based on wireless control signals received from a separate device (e.g., a remote control device).

Additionally, the motor controller 186 may also include a communications module 197 to facilitate communications between the motor controller 186 and the motor 156. For instance, the communications module 197 may allow the controller 186 to transmit suitable control signals to the motor 156 for controlling its operation. Moreover, in several embodiments, the communications module 197 may include suitable components for allowing the motor controller 186 to communicate wirelessly with one or more separate devices, such as a remote control device. For instance, in one embodiment, the communications module 197 may include or may be coupled to a wireless communications device 198 (e.g., an antenna or wireless receiver) for providing wireless communications between the motor controller 186 and one or more separate devices via radio waves or any other suitable wireless communications protocol, such as Bluetooth, WiFi, near field communication (NFC) and/or the like. In such an embodiment, the motor controller 186 may be configured to receive user inputs wirelessly from a separate device(s) for controlling the operation of the motor 156.

Figure 33:
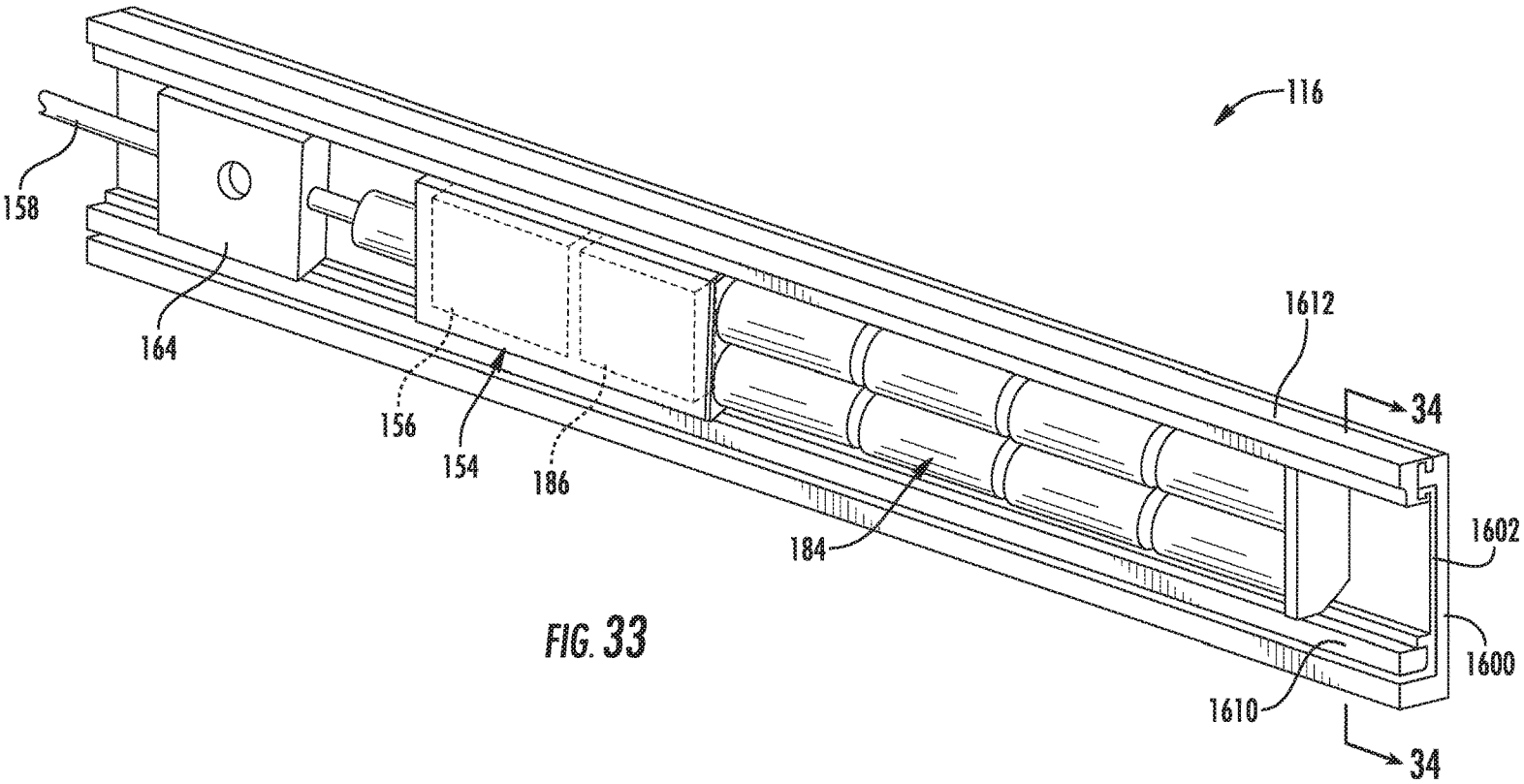
FIG. 33 illustrates a perspective, cut-away view of one illustrative embodiment of a portion of a stile configured for use within the disclosed shutter assembly in accordance with aspects of the present subject matter, particularly illustrating various internal components of the shutter assembly installed within the stile.
Figure 34:
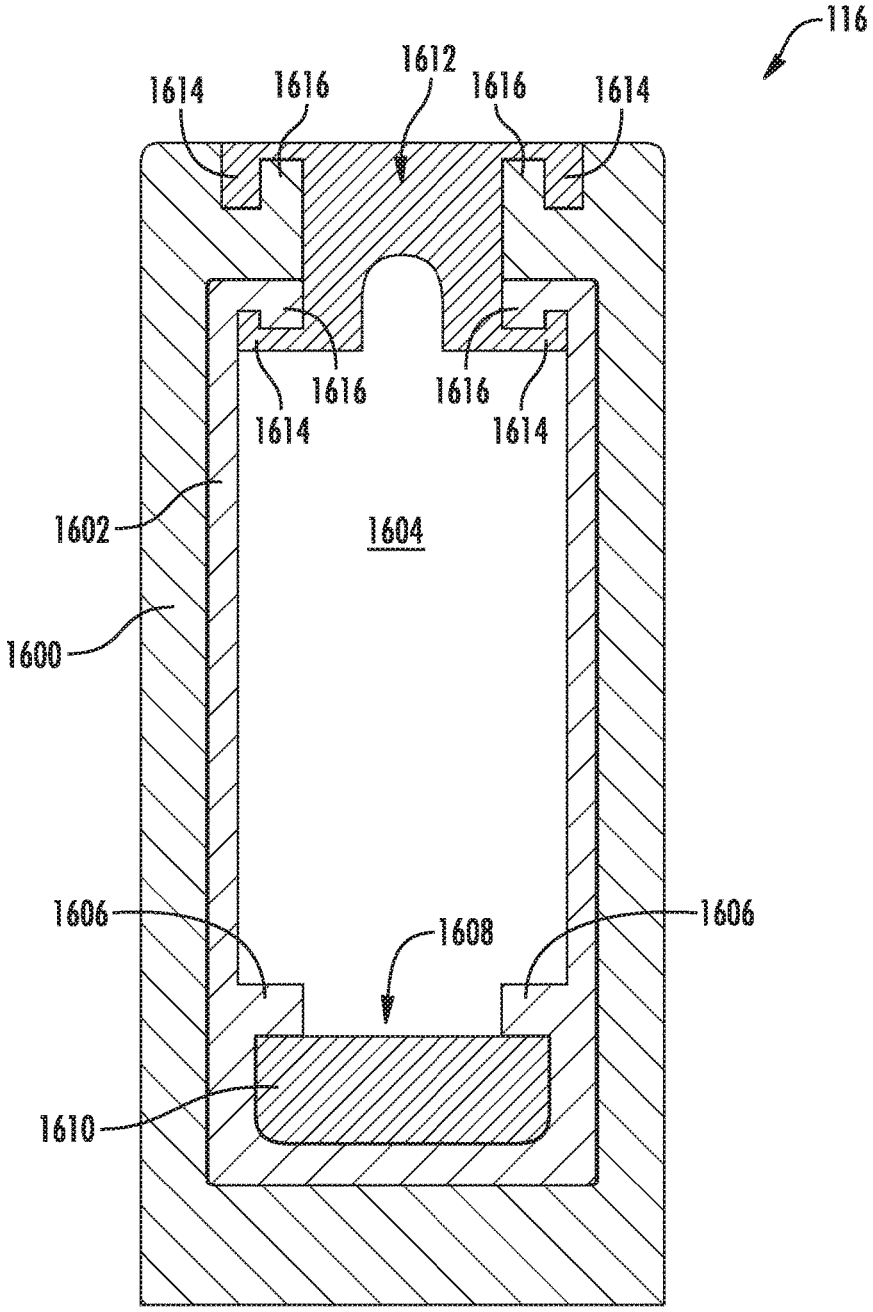
FIG. 34 illustrates a cross-sectional view of the stile shown in FIG. 33 taken about line 34-34.

Referring now to FIGS. 33 and 34, differing views of one illustrative embodiment of a suitable configuration for a stile (e.g., stile 116) that may be utilized within the disclosed shutter assembly 100 are illustrated in accordance with aspects of the present subject matter. Specifically, FIG. 33 illustrates a perspective view of the stile 116 having a portion of the stile 116 removed to show an exemplary arrangement of the various internal components of the shutter assembly 100 within the stile 116. Additionally, FIG. 34 illustrates a cross-sectional view of the stile 116 shown in FIG. 33 taken about line 34-34. For purposes of description, the stile configuration shown in FIGS. 33 and 34 will be described with reference to the frame-side stile 116 of shutter assembly 100. However, it should be appreciated that, in general, any stile(s) of shutter assembly 100 may have the stile configuration shown in FIGS. 33 and 34.

In several embodiments, the configuration of the stile 116 shown in FIGS. 33 and 34 may be utilized for stiles formed from wood or medium-density fiberboard (MDF) as opposed to vinyl stiles. Specifically, the stile configuration may allow for a wooden or MDF stile to house the various internal components of the disclosed shutter assembly 100 while maintaining a solid structure. However, it should be appreciated that the stile configuration shown in FIGS. 33 and 34 may also be utilized for stiles made of any other suitable material, including a vinyl material.

As particularly shown in the cross-sectional view of FIG. 34, the stile 116 may include an outer shell 1600 (e.g., formed from wood or MDF) and an inner housing 1602 within the outer shell 1600. In one embodiment, the inner housing 1602 may be formed from a lightweight, structural material, such as aluminum and/or the like, while the outer housing 1602 may be formed from wood or MDF. The inner housing 1602 may generally define an internal cavity 1604 configured to accommodate the various internal components of shutter assembly 100. For example, as shown in FIG. 33, the inner housing 1602 may be configured to accommodate a motor assembly (e.g., motor assembly 154), a battery pack (e.g., battery pack 184), a motor drive shaft (e.g., drive shaft 158), one or more gearboxes (e.g., gearbox 164) and/or any other suitable components of shutter assembly 100.

Moreover, as shown in FIG. 34, the inner housing 1602 may include opposed flanges 1606 extending inwardly within the cavity 1604 that define a track 1608 for slidably receiving one or more of the internal components of shutter assembly 100. In such an embodiment, one or more locking mechanisms 1610 may also be received within the track 1608 to maintain the relative positioning of the internal components within the stile 116. Additionally, as shown in FIG. 34, to finalize the assembly once the internal components of shutter assembly 100 have been installed within the stile 116, a connection member 1612 may be slidably received within a slot (not shown) defined between opposed sides of the outer shell 1600 and the inner housing 1602 at the open ends of such components. In one embodiment, the connection member 1612 may define suitable flanges 1614 configured to engage with corresponding flanges 1616 defined by the inner housing 1602 and the outer shell 1600, thereby interlocking the various components of the stile 116 together.

Figure 35:
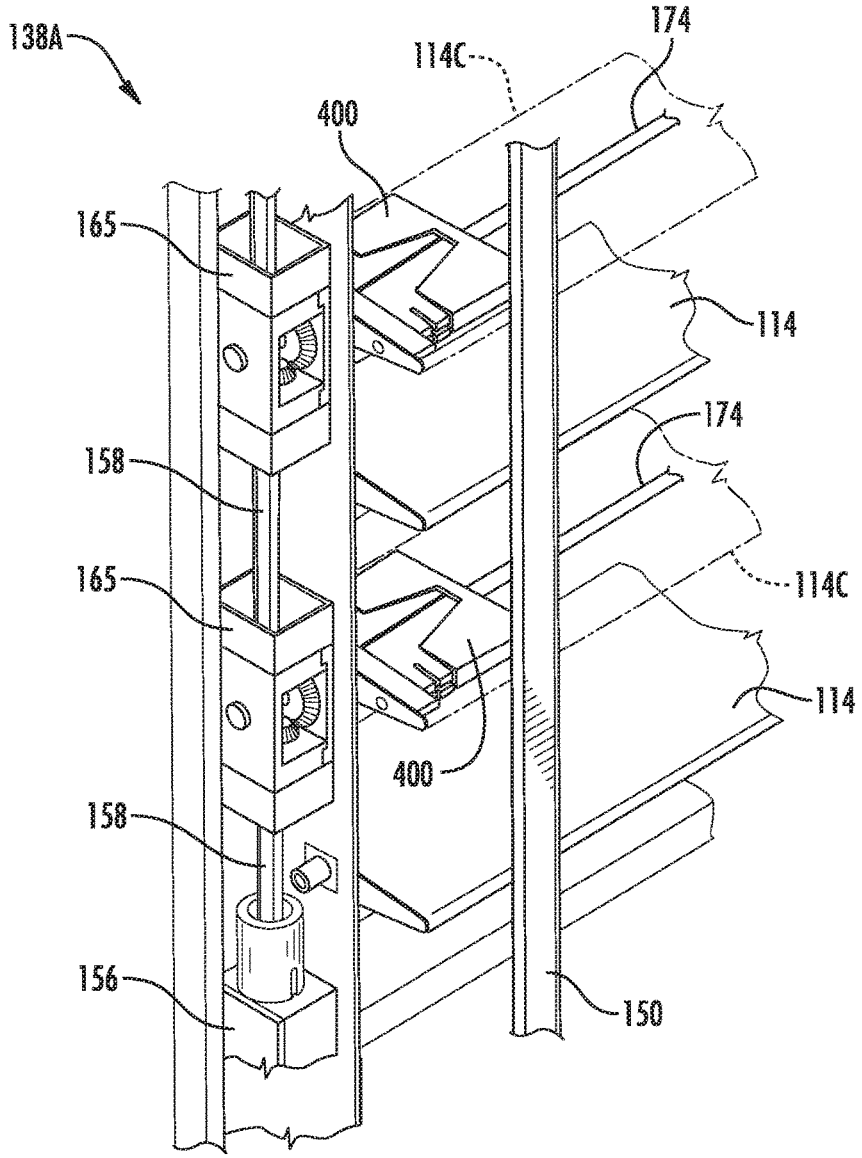
FIG. 35 illustrates a perspective view of one illustrative embodiment of a panel section of the disclosed shutter assembly including two driven louvers in accordance with aspects of the present subject matter.

Referring now to FIG. 35, a partial, perspective view of another illustrative embodiment of one of the panel sections of the disclosed shutter assembly 100 is illustrated in accordance with aspects of the present subject matter. For purposes of description, the panel section will be described as corresponding to the first lower panel section 138A of shutter assembly 100 shown in FIG. 6. However, it should be appreciated that, in general, the illustrated panel section may correspond to any suitable panel section of the disclosed shutter assembly 100.

As shown in FIG. 35, unlike the embodiment described above in which the first lower panel section 138A includes a single driven louver 114C, the panel section 138A includes two driven louvers 114C. Specifically, the motor 156 may be configured to rotationally drive a louver drive shaft 174 extending through each driven louver 114C via the motor drive shaft 158 and an associated gearbox 165. Each louver drive shaft 174 may, in turn, rotationally drive its respective driven louver 114C via a suitable clutch (e.g., the clutch 400 described above with reference to FIGS. 11 and 12). As such, the driven louvers 114C may be rotated in concert via rotation of the motor drive shaft 158 by the motor 156. Additionally, as shown in FIG. 35, the tie bar 150 associated with the panel section 138A may connect all of the corresponding louvers 114, 114C together to ensure that the driven 114C and non-driven louvers 114 rotate simultaneously.

It should be appreciated that, although the panel section 138A illustrated in FIG. 35 is shown as only including two driven louvers, each panel section of the disclosed shutter assembly 100 may generally be configured to include any suitable number of driven louvers, such as three or more driven louvers. By increasing the ratio of driven louvers to non-driven louvers within a given panel section, the likelihood that all of the louvers 114 within such panel section rotate in unison may be similarly increased. In doing so, the exact ratio of driven louvers to non-driven louvers utilized for a given panel section may vary depending on the amount of rotational slack or play exhibited between the various louvers 114 and other system components.

Figure 36:
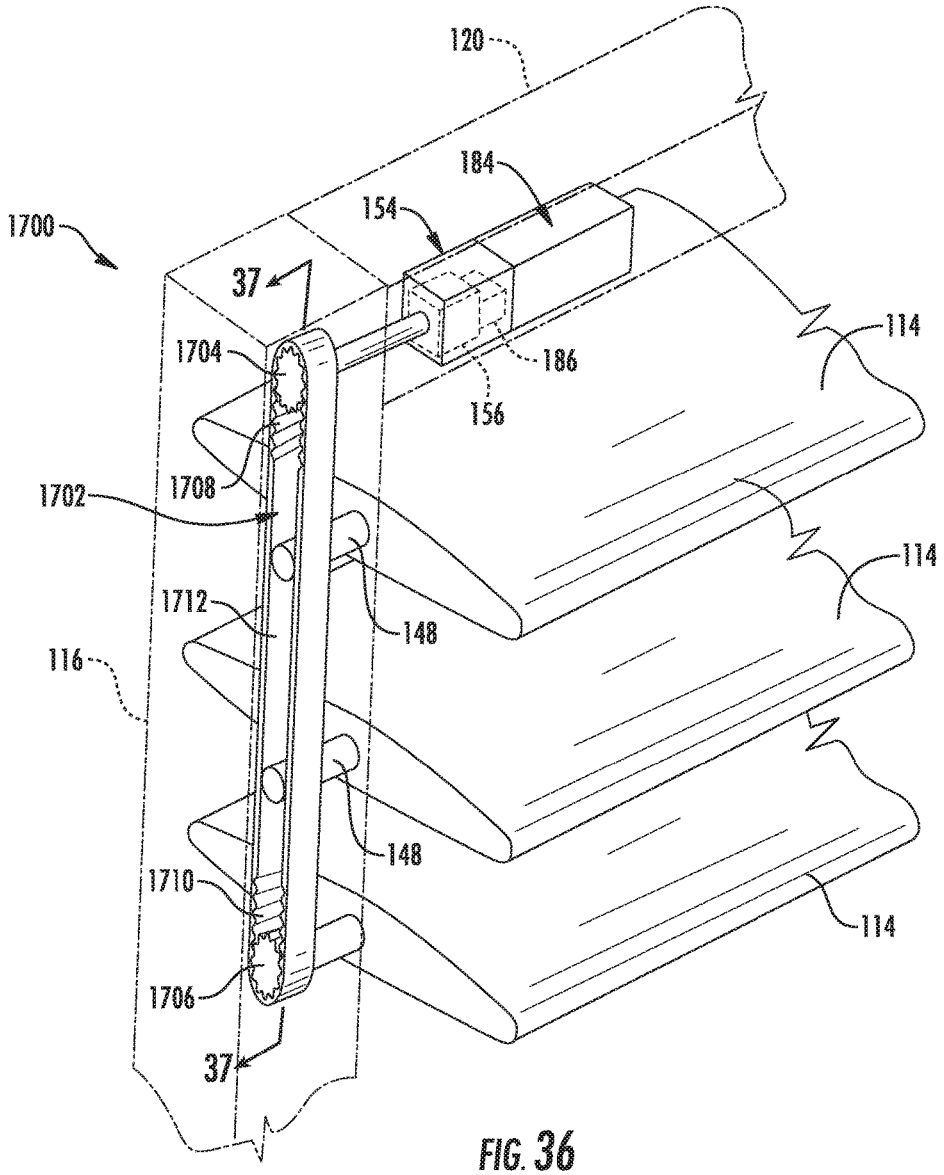
FIG. 36 illustrates a perspective view of another illustrative embodiment of a drive system configured for use within the disclosed shutter assembly in accordance with aspects of the present subject matter.
Figure 37:
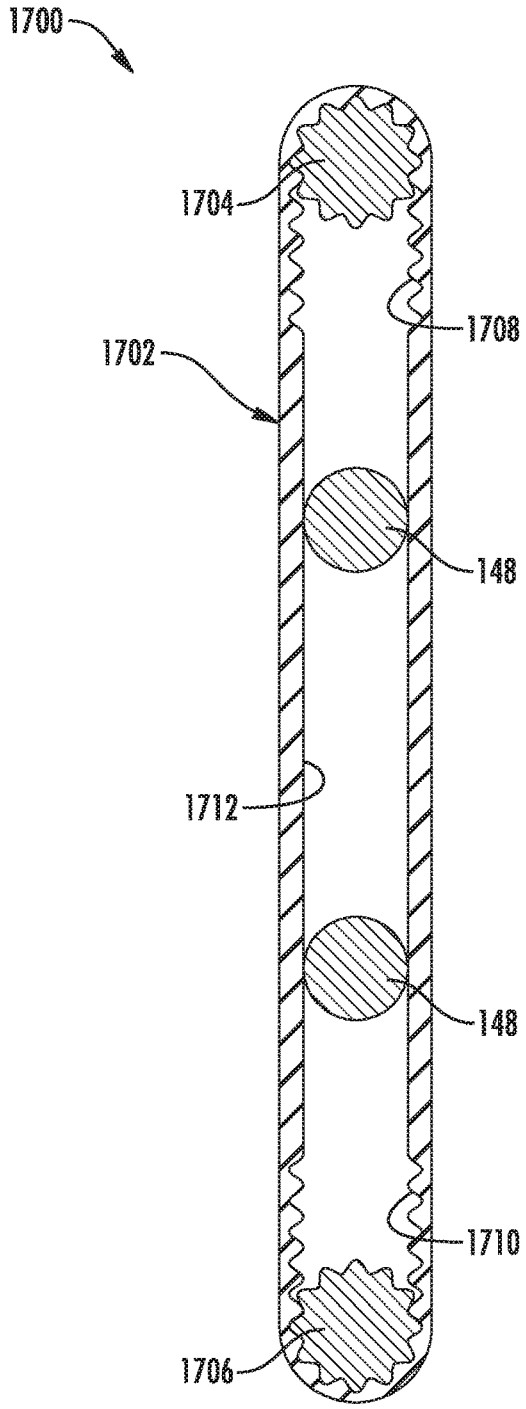
FIG. 37 illustrates a cross-sectional view of various components of the drive system shown in FIG. 36 taken about line 37-37.

Referring now to FIGS. 36 and 37, differing views of another illustrative embodiment of a drive system 1700 that may be utilized within the disclosed shutter assembly 100 are illustrated in accordance with aspect of the present subject matter. Specifically, FIG. 36 illustrates a partial, perspective view of various component of the drive system 1700 installed within a shutter frame (e.g., the frame side stile 116 and top rail 120 of shutter frame 112A), with the components of the shutter frame being shown in phantom lines. Additionally, FIG. 37 illustrates a cross-sectional view of the drive system 1700 shown in FIG. 36 taken about line 37-37. It should be appreciated that, in one embodiment, the drive system 1700 may be used an alternative to the drive system 152 described above with reference to FIGS. 4-7.

As shown, unlike the embodiment of the drive system 152 described above, the drive system 1700 includes a belt 1702 configured to rotationally drive one or more louvers 114 of the shutter assembly 100 (e.g., via an associated motor assembly 154 and battery pack 184). Specifically, in the illustrated embodiment, the belt 1702 may be configured to extend lengthwise between a drive gear 1704 coupled to the motor 156 and an end gear 1706 coupled to one of the louvers 114. In such an embodiment, at least a portion of the belt 1702 may be toothed to allow the gears 1704, 1706 to rotationally engage the belt 1702. For instance, as particularly shown in FIG. 36, the belt 1704 may include an upper toothed section 1708 and a lower toothed section 1710 configured to extend around the drive gear 1704 and the end gear 1706, respectively.

Additionally, in one embodiment, the belt 1702 may be configured to frictionally engage a louver peg(s) 148 of the louver(s) 114 positioned between the drive gear 1704 and the end gear 1706. For instance, a middle section 1712 of the belt 1702 may include an inner friction surface configured to rotationally engage the louver peg(s) 148 as the belt 1702 is driven by the motor 156. In addition to the friction surface or as an alternative thereto, the middle section 1712 may be retained in engagement with the louver pegs 148 by the sides of the stile 116 within which the belt 1702 is installed or by any other suitable means (e.g., using one or more springs positioned between the belt 1702 and the sides of the stile 116). As such, as the motor 156 is used to rotationally drive the drive gear 1704, the translation of the belt 1702 between the drive and end gears 1704, 1706 may cause the louvers 114 coupled to the belt 1702 to rotate about their longitudinal axes.

In the illustrated embodiment, the belt 1702 is configured to drive three corresponding louvers 114. However, in other embodiments, the belt 1702 may be coupled to any other suitable number of louvers 114 to allow such louvers to be rotationally driven by the motor 156. For instance, in one embodiment, more than two louvers 114 (e.g., three, four, five, or more louvers) may be positioned between the drive and end gears 1704, 1706, with each louver 114 having a louver peg 148 configured to rotationally engage the belt 1702.

It should be appreciated that, in other embodiments, the entire belt 1702 may be toothed. In such an embodiment, the louver pegs 148 may include or be coupled to suitable gears configured to rotationally engage the belt 1702, thereby allowing the various louvers 114 to be rotationally driven by the motor 156. It should also be appreciated that, although the motor assembly 154 and associated battery pack 184 are shown as being installed within one of the top rails 120 of the shutter assembly 100, the motor assembly 154 and/or battery pack 184 may, alternatively, be installed at any other suitable location within the shutter assembly 100, such as within one of the bottom rails or within the same stile as the belt 1702.

Figure 38:
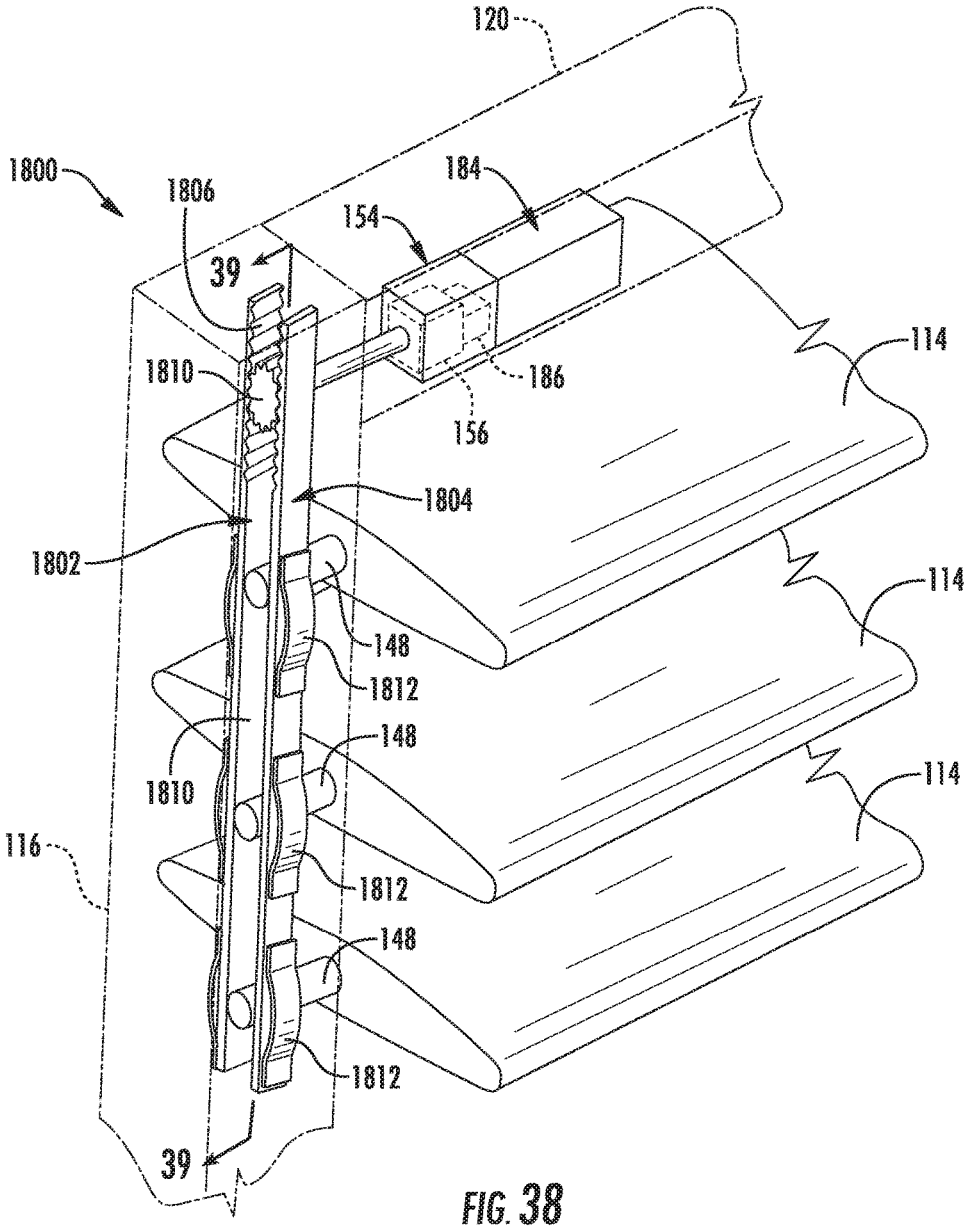
FIG. 38 illustrates a perspective view of a further illustrative embodiment of a drive system configured for use within the disclosed shutter assembly in accordance with aspects of the present subject matter.
Figure 39:
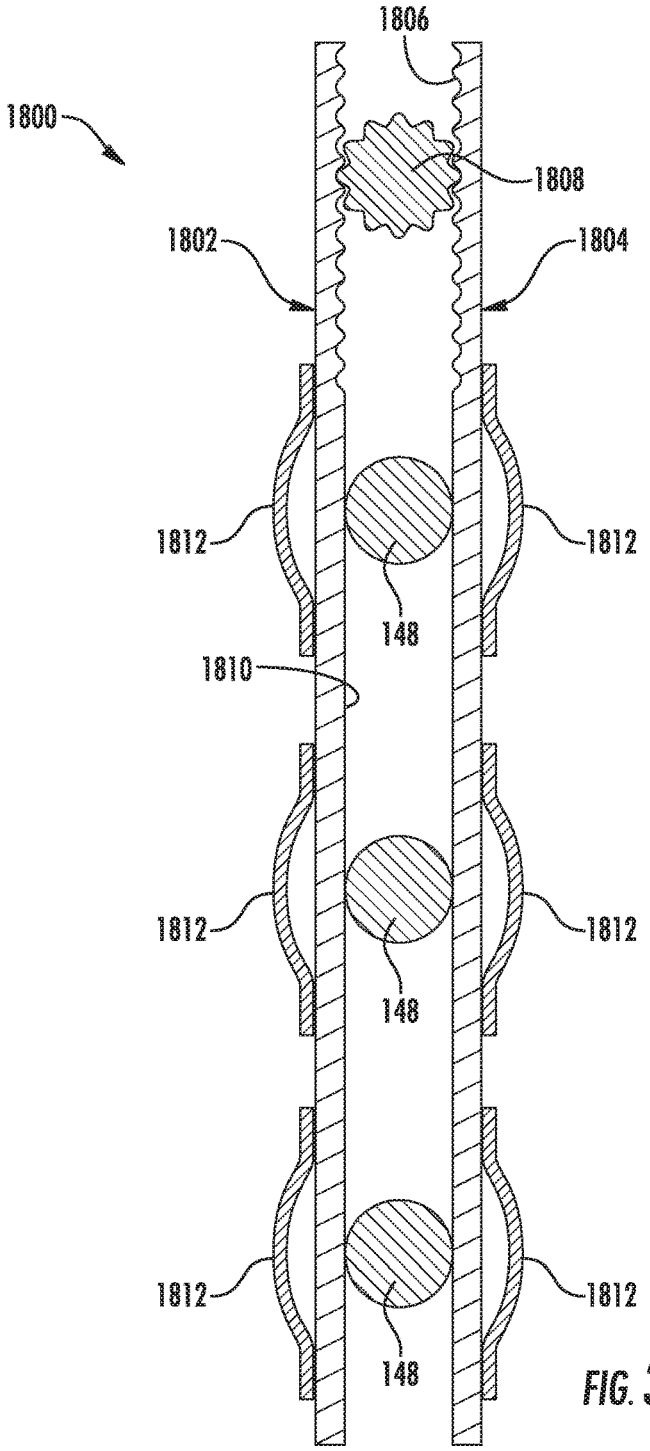
FIG. 39 illustrates a cross-sectional view of various components of the drive system shown in FIG. 38 taken about line 39-39.

Referring now to FIGS. 38 and 39, differing views of a further illustrative embodiment of a drive system 1800 that may be utilized within the disclosed shutter assembly 100 are illustrated in accordance with aspect of the present subject matter. Specifically, FIG. 38 illustrates a partial, perspective view of various component of the drive system 1800 installed within a shutter frame (e.g., the frame side stile 116 and top rail 120 of shutter frame 112A), with the components of the shutter frame being shown in phantom lines. Additionally, FIG. 39 illustrates a cross-sectional view of the drive system 1800 shown in FIG. 38 taken about line 39-39. It should be appreciated that, in one embodiment, the drive system 1800 may be used an alternative to the drive system 152 described above with reference to FIGS. 4-7.

As shown, unlike the embodiment of the drive system 152 described above, the drive system 1800 includes first and second racks 1802, 1804 configured to rotationally drive one or more louvers 114 of the shutter assembly 100 (e.g., via an associated motor assembly 154 and battery pack 184). The racks 1802, 1804 may generally be configured to extend lengthwise within the adjacent stile 116, with each rack 1802, 1804 including a toothed section 1806 configured to rotationally engage a drive gear 1808 coupled to the motor 156. Additionally, in one embodiment, the racks 1802, 1804 may be configured to frictionally engage a louver peg(s) 148 of the louver(s) 114 coupled to the racks 1802, 1804. For instance, the racks 1802, 1804 may define an inner friction surface 1810 configured to rotationally engage the louver peg(s) 148 as the racks 1802, 1804 are linearly translated relative to the peg(s) 148 via rotation of the drive gear 1808 by the motor 156. In addition to the friction surface 1810 or as an alternative thereto, the racks 1802, 1804 may be retained in engagement with the louver pegs 148 by the sides of the stile 116 within which the racks 1802, 1804 are installed or by any other suitable means. For instance, as shown in FIGS. 38 and 39, springs 1812 may be positioned between each rack 1802, 1804 and the adjacent side of the stile 116 to force the racks 1802, 1804 inwardly towards the louver peg(s) 148. Thus, as the motor 156 rotates the drive gear 1808, the racks 1802, 1804 may be translated in opposite directions relative to the louver pegs 148 to allow the corresponding louvers 114 to be rotated about their longitudinal axes.

It should be appreciated that, in other embodiments, the racks 1802, 1804 may be have a toothed configuration along their entire lengths and/or may include discrete toothed sections at the locations of the louvers 114. In such an embodiment, the louver pegs 148 may include or be coupled to suitable gears configured to rotationally engage the racks 1802, 1804 to allow the various louvers 114 to be rotationally driven by the motor 156. It should also be appreciated that, although the motor assembly 154 and associated battery pack 184 are shown as being installed within one of the top rails 120 of the shutter assembly 100, the motor assembly 154 and/or battery pack 184 may, alternatively, be installed at any other suitable location within the shutter assembly 100, such as within one of the bottom rails or within the same stile as the racks 1802, 1804.

Figure 40:
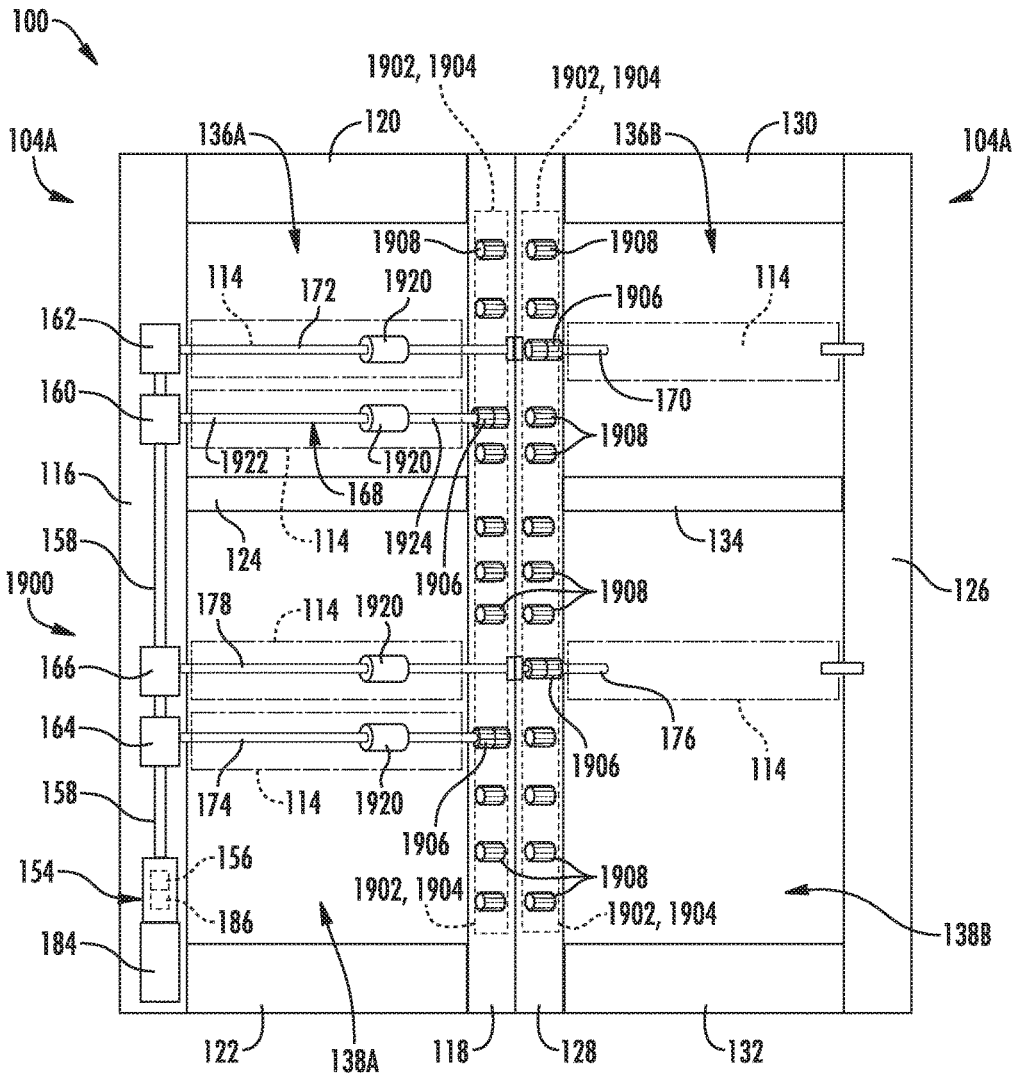
FIG. 40 illustrates another simplified front view of the shutter assembly similar to that shown in FIG. 4, particularly illustrating yet another illustrative embodiment of a drive system configured for use within the disclosed shutter assembly in accordance with aspects of the present subject matter.
Figure 41:
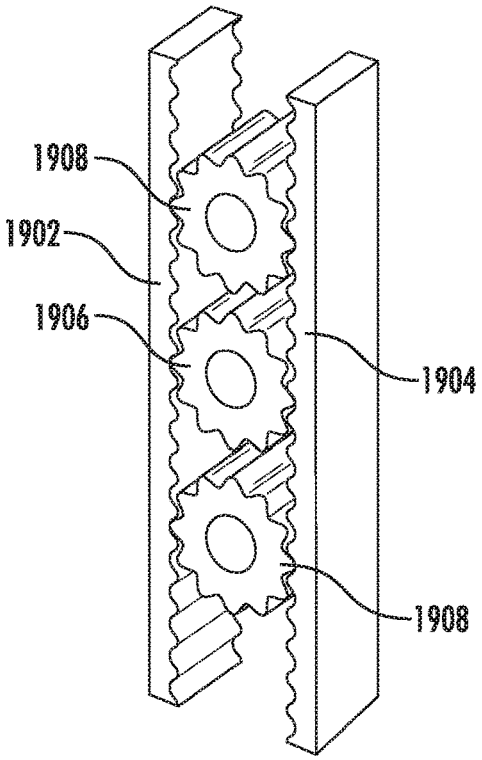
FIG. 41 illustrates a perspective view of a portion of a pair of racks and associated gears of the drive system shown in FIG. 40.
Figure 42:
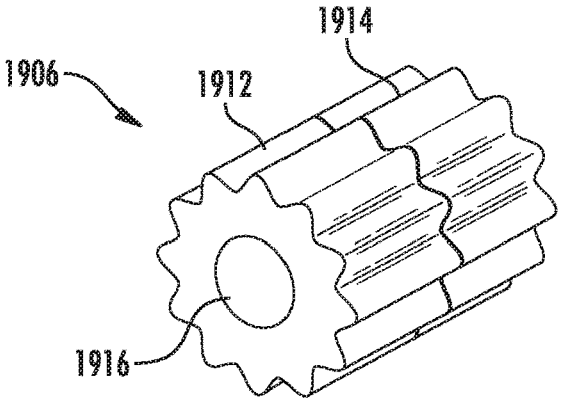
FIG. 42 illustrates a perspective view of one illustrative embodiment of a split-gear configuration suitable for use with one or more of the gears of the drive system shown in FIG. 40 in accordance with aspects of the present subject matter.

Referring now to FIGS. 40-42, differing views of yet another illustrative embodiment of a drive system 1900 that may be utilized within the disclosed shutter assembly 100 are illustrated in accordance with aspects of the present subject matter. Specifically, FIG. 40 illustrates a front view of the shutter assembly 100 similar to the view shown in FIG. 4, particularly illustrating a transparent or wireframe view of the shutter panels 102A, 102B in their closed position to allow the various internal components of the drive system 1900 to be viewed. FIG. 40 also illustrates the shutter assembly 100 with the majority of its louvers 114 removed (except for a select few shown in phantom lines) for purposes of describing the internal components of the drive system 1900. Additionally, FIG. 41 illustrates a perspective view of a portion of racks 1902, 1904 configured for use within the drive system 1900, and FIG. 42 illustrates a perspective view of a split-gear configuration that may be utilized for one or more gears of the illustrated drive system 1900.

As shown, the drive system 1900 may include many of the same or similar components of the drive system 152 described above with reference to FIG. 4 and, thus, the same reference numbers will be used to identify the same/similar components shown in FIG. 40. For instance, the drive system 1900 may include a motor assembly 154 having a motor 156 and associated motor controller 186. The drive system 1900 may also include a battery pack 184 for powering the motor assembly 154. The motor 156 may be configured to rotationally drive a motor drive shaft 158 extending through corresponding gearboxes 160, 162, 164, 166, which are, in turn, coupled to louver shafts associated with the various panel sections 136A, 136B, 138A, 138B of shutter assembly 100. For instance, a first gearbox 160 may be coupled to a first louver drive shaft 168 for rotationally driving the louvers 114 of the first upper panel section 136A while a second gearbox 162 may be coupled to a second louver drive shaft 170 (e.g., via an upper pass-through louver shaft 172 and associated coupling members (not labeled in FIG. 40)) for rotationally driving the louvers 114 of the second upper panel section 136B. Similarly, a third gearbox 164 may be coupled to a third louver drive shaft 174 for rotationally driving the louvers 114 of the first lower panel section 138A while a fourth gearbox 166 may be coupled to a fourth louver drive shaft 176 (e.g., via a lower pass-through louver shaft 178 and associated coupling members (not labeled in FIG. 40)) for rotationally driving the louvers 114 of the second lower panel section 138B.

However, as shown in FIG. 40, unlike the embodiment of the drive system 152 described above, the louvers 114 within each panel section 136A, 136B, 138A, 138B may be configured to be rotated using a rack and pinion-type drive arrangement. Specifically, in one embodiment, the drive system 1900 may include a pair of racks 1902, 1904 (shown in dashed lines in FIG. 40) associated with each panel section 136A, 136B, 138A, 138B of shutter assembly 100, with the racks 1902, 1904 being installed within the panel-side stiles 118, 128 of the shutter panels 104A, 104B to allow each pair of racks 1902, 1904 to rotationally engage corresponding gears 1906, 1908 coupled to the louvers 114 within each associated panel section 136A, 136B, 138A, 138B. In such an embodiment, each louver drive shaft 168, 170, 174, 176 may be coupled to a drive gear 1906 rotationally engaged with one of the pairs of racks 1902, 1904, with the remainder of the louvers 114 within each section 136A, 136B, 138A, 138B being coupled to corresponding driven gears 1908 via their louver pegs (not shown) or any other suitable coupling means. Thus, by rotationally driving the louver drive shaft 168, 170, 172, 174 associated with a given panel section 136A, 136B, 138A, 138B, the racks 1902, 1904 installed across such panel section may be linearly translated to rotationally drive the louvers 114 within the panel section.

It should be appreciated that the driven gears 1908 for the louvers 114 through which the pass-through louver shafts 172, 178 extend have been removed from FIG. 41 for purposes of illustration. One of ordinary skill in the art will readily appreciate that each of such driven gears 1908 may be configured to rotationally engage its corresponding pair of racks 1902, 1904 while allowing the associated pass-through louver shaft 172, 178 to extend through the gear 1908 without rotationally engaging the gear 1908.

Figure 43:
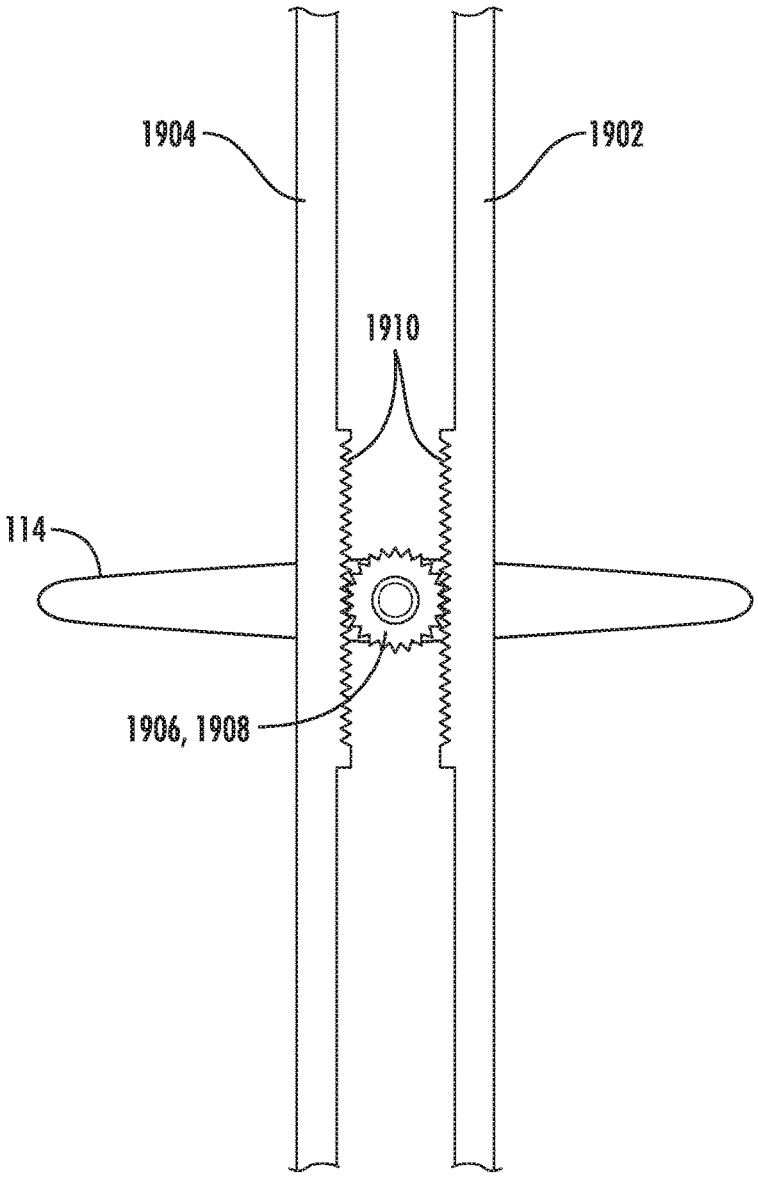
FIG. 43 illustrates a side view of another illustrative embodiment of a pair of racks configured for use with the drive system shown in FIG. 40 in accordance with aspects of the present subject matter.

As shown in FIG. 41, each pair of racks 1902, 1904 may include a first rack 1902 and a second rack 1904 extending adjacent to the first rack 1902, with the various gears 1906, 1908 being positioned between the first and second racks 1902, 1904. As is generally understood, the inner surfaces of the racks 1902, 1904 may be toothed to allow the gears 1906, 1908 to rotationally engage the racks 1902, 1904. Thus, as the racks 1902, 1904 are linearly translated in opposite directions within the associated stile(s) 118, 128 (e.g., via rotation of each drive gear 1906), each driven gear 1908 may be rotationally driven to allow its associated louver 114 to be rotated about its longitudinal axis. It should be appreciated that, as an alternative to configuring the inner surfaces of the racks 1902, 1904 to be toothed along their entire length, the racks 1902, 1904 may, instead, include discrete toothed sections along their length. For example, as shown in the alternative embodiment of FIG. 43, each rack 1902, 1904 may include a toothed section 1910 extending lengthwise adjacent to the location of each gear 1906, 1908 to allow the associated louver 114 to be rotationally driven.

Additionally, as shown in the illustrated embodiment, each drive gear 1906 may, in one embodiment, have a split-gear configuration. Specifically, as shown in FIG. 42, each drive gear 1906 may include a first gear portion 1912 and a second gear portion 1914. The first gear portion 1912 may generally be configured to define an opening 1916 having a diameter larger than the diameter of the corresponding louver drive shaft 168, 170, 174, 176, thereby allowing the drive shaft to extend through the first gear portion 1912 without rotationally engaging the gear portion. Moreover, the second gear portion 1914 may be configured to be rotationally engaged or coupled to the corresponding louver drive shaft 168, 170, 174, 176. As such, when the louver drive shaft 168, 170, 174, 176 is rotated, the drive shaft may rotationally drive the second gear portion 1914 without driving the first gear portion 1912.

Further, as shown in FIG. 40, the louver shafts extending through the louvers 114 of the first shutter panel 104A (e.g., the first and third louver drive shafts 168, 174 and the upper and lower pass-through louver shafts 172, 178) may each be divided into two separate shaft sections (e.g., a motor-side section 1922 and a rack-side section 1924), with the shaft sections 1922, 1924 being coupled together via a suitable clutch 1920 positioned within the corresponding louver 114. In the illustrated embodiment, each clutch 1920 has the same in-line clutch configuration as the clutch 1000 shown in FIG. 21. However, in other embodiments, the clutches 1920 may have any other suitable clutch configuration that allows each clutch 1920 to function as means for disengaging the separate sections 1922, 1924 of the louver shafts 168, 172, 174, 178, such as any of the other clutch configurations described herein. By providing the clutches 1920 between the separate sections 1922, 1924 of the louver shafts 168, 172, 174, 178, the rack-side section 1924 of each louver shaft may be decoupled from its motor-side section 1922 when the louvers 114 within the corresponding panel section are being manually adjusted. For instance, the rack-side section 1924 of the first louver drive shaft 168 may be configured to slip relative to the clutch 1920 when the louvers 114 of the first upper panel section 136A are being manually adjusted, thereby allowing the rack-side section 1924 to rotate relative to the motor-side section 1924 of the first louver drive shaft 168.

Figure 44:
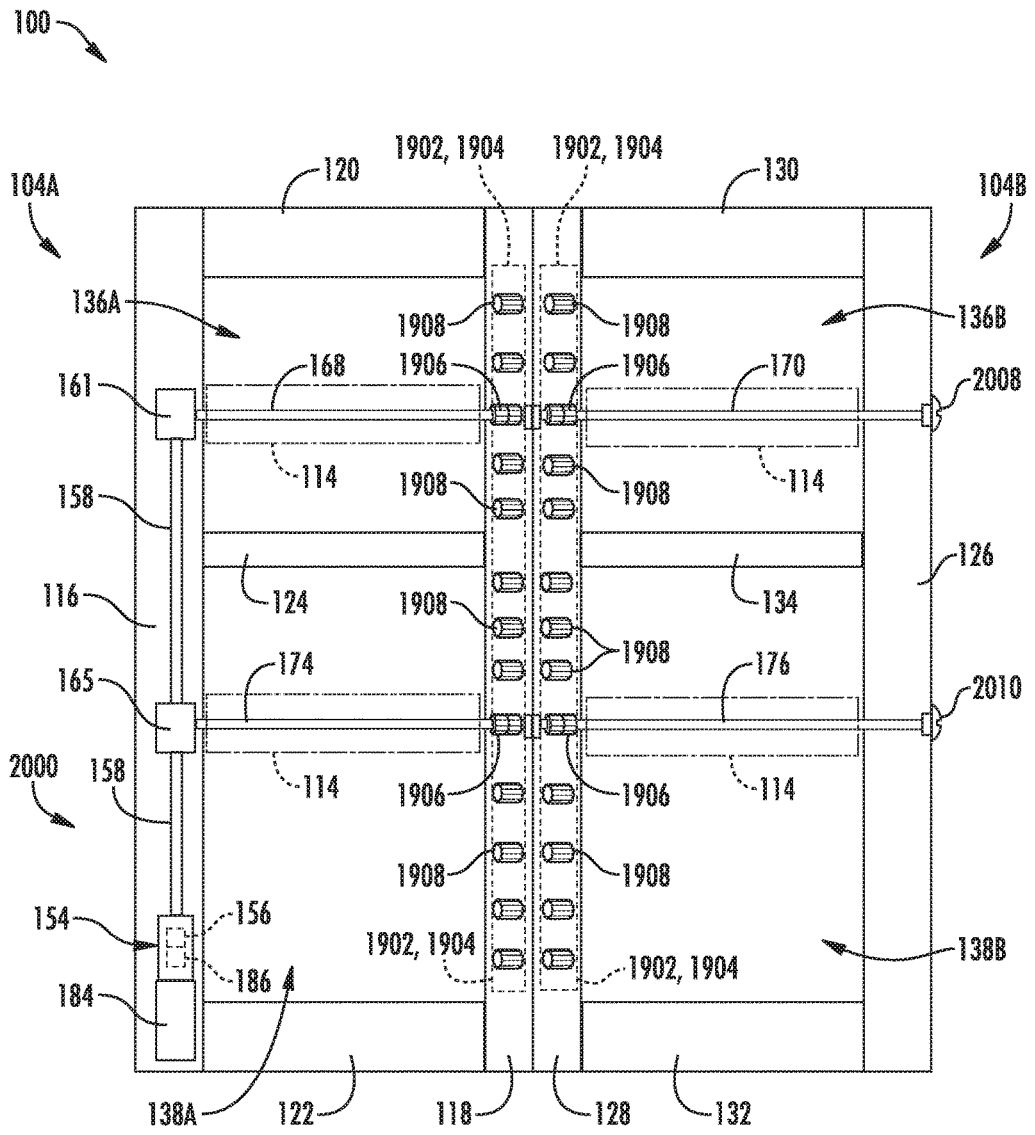
FIG. 44 illustrates another simplified front view of the shutter assembly similar to that shown in FIG. 6, particularly illustrating an even further illustrative embodiment of a drive system configured for use within the disclosed shutter assembly in accordance with aspects of the present subject matter.
Figure 45:
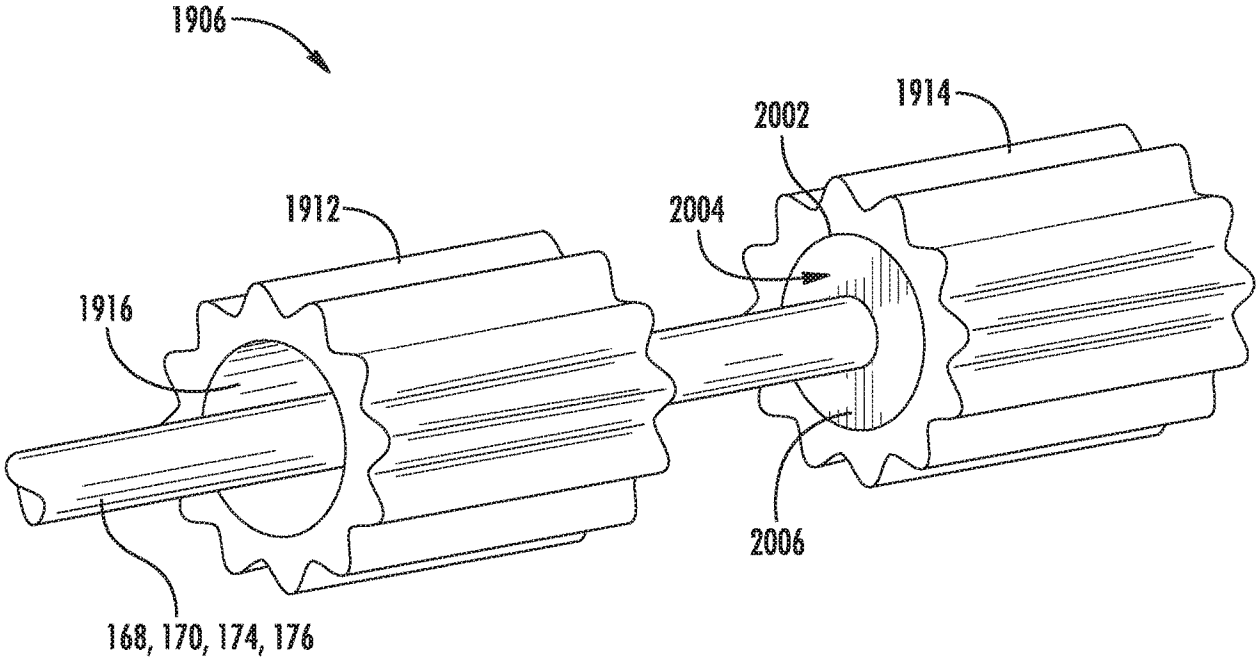
FIG. 45 illustrates a perspective, exploded view of one illustrative embodiment of a split-gear configuration suitable for use with one or more of the gears of the drive system shown in FIG. 44 in accordance with aspects of the present subject matter.

Referring now to FIGS. 44 and 45, differing views of a further illustrative embodiment of a drive system 2000 that may be utilized within the disclosed shutter assembly 100 are illustrated in accordance with aspects of the present subject matter. Specifically, FIG. 44 illustrates a front view of the shutter assembly 100 similar to the view shown in FIG. 6, particularly illustrating a transparent or wireframe view of the shutter panels 102A, 102B in their closed position to allow the various internal components of the drive system 2000 to be viewed. FIG. 44 also illustrates the shutter assembly 100 with the majority of its louvers 114 removed (except for a select few shown in phantom lines) for purposes of describing the internal components of the drive system 2000. Additionally, FIG. 45 illustrates a perspective view of a split-gear configuration that may be utilized for one or more gears of the illustrated drive system 2000, particularly illustrating one of the gear portions being exploded away from the other gear portion.

As shown, the drive system 2000 may be configured similarly to the embodiment of the drive system 1900 described above with reference to FIGS. 40-42 and, thus, the same reference numbers will be used to identify the same/similar components shown in FIGS. 44 and 45. For example, the drive system 2000 includes a pair of racks 1902, 1904 (shown in dashed lines in FIG. 44) associated with each panel section 136A, 136B, 138A, 138B of shutter assembly 100, with the racks 1902, 1904 being installed within the panel-side stiles 118, 128 of the shutter panels 104A, 104B to allow each pair of racks 1902, 1904 to rotationally engage corresponding gears 1906, 1908 coupled to the louvers 114 within each associated panel section 136A, 136B, 138A, 138B. Additionally, similar to the embodiment described above, each drive gear 1906 may have a split-gear configuration, including both a first gear portion 1912 and a second gear portion 1914. As indicated above, the first gear portion 1912 may generally be configured to define an opening 1916 having a diameter larger than the diameter of the corresponding louver drive shaft 168, 170, 174, 176, thereby allowing the drive shaft to extend through the first gear portion 1912 without rotationally engaging the gear portion. Similarly, the second gear portion 1914 may be configured to be rotationally engaged or coupled to the corresponding louver drive shaft 168, 170, 174, 176. As such, when the louver drive shaft 168, 170, 174, 176 is rotated, the drive shaft may rotationally drive the second gear portion 1914 while the first gear portion 1912 may be rotationally driven by the translation of the associated racks 1902, 1904.

However, unlike the embodiment described above with reference to FIGS. 40-42, the drive system 2000 only includes two gearboxes, namely an upper gearbox 161 and a lower gearbox 165. In such an embodiment, the motor drive shaft 158 may be configured to extend through the upper gearbox 161 to allow rotational motion to be transferred to the first louver drive shaft 168 for driving the louvers 114 within the first upper panel section 136A and to the second louver drive shaft 170 (e.g., via coupling members (not labeled in FIG. 44)) for driving the louvers 114 within the second upper panel section 136B. Similarly, the motor drive shaft 158 may be configured to extend through the lower gearbox 165 to allow rotational motion to be transferred to the third louver drive shaft 174 for driving the louvers 114 within the first lower panel section 138A and to the fourth louver drive shaft 176 (e.g., via coupling members (not labeled in FIG. 44)) for driving the louvers 114 within the second lower panel section 138B. Thus, by rotationally driving the louver drive shafts 168, 170, 174, 176, the associated racks 1902, 1904 may be linearly translated in opposite directions within each shutter panel 104A, 104B (e.g., via rotation of the drive gears 1906) to allow the louvers 114 to be rotated.

Moreover, unlike the embodiment described above with reference to FIGS. 40-42 that includes clutches 1920 positioned between separate shaft sections of the louver drive shafts, the illustrated embodiment includes clutches incorporated into the drive gears 1906. Specifically, as shown in FIG. 45, the second gear portion 1914 of each drive gear 1906 may define an opening 2002 configured to receive a clutch 2004, which, in turn, is configured to rotationally engage the associated louver drive shaft 168, 170, 174, 176. For instance, in one embodiment, the clutch 2004 may include a sleeve member 2006 configured to be fixed within the second gear portion 1914 at the interface defined between the clutch 2004 and the second gear portion 1914. Similar to the sleeve members 502, 602, 702, 1002 described above, the sleeve member 2006 may be formed from a deformable, friction material (e.g., nylon or any other suitable material) that allows the sleeve member 2006 to be fit tightly around the louver drive shaft 168, 170, 174, 176 to provide a frictional interface between the clutch 2004 and the associated drive shaft. In such an embodiment, the louver drive shaft 168, 170, 174, 176 may be pressed into the sleeve member 2006 to allow the clutch 2004 to rotationally engage the drive shaft. Thus, when the motor 156 is used to turn the louver drive shafts 168, 170, 174, 176, rotational motion may be transferred through each clutch 2004 to the second gear portion 1914 of each drive gear 1906 to rotationally drive the associated racks 1902, 1904. However, when one of the louvers 114 associated with a drive gear 1906 is manually rotated, the clutch 2004 may allow the sleeve member 2006 to slip relative to the associated louver drive shaft 168, 170, 174, 176, thereby allowing the second gear portion 1914 of the drive gear 1906 to rotate relative to the drive shaft.

It should be appreciated that, in the embodiment illustrated in FIG. 44, the second and fourth louver drive shafts 170, 176 are each shown as extending across the entire width of the second shutter panel 104B to a corresponding coupling member 2008, 2010. Such a configuration may be desirable, for example, when the disclosed shutter assembly 100 includes one or more additional shutter panels configured to be rotationally driven by the common motor 156. In such an embodiment, the louver drive shafts of an adjacent panel may be coupled to the louver drive shafts 170, 176 of the second shutter panel 104B (e.g., via the coupling members 2008, 2010) to allow the louvers of the adjacent panel to be rotationally driven by the motor 156.

Figure 46:
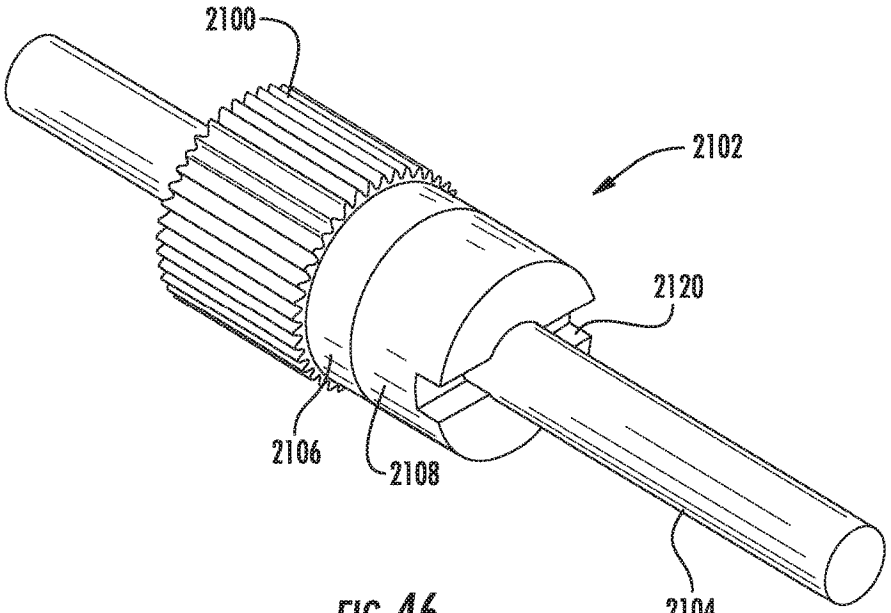
FIG. 46 illustrates a perspective view of one illustrative embodiment of a gear having a clutch associated therewith in accordance with aspects of the present subject matter.
Figure 47:
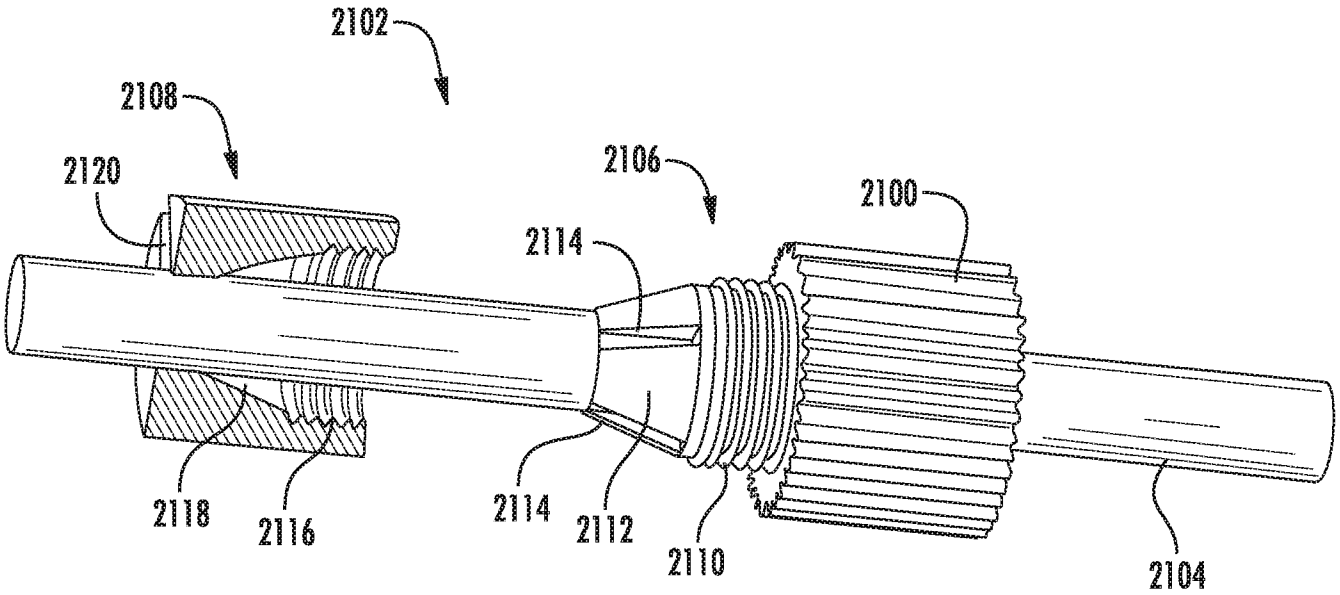
FIG. 47 illustrates another perspective view of the gear and clutch shown in FIG. 46, particularly illustrating a portion of the clutch exploded away from another portion of the clutch and being shown in cross-section.

Referring now to FIGS. 46 and 47, differing views of another illustrative embodiment of a drive gear 2100 configured for use within a rack and pinion-type drive arrangement are illustrated in accordance with aspects of the present subject matter, particularly illustrating the drive gear 2100 provided in operative association with a correspond gear clutch 2102. Specifically, FIG. 46 illustrates a perspective view of the gear 2100 and associated clutch 2102 in an assembled state relative to a corresponding louver drive shaft 2104 (e.g., any of the louver drive shafts 168, 170, 174, 176 described above). Additionally, FIG. 47 illustrates another perspective view of the gear 2100 and clutch 2102 shown in FIG. 46, with a portion of the clutch 2102 being exploded away from the gear 2100 and shown in cross-section for illustrative purposes.

As shown, the clutch 2102 may include a first clutch member 2106 coupled to or formed integrally with the drive gear 2100 and a second clutch member 2108 configured to be removably coupled to the first clutch member 2106. The first clutch member 2108 may generally include a first threaded portion 2110 extending outwardly from the drive gear 2100 and a first tapered or frustoconical portion 2112 extending around the louver drive shaft 2104. In one embodiment, the louver drive shaft 2104 may be configured to extend through the drive gear 2100 and the first threaded portion 2110 of the first clutch member 2106 without rotationally engaging such components. Additionally, as will be described below, the first frustoconical portion 2112 may be configured to engage the louver drive shaft 2104 such that a frictional interface is defined between the first clutch member 2106 and the shaft 2104, with the amount of friction provided at the frictional interface being adjustable based on the position of the second clutch member 2108 relative to the first clutch member 2106. Moreover, as shown in FIG. 47, the first clutch member 2106 may also include one or more cut-out portions 2114 defined through the first frustoconical portion 2112 to facilitate adjusting the diameter of the first frustoconical portion 2112 relative to the louver drive shaft 2014.

The second clutch member 2108 may generally include a second threaded portion 2116 configured to be screwed onto the first threaded portion 2110 of the first clutch member 2106 (e.g., by using a tool configured to engage a slot 2120 defined on the exterior/end of the second clutch member 2108) and a second tapered or frustoconical portion 2118 configured to receive the first frustoconical portion 2112 of the first clutch member 2106. In such an embodiment, by screwing the second threaded portion 2116 onto the first threaded portion 2110 in a manner that results in the second clutch member 2108 moving towards the drive gear 2100, the second frustoconical portion 2118 of the second clutch member 2108 may press inwardly against the first frustoconical portion 2112 of the first clutch member 2106, thereby tightening the first frustoconical portion 2112 around the louver drive shaft 2104 and, thus, increasing the friction between the first clutch member 2106 and the shaft 2104. Similarly, by screwing the second threaded portion 2116 relative to the first threaded portion 2110 in a manner that results in the second clutch member 2108 moving away from the drive gear 2100, the second frustoconical portion 2118 of the second clutch member 2108 may be moved away from the first frustoconical portion 2112 of the first clutch member 2106 to allow the first frustoconical portion 2112 expand outwardly relative to the louver drive shaft 2104, thereby decreasing the friction between the first clutch member 2106 and the shaft 2104.

Figure 48:
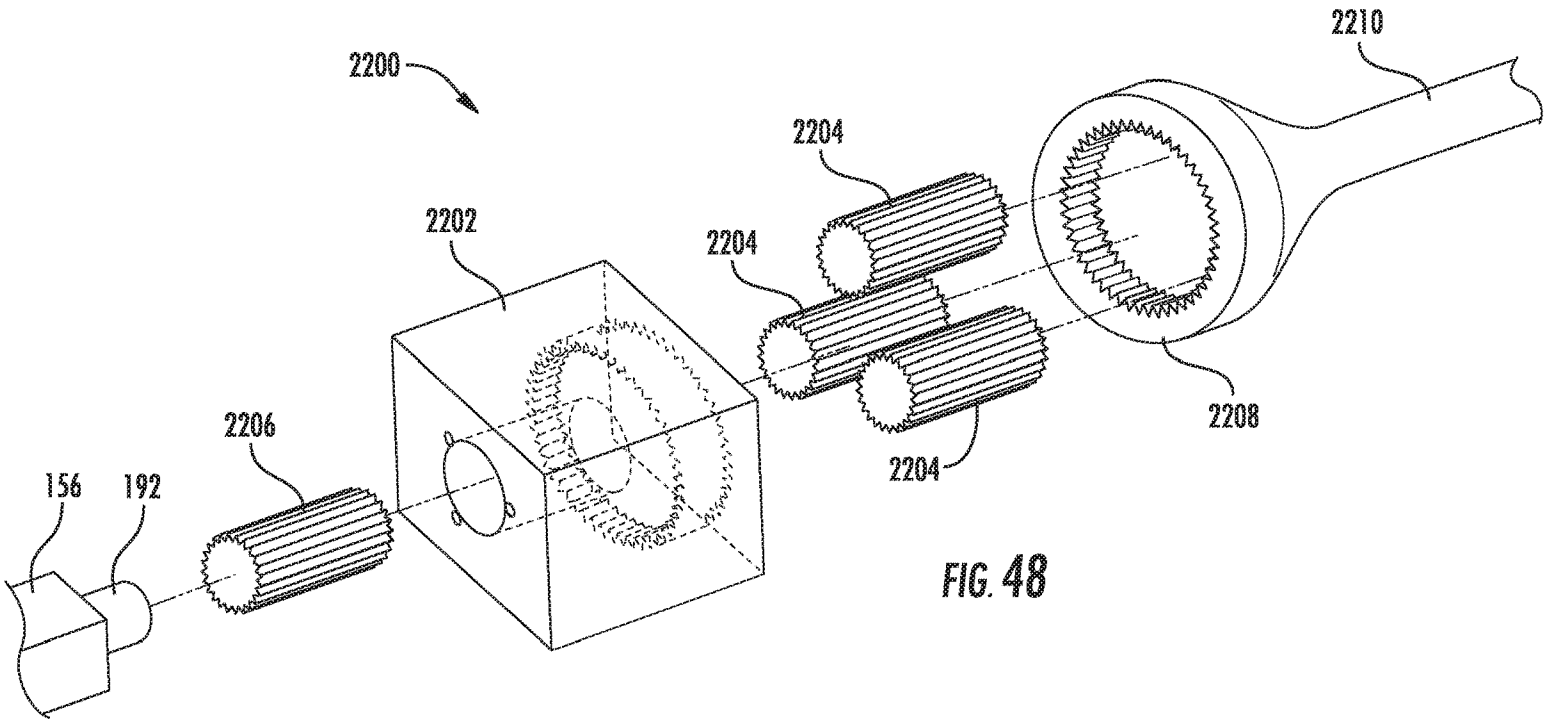
FIG. 48 illustrates an exploded, perspective view of one illustrative embodiment of an in-line gearbox configured for use within the disclosed shutter assembly in accordance with aspects of the present subject matter.

Referring now to FIG. 48, a perspective, exploded view of one embodiment of an inline gearbox 2200 for increasing the torque transmitted from the motor 158 of the disclosed shutter assembly 100 is illustrated in accordance with aspects of the present subject matter. As shown, the inline gearbox 2200 may include an outer frame or housing 2202 configured to encase a plurality of planetary gears 2204 (e.g., three planetary gears). The planetary gears 2204 may be fixed within the housing 2202 and may be configured to be driven via a sun gear 2206 coupled an output shaft 192 of the motor 156. The planetary gears 2204 may, in turn, drive a ring gear 2208 coupled to an output drive shaft 2210 (e.g., the motor drive shaft 158 described above) to allow torque to be transferred through the remainder of the drive train of the shutter assembly 100.

Figure 49:
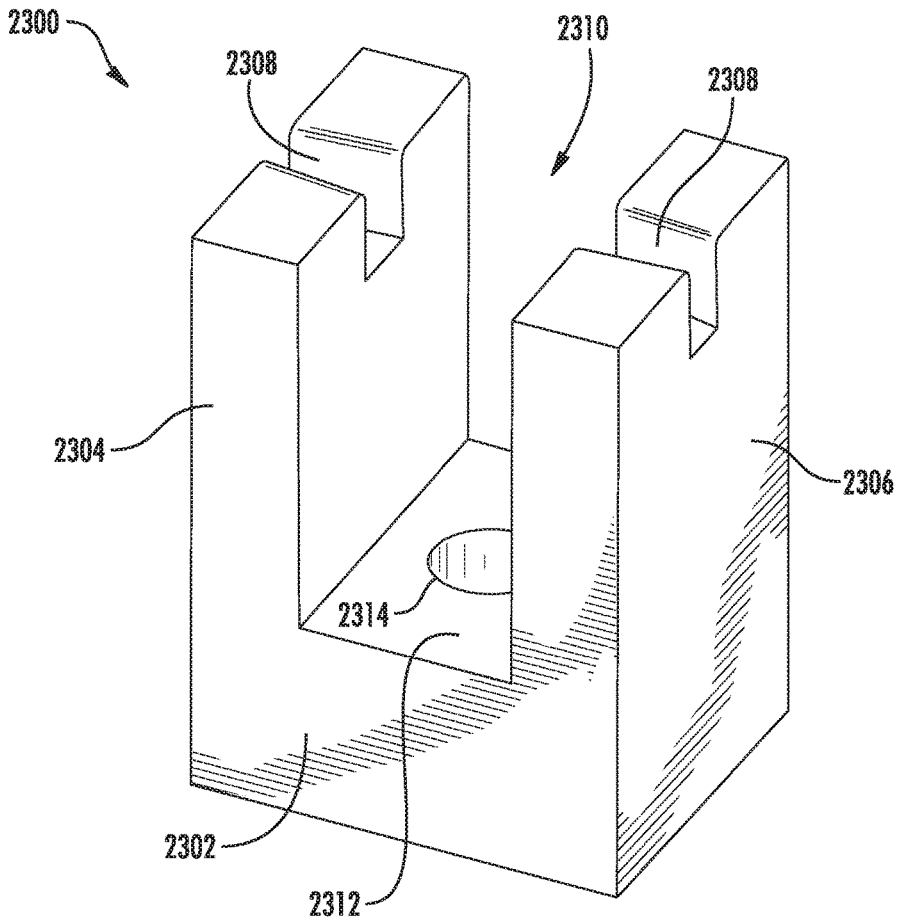
FIG. 49 illustrates a perspective view of one illustrative embodiment of drilling alignment tool suitable for use when manufacturing the disclosed shutter assembly in accordance with aspects of the present subject matter.

Referring now to FIG. 49, a perspective view of an alignment tool 2300 for drilling properly aligned holes within the stile(s) 116, 118, 226, 228 of the disclosed shutter assembly 100 to accommodate one or more of the louver shafts 168, 170, 172, 174, 176, 178 is illustrated in accordance with aspects of the present subject matter. As shown, the alignment tool 2300 may include a base portion 2302 and first and second arm portions 2304, 2306 extending outwardly from the base portion 2302. Each arm portion 2304, 2306 may define a louver channel 2308 at its top end. Additionally, the first and second arm portions 2306, 2308 may be spaced apart from each other such that a stile channel 2310 is defined between the arm portions 2306, 2308 that is configured to receive the stile 116, 118, 226, 228 being drilled. For instance, when the alignment tool 2300 is positioned relative to a stile, the stile may be received with the stile channel 2310 such that the outer face of the stile (e.g., the side positioned furthest away from the louvers 114) contacts an inner surface 2312 of the base portion 2302 and the arm portions 2304, 2306 extend outwardly to the opposing side of the stile to allow the adjacent louver 114 to be received within the louver channels 2308. With the stile positioned within the stile channel 2310 and the adjacent louver 114 within the louver channels 2308, a drill bit may be inserted through a guide hole 2314 defined through the base portion 2302 to allow a suitable opening to be drilled through the stile.

Figure 51:
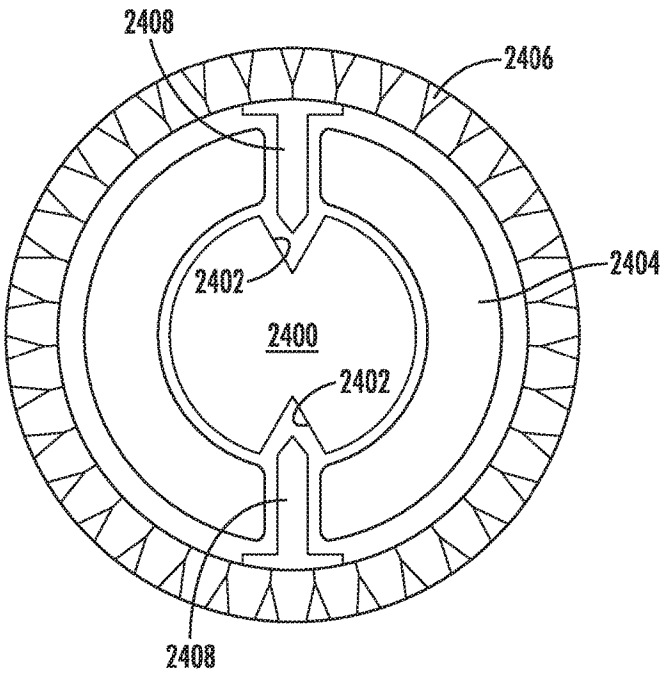
FIG. 51 illustrates a cross-sectional view of the drive shaft shown in FIG. 51 installed relative to components of a gear of the disclosed shutter assembly in accordance with aspects of the present subject matter.
Figure 50:
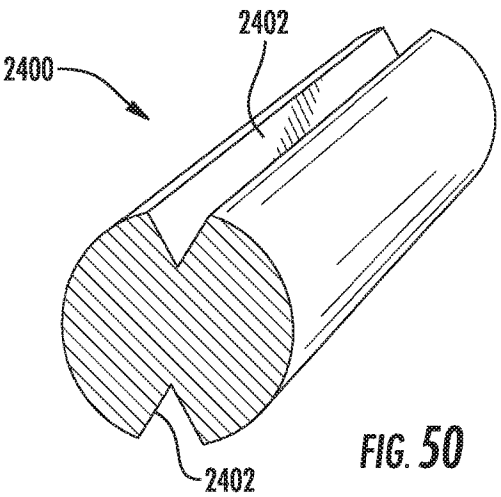
FIG. 50 illustrates a partial, perspective view of a drive shaft suitable for use within the disclosed shutter assembly in accordance with aspects of the present subject matter.

Referring now to FIGS. 50 and 51, differing views of one illustrative embodiment of a drive shaft 2400 that may be utilized within the disclosed shutter assembly 100 are illustrated in accordance with aspects of the present subject matter. Specifically, FIG. 50 illustrates a perspective view of a portion of the drive shaft 2400 and FIG. 51 illustrates a cross-sectional view an attachment configuration for coupling the drive shaft 2400 to a shaft gear(s) of a gearbox of the disclosed shutter assembly 100 (e.g., one or more of the shaft gears 220, 222, 320 described above).

In several embodiments, the drive shaft 2400 may be designed to have a configuration that reduces or eliminates backlash within the drive train of the shutter assembly 100. As shown in the illustrated embodiment, the drive shaft 2400 may include two notches 2402 (e.g., "V-shaped" notches) extending along its length. Additionally, as shown in FIG. 51, when coupling the drive shaft 2400 to a shaft gear of a gearbox, the drive gear 2400 may include or be coupled to a threaded housing 2404 having an adjustable nut 2406 configured to be received on the threaded housing 2404. Moreover, in one embodiment, shaft prongs 2408 may be configured to extend inwardly from the adjustable nut 2406 through the threaded housing 2404 to allow each prong 2408 to be received within one of the notches 2402. In such an embodiment, when the adjustable nut 2406 is moved along the length of the threaded housing 2404 in a given direction (e.g., by turning the nut 2406 in a tightening direction relative to the housing 2404), the prongs 2408 may be pressed inwardly towards the shaft 2400, thereby reducing the spacing between the prongs 2408 and the shaft 2400 and, thus, reducing backlash between the shaft 2400 and the associated shaft gear.

Figure 52:
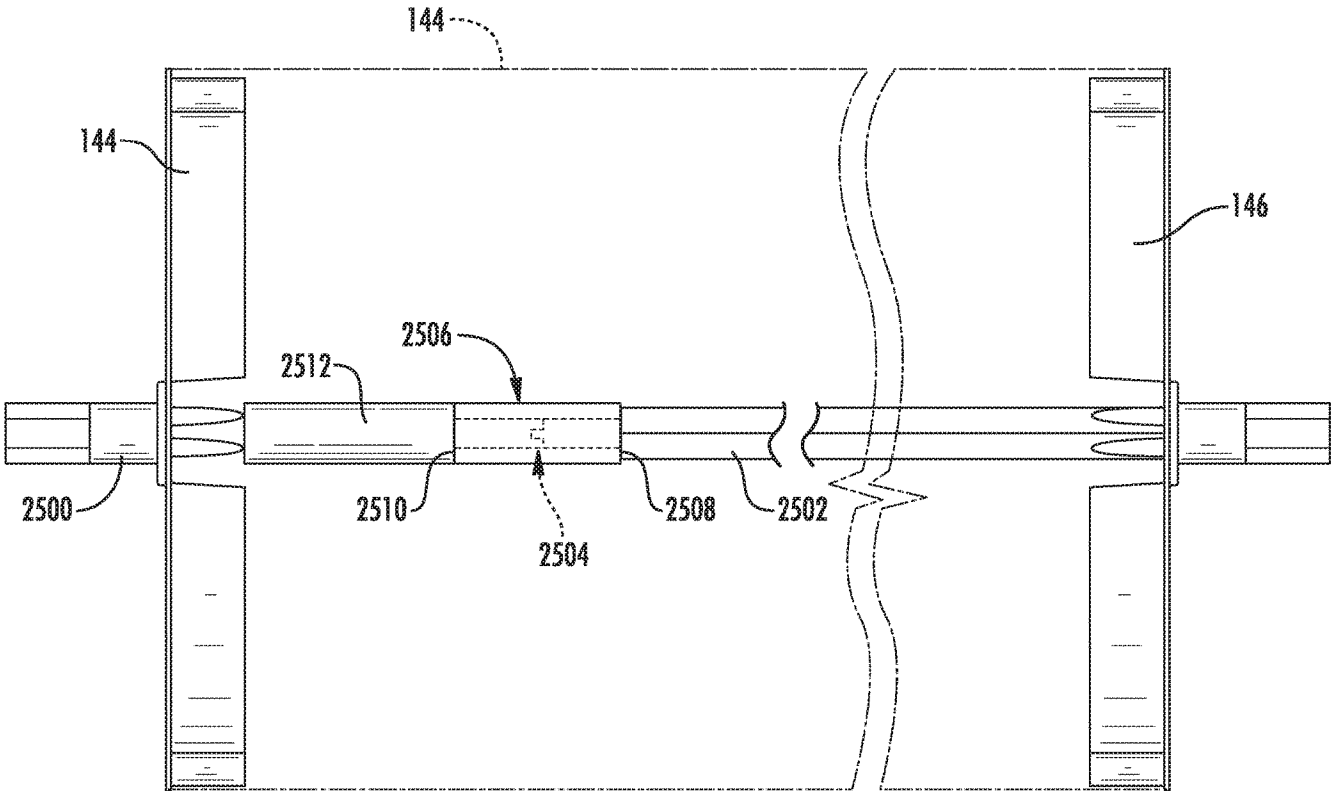
FIG. 52 illustrates a top view of one illustrative embodiment of a means for coupling adjacent ends of shafts or shaft sections to each other within the interior of a louver in accordance with aspects of the present subject matter.

Referring now to FIG. 52, a simplified view of another illustrative embodiment of a means for coupling adjacent shafts or shaft sections 2500, 2502 to each other is illustrated in accordance with aspects of the present subject matter. As shown in FIG. 52, the adjacent ends of first and second shaft sections 2500, 2502 extending within the interior of a louver 114 may be coupled to each other to form a joint 2504 between the shaft sections 2500, 2502. For instance, in the illustrated embodiment, a tongue and groove-type joint is defined between the adjacent ends of the shaft sections 2500, 2502. However, in other embodiments, the shaft sections 2500, 2502 may be coupled to each other at the joint 2504 using any other suitable connection means.

Additionally, as shown in FIG. 52, the ends of the shaft sections 2500, 2502 may be configured to be received within a coupling sleeve 2506 extending lengthwise between a first end 2508 and a second end 2510 such that the joint 2506 defined between the shaft sections 2500, 2502 is positioned between the opposed ends 2508, 2510 of the coupling sleeve 2506. As such, the coupling sleeve 2506 may serve to maintain a secure connection between the adjacent ends of the shaft sections 2500, 2502. Moreover, as shown in FIG. 52, a suitable clutch 2512 may be provided in operative association with one of the shaft sections (e.g., the first shaft section 2500) to allow one or both of the shaft sections 2500, 2502 to be disengaged from the motor 156 when manually adjusting the position of the associated louver 114.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A shutter assembly, comprising:

a first shutter panel including a first shutter frame and at least one first louver configured to rotate relative to said first shutter frame, said first shutter panel further including at least one first shaft extending within said at least one first louver;

a second shutter panel including a second shutter frame and at least one second louver configured to rotate relative to said second shutter frame, said second shutter frame configured to extend adjacent to said first shutter frame at a panel-to-panel interface defined between said first and second shutter panels, said second shutter panel further including at least one second shaft extending within said at least one second louver;

a motor rotatably coupled to said at least one first shaft;

a first coupling member coupled to an end of said at least one first shaft; and a second coupling member coupled to an end of said at least one second shaft;

wherein said first and second coupling members are configured to engage each other at the panel-to-panel interface such that rotational motion of said at least one first shaft is transferred to said at least one second shaft across the panel-to-panel interface.

2. A shutter assembly as in claim 1, wherein said first and second coupling members are configured to engage each other at the panel-to-panel interface via a male/female-type coupling joint defined between said first and second coupling members.

3. A shutter assembly as in claim 2, wherein said first coupling member includes a post configured to be received within a corresponding slot defined by said second coupling member.

4. A shutter assembly as in claim 1, wherein at least one of said first coupling member or said second coupling member is spring-loaded.

5. A shutter assembly of claim as in claim 1, wherein a depth of at least one of said first coupling member or said second coupling member is adjustable at the panel-to-panel interface.

6. A shutter assembly as in claim 1, wherein:

said at least one first louver comprises a driven louver of said first shutter panel;

said at least one first shaft comprises a louver drive shaft extending within said drive louver; and said louver drive shaft is configured to rotationally engage said driven louver.

7. A shutter assembly as in claim 6, further comprising a clutch positioned within said driven louver, a portion of said clutch being configured to slip relative to said louver drive shaft when said driven louver is manually rotated.

8. A shutter assembly as in claim 1, wherein said at least one first shaft comprises a pass-through louver shaft extending through said at least one first louver without rotationally engaging said at least one first louver.

9. A shutter as in claim 1, further comprising a clutch configured to rotationally disengage said at least one first shaft from said motor during manual operation of said shutter.

10. A shutter as in claim 1, wherein said first coupling member is configured to be rotated relative to said second coupling member when said first and second coupling members are initially misaligned at the panel-to-panel interface until said first and second coupling members rotationally engage each other.

11. A shutter as in claim 1, further comprising a clutch provided in operative association with one of the first coupling member or the second coupling member.

12. A shutter as in claim 11, wherein said clutch is adjustable to adjust an amount of friction required for said clutch to slip.

13. A shutter assembly as in claim 1, wherein said first and second coupling members are configured to directly engage each other at the panel-to-panel interface.

14. A shutter assembly as in claim 1, wherein said first and second coupling members are configured to engage each other at the panel-to-panel interface such that rotational motion of said at least one first shaft is transferred to said at least one second shaft via the engagement provided between the first and second coupling members.

15. A shutter assembly as in claim 1, wherein:

said at least one first shaft extends lengthwise between a first end of said at least one first shaft and a second end of said at least one first shaft opposite said first end;

said motor is coupled to said first end of said at least one first shaft; and said second end of said at least one first shaft is positioned at or adjacent to said interface defined between said first and second shutter panels.

16. A shutter assembly as in claim 1, wherein said first and second shutter panels are movable relative to each other.

17. A shutter assembly as in claim 4, wherein:

said first shutter frame includes a first side and a second side opposite said first side;

said motor being supported by said first shutter panel at or adjacent to said first side of said shutter frame; and said interface being defined at or adjacent to said second side of said shutter frame.

18. A shutter assembly, comprising:

a first shutter panel including a first shutter frame and at least one first louver configured to rotate relative to said first shutter frame, said first shutter panel further including at least one first shaft associated therewith;

a second shutter panel including a second shutter frame and at least one second louver configured to rotate relative to said second shutter frame, said second shutter frame configured to extend adjacent to said first shutter frame at a panel-to-panel interface defined between said first and second shutter panels, said second shutter panel further including at least one second shaft associated therewith;

a first coupling member coupled to an end of said at least one first shaft; and a second coupling member coupled to an end of said at least one second shaft;

wherein said first and second coupling members are configured to engage each other at the panel-to-panel interface such that rotational motion of said at least one first shaft is transferred to said at least one second shaft across the panel-to-panel interface.

19. A shutter assembly as in claim 18, wherein said first and second coupling members are configured to engage each other at the panel-to-panel interface via a male/female-type coupling joint defined between said first and second coupling members.

20. A shutter assembly as in claim 19, wherein said first coupling member includes a post configured to be received within a corresponding slot defined by said second coupling member.

21. A shutter assembly as in claim 18, wherein a depth of at least one of said first coupling member or said second coupling member is adjustable at the panel-to-panel interface.

22. A shutter assembly as in claim 18, further comprising a motor rotatably coupled to said at least one first shaft.

23. A shutter assembly as in claim 18, wherein:

said at least one first shaft extends within said at least one first louver; and said at least one second shaft extends within said at least one second louver.

24. A shutter assembly as in claim 23, wherein said at least one first shaft comprises a pass-through louver shaft extending through said at least one first louver without rotationally engaging said at least one first louver.

* * * * *